US011560605B2

(12) United States Patent
Branagan et al.

(10) Patent No.: US 11,560,605 B2
(45) **Date of Patent: *Jan. 24, 2023**

(54) HIGH YIELD STRENGTH STEEL WITH MECHANICAL PROPERTIES MAINTAINED OR ENHANCED VIA THERMAL TREATMENT OPTIONALLY PROVIDED DURING GALVANIZATION COATING OPERATIONS

(71) Applicant: United States Steel Corporation, Pittsburgh, PA (US)

(72) Inventors: Daniel James Branagan, Idaho Falls, ID (US); Andrew E. Frerichs, Idaho Falls, ID (US); Brian E. Meacham, Idaho Falls, ID (US); Grant G. Justice, Idaho Falls, ID (US); Kurtis Clark, Idaho Falls, ID (US); Logan J. Tew, Idaho Falls, ID (US); Scott T. Anderson, Idaho Falls, ID (US); Scott Larish, Idaho Falls, ID (US); Sheng Cheng, Idaho Falls, ID (US); Alla V Sergueeva, Idaho Falls, ID (US)

(73) Assignee: United States Steel Corporation, Pittsburgh, PA (US)

( * ) Notice: Subject to any disclaimer, the term of this patent is extended or adjusted under 35 U.S.C. 154(b) by 260 days.

This patent is subject to a terminal disclaimer.

(21) Appl. No.: 16/783,467

(22) Filed: Feb. 6, 2020

(65) Prior Publication Data

US 2020/0255918 A1 Aug. 13, 2020

Related U.S. Application Data

(60) Provisional application No. 62/804,932, filed on Feb. 13, 2019.

(51) Int. Cl.

| | |
|---|---|
| ***C21D 9/46*** | (2006.01) |
| ***C21D 8/02*** | (2006.01) |
| ***C21D 6/00*** | (2006.01) |
| ***C22C 38/58*** | (2006.01) |
| ***C22C 38/20*** | (2006.01) |
| ***C22C 38/02*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0236* (2013.01); *C21D 8/0273* (2013.01); *C22C 38/02* (2013.01); *C22C 38/20* (2013.01); *C22C 38/58* (2013.01)

(58) Field of Classification Search

CPC ..... C21D 6/004; C21D 6/005; C21D 6/008; C21D 8/0205; C21D 8/0236; C21D 8/0273; C21D 9/46; C22C 38/02; C22C 38/20; C22C 38/34; C22C 38/42; C22C 38/58

See application file for complete search history.

(56) References Cited

U.S. PATENT DOCUMENTS

| | | | |
|---|---|---|---|
| 2009/0014095 | A1 | 1/2009 | Mukai et al. |
| 2013/0233452 | A1 | 9/2013 | Branagan et al. |
| 2015/0114587 | A1 | 4/2015 | Branagan et al. |
| 2016/0115562 | A1 | 4/2016 | Santacreu et al. |
| 2016/0145725 | A1 | 5/2016 | Branagan et al. |
| 2016/0319387 | A1 | 11/2016 | Kim et al. |
| 2018/0010204 | A1* | 1/2018 | Branagan ..... C22C 38/58 |

FOREIGN PATENT DOCUMENTS

| | | |
|---|---|---|
| CN | 104328360 A | 2/2015 |
| WO | 2015099217 A1 | 7/2015 |

OTHER PUBLICATIONS

Continuous hot dip galvanizing—process and products Gary W. Dallin Galvinfor Center Nov. 2014 (Year: 2014).*

Zhang et al., Radiometric Temperature Measurements, Elsevier/Academic Press, 2010.

* cited by examiner

*Primary Examiner* — Jenny R Wu

(74) *Attorney, Agent, or Firm* — Alan G. Towner; Leech Tishman Fuscaldo & Lampl

(57) ABSTRACT

This disclosure is related to high yield strength steel where mechanical properties, such as elongation, ultimate tensile strength and yield strength in a sheet are maintained or enhanced via thermal treatment optionally provided during a galvanization coating operation.

20 Claims, 66 Drawing Sheets

HIGH YIELD STRENGTH STEEL WITH MECHANICAL PROPERTIES MAINTAINED OR ENHANCED VIA THERMAL TREATMENT OPTIONALLY PROVIDED DURING GALVANIZATION COATING OPERATIONS

CROSS-REFERENCE

The present application claims the benefit of U.S. Provisional Application 62/804,932 filed Feb. 13, 2019, the teachings of which are incorporated herein by reference.

FIELD OF INVENTION

This disclosure is related to high yield strength steel. Due to the unique structures and mechanisms, yield strength can be increased without significantly affecting ultimate tensile strength (UTS) and in some cases, higher yield strength can be obtained without significant decrease in ultimate tensile strength and total elongation. These new steels can offer advantages for a myriad of applications where relatively high yield strength is desirable along with relatively high UTS and total elongation such as the passenger cage in automobiles. The elongation, ultimate tensile strength and yield strength are such that they can be maintained or even enhanced upon subsequent heat treatment that may be provided by a galvanization coating operation.

BACKGROUND

Third Generation Advanced High Strength Steels (AHSS) are currently being developed for automobile uses, and in particular automobile body applications. Advanced High-Strength Steels (AHSS) steels are classified by tensile strengths greater than 700 MPa with elongations from 4% to 30% and include such types as martensitic steels (MS), dual phase (DP) steels, transformation induced plasticity (TRIP) steels, and complex phase (CP) steels. Example targets for 3$^{rd}$ Generation AHSS are provided in the banana chart for autobody steels which is published by World Auto Steel (FIG. 1).

Tensile properties such as ultimate tensile strength (UTS) and total elongation are important benchmarks for establishing combinations of properties. However, AHSS materials are not generally classified by the yield strength (YS). Yield strength of a material is also of large importance to automobile designers since once a part is in service and if the part is stressed beyond yield, the part will permanently (plastically) deform. Materials that have high yield strength resist permanent deformation to higher stress levels than those with lower yield strength. This resistance to deformation is useful by allowing structures made from the material to withstand greater loads before the structure permanently deflects and deforms. Materials with higher yield strength can thereby enable automobile designers to reduce associated part weight through gauge reduction while maintaining the same resistance to deformation in the part. Many types of emerging grades of third generation AHSS suffer from low initial yield strengths, despite having various combinations of tensile strength and ductility.

A component in an automobile that experiences early yielding during normal service and undergoes permanent plastic deformation would be unacceptable based on most design criteria. In a crash event however, lower yield strengths, especially when coupled with a high strain hardening coefficient can be advantageous. This is especially true in the front and back ends of a passenger compartment which are often called the crumple zones. In these areas, a lower yield strength material with higher ductility can deform and strain harden increasing strength during the crash event leading to high levels of energy absorption due to the high starting ductility.

For other areas of the automobile, low yield strength would be unacceptable. Specifically, this would include what is called the passenger cage of an automobile. In the passenger cage, the materials utilized must have high yield strength since only very limited deformation/intrusion into the passenger cage is allowed. Once the passenger cage is penetrated this can lead to injury or death to the occupant(s). Thus, a material with high yield strength is required for these areas.

The yield strength of a material can be increased in a number of ways on the industrial scale. The material can be cold rolled a small amount (with a reduction <2%) in a process called temper rolling. This process introduces a small amount of plastic strain in the material, and the yield strength of the material is increased slightly corresponding to the amount of strain that the material was subjected to during the temper pass. Another method of increasing the yield strength in the material is through a reduction in the material's crystal grain size, known as Hall-Petch strengthening. Smaller crystal grains increase the required shear stress for the initial dislocation movement in the material, and the initial deformation is delayed until higher applied loads. The grain size can be reduced through process modifications such as altered annealing schedules to limit grain growth during the recrystallization and growth process that occurs during annealing after plastic deformation. Chemistry modifications to an alloy such as the addition of alloying elements that exist in solid solution can also increase the yield strength of a material, however the addition of these alloying elements must take place while the material is molten and may result in increased costs.

Developing high yield strength in the passenger cage from a low yield strength version of AHSS is a possible route. However, it is difficult in many metalworking operations to strain harden the finished part uniformly. This means that while the heavily cold worked areas of a part are much higher yield, there would still be lower yield strength areas which might then deform and cause an unacceptable intrusion into the passenger space.

Cold working steel from a fully annealed state is a known route to increase yield strength and tensile strength. It can be applied uniformly across a sheet during processing through cold rolling increasing the yield strength and tensile strength. However, this approach results in a decrease in total elongation and often to levels much below 20%. As elongation decreases, the cold forming ability also decreases, reducing the ability to produce parts with complex geometries resulting in a decrease in the usefulness of the AHSS. Higher ductility with a minimum of 30% total elongation is generally needed to form complex geometries through cold stamping processes. While processes such as roll forming can be used to create parts from lower elongation material, the geometric complexity of parts from these processes is limited. Cold rolling also can introduce anisotropy into the material which will farther reduce its ability to be cold formed into parts.

Steels, which are not stainless, corrode under normal atmospheric conditions and because the oxide spalls, the corrosion or rusting process often continue until failure. Zinc is reportedly used to coat steels and a zinc coating onto steel is applied through a process called galvanization. Zinc coating prevents the steel from corroding and, unlike for iron, the corrosion byproduct is adherent and provides additional corrosion protection.

SUMMARY

A method of forming a metal alloy into sheet comprising:

a. supplying a metal alloy comprising at least 70 atomic % iron and at least four or more elements selected from Si, Mn, Cr, Ni, Cu or C, melting said alloy, cooling at a rate of $10^{-4}$ K/sec to $10^{3}$ K/sec and solidifying to a thickness of >5.0 mm to 500 mm;

b. processing said alloy into a first sheet form with thickness from 0.5 to 5.0 mm;

c. permanently deforming said alloy in a temperature of ≤150° C. into a second sheet form, exhibiting the following tensile property combinations;
(1) total elongation of 2.0 to 35.0%;
(2) ultimate tensile strength of 1350 to 2300 MPa;
(3) yield strength of 950 to 2075 MPa;

d. applying a thermal exposure to said second sheet of ≥400° C. to ≤775° C. and for a time of ≥25 seconds to ≤225 seconds wherein said second sheet form, after said thermal exposure, has the following tensile property combinations:
(1) total elongation of 10.0% to 65.0%;
(2) ultimate tensile strength of 1100 MPa to 1600 MPa;
(3) yield strength of 500 MPa to 1500 MPa.

In the above, the thermal exposure in step (d) can optionally be provided during a zinc or zinc alloy galvanization coating procedure. Accordingly, the method herein may also be summarized also as follows:

A method of forming a metal alloy into sheet comprising:

a. supplying a metal alloy comprising at least 70 atomic % iron and at least four or more elements selected from Si, Mn, Cr, Ni, Cu or C, melting said alloy, cooling at a rate of $10^{-4}$ K/sec to $10^{3}$ K/sec and solidifying to a thickness of >5.0 mm to 500 mm;

b. processing said alloy into a first sheet form with thickness from 0.5 to 5.0 mm;

c. permanently deforming said alloy in a temperature of ≤150° C. into a second sheet form, exhibiting the following tensile property combinations;
(1) total elongation of 2.0 to 35.0%;
(2) ultimate tensile strength of 1350 to 2300 MPa;
(3) yield strength of 950 to 2075 MPa;

d. coating said sheet by exposing to a molten zinc or molten zinc alloy which provides a thermal exposure on said second sheet from ≥400° C. to ≤775° C. and for a time of ≥25 to ≤225 s wherein said second sheet form after said thermal exposure and coating of zinc or zinc alloy has the following tensile property combinations:
(1) total elongation of 10.0% to 65.0%;
(2) ultimate tensile strength of 1100 MPa to 1600 MPa;
(3) yield strength of 500 MPa to 1500 MPa.

The metallic alloys produced herein provide particular utility in vehicles, railway cars, railway tank cars/wagons, drill collars, drill pipe, pipe casing, tool joints, wellheads, compressed gas storage tanks or liquefied natural gas canisters. More specifically, the alloys find utility in vehicular bodies in white, vehicular frames, chassis, or panels and can be uncoated or zinc or zinc alloy coated/galvanized.

BRIEF DESCRIPTION OF THE DRAWINGS

The detailed description below may be better understood with reference to the accompanying FIG.s which are provided for illustrative purposes and are not to be considered as limiting any aspect of this invention.

DETAILED DESCRIPTION

Figure 1:
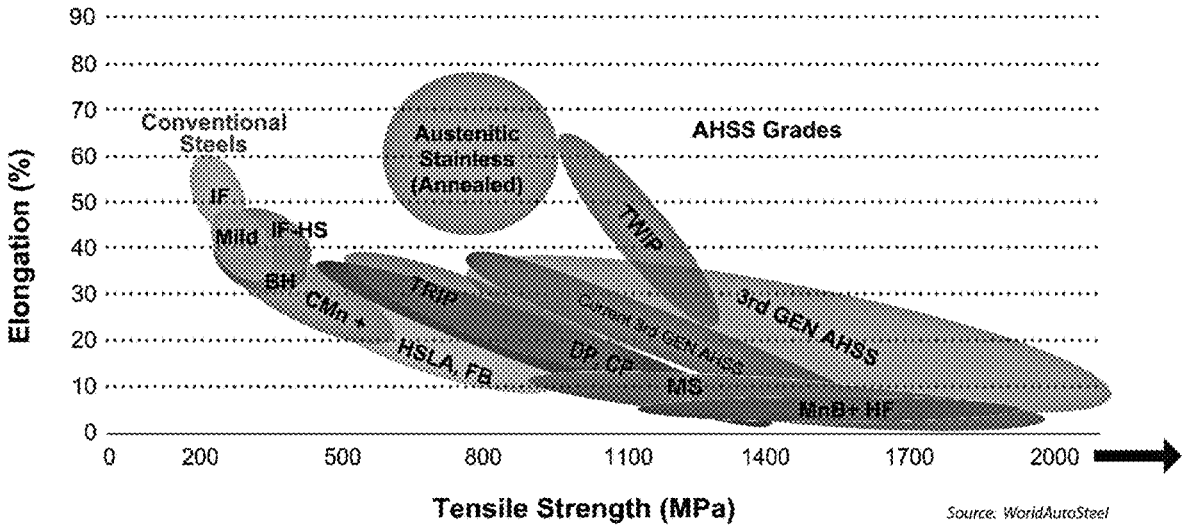
FIG. 1 World Auto Steel "Banana Plot" with targeted properties for 3$^{rd}$ Generation AHSS.
Figure 2:
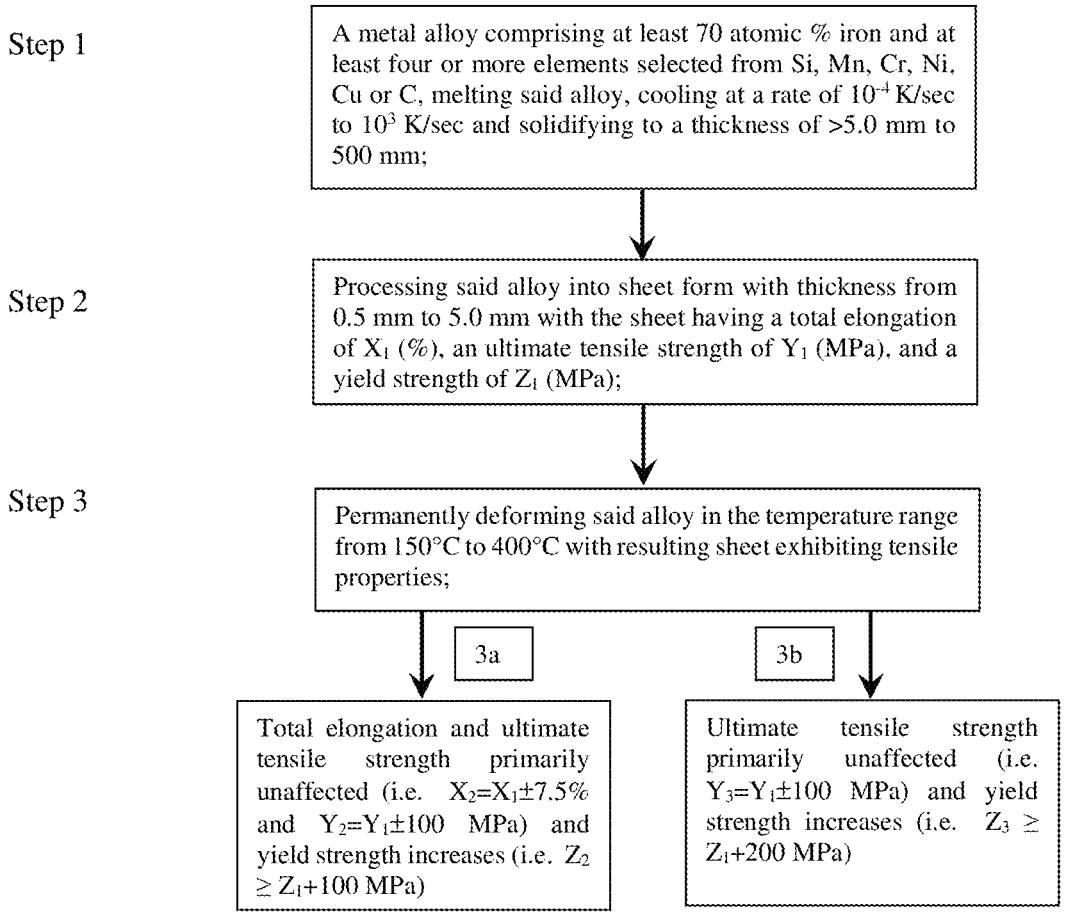
FIG. 2 Summary of Method 1 to produce high yield strength in alloys herein.

FIG. 2 represents a summary of preferred Method 1 to develop high yield strengths from a low yield strength material by a route which results in either of two conditions as provided in conditions 3a or 3b. In Step 1 of Method 1, the starting condition is to supply a metal alloy. This metal alloy will comprise at least 70 atomic % iron and at least four or more elements selected from Si, Mn, Cr, Ni, Cu or C. The alloy chemistry is melted and preferably cooled at a rate of $10^{-4}$ K/s to $10^{3}$ K/s and solidified to a thickness of >5.0 mm to 500 mm. The casting process can be done in a wide variety of processes including ingot casting, bloom casting, continuous casting, thin slab casting, thick slab casting, thin strip casting, belt casting etc. Preferred methods would be continuous casting in sheet form by thin slab casting, thick slab casting, and thin strip casting. Preferred alloys would exhibit a fraction of austenite (γ-Fe) at least 10 volume percent up to 100 volume percent and all increments in between in the temperature range from 150 to 400° C.

In Step 2 of Method 1, the alloy is preferably processed into sheet form with thickness from 0.5 to 5.0 mm. This step 2 can involve hot rolling or hot rolling and cold rolling. If hot rolling the preferred temperature range would be at a temperature of 700° C. and below the Tm of said alloy. If cold rolling is employed, such is understood to be at ambient temperature. Note that after hot rolling or hot rolling and cold rolling, the sheet can be additionally heat treated, preferably in the range from a temperature of 650° C. to a temperature below the melting point (Tm) of said alloy.

The steps to produce sheet from the cast product can therefore vary depending on specific manufacturing routes and specific targeted goals. As an example, consider thick slab casting as one process route to get to sheet of this targeted thickness. The alloy would preferably be cast going through a water-cooled mold typically in a thickness range of 150 to 300 mm in thickness. The cast ingot after cooling would then be preferably prepared for hot rolling which may involve some surface treatment to remove surface defects including oxides. The ingot would then go through a roughing mill hot roller which may involve several passes resulting in a transfer bar slab typically from 15 to 100 mm in thickness. This transfer bar would then go through successive/tandem hot rolling finishing stands to produce hot band coils which are typically from 1.5 to 5.0 mm in thickness. If additional gauge reduction is needed, cold rolling can be done at various reductions per pass, variable number of passes and in different mills including tandem mills, Z-mills, and reversing mills. Typically, cold rolled thickness would be 0.5 to 2.5 mm thick. Preferably, the cold rolled material is annealed to restore the ductility lost from the cold rolling process either partially or completely at a temperature range from 650° C. to a temperature below the melting point (Tm) of said alloy.

Another example would be to preferably process the cast material through a thin slab casting process. In this case, after casting typically forms 35 to 150 mm in thickness by going through a water-cooled mold, the newly formed slab goes directly to hot rolling without cooling down with auxiliary tunnel furnace or induction heating applied to bring the slab directly up to targeted temperature. The slab is then hot rolled directly in multi-stand finishing mills which are preferably from 1 to 10 in number. After hot rolling, the strip is rolled into hot band coils with typical thickness from 1 to 5 mm in thickness. If further processing is needed, cold rolling can be applied in a similar manner as above. Note that bloom casting would be similar to the examples above but higher thickness might be cast typically from 200 to 500 mm thick and initial breaker steps would be needed to reduce initial cast thickness to allow it to go through a hot rolling roughing mill.

Notwithstanding the specific process in going from the cast material in Step 1 to Step 2, once the sheet is formed in the preferred range from 0.5 mm to 5.0 mm, the sheet will then exhibit a total elongation of $X_1$ (%), an ultimate tensile strength of $Y_1$ (MPa), and a yield strength of $Z_1$ (MPa). Preferred properties for this alloy would be ultimate tensile strength values from 900 to 2050 MPa, tensile elongation from 10 to 70%, and yield strength is in a range from 200 to 750 MPa.

In Step 3 of Method 1, the alloy is permanently (i.e. plastically) deformed in the temperature range from 150° C. to 400° C. Such permanent deformation may be provided by rolling and causing a reduction in thickness. This can be done for example during the final stages of the development of a steel coil. Rather than doing the traditional cold rolling for final gauge reduction with the sheet starting at ambient temperature, elevated temperature rolling is now preferably done in the targeted temperature range of 150 to 400° C. One method would be to heat the sheet to the targeted temperature range prior to going through the cold rolling mill. The sheet could be heated by a variety of methods including going through a tunnel mill, a radiative heater, a resistance heater, or an induction heater. Another method would be to heat directly the reduction rollers. A third example for illustration would be to low temperature batch anneal the sheet and then send this through the cold rolling mill(s) at the targeted temperature range. Alternatively, the sheet may be deformed at the elevated temperature range into parts using a variety of processes providing permanent deformation during the making of parts by various methods including roll forming, metal stamping, metal drawing, hydroforming etc.

Notwithstanding the specific process to permanently deform the alloy in the temperature range of 150 to 400° C., two distinct conditions can be formed which are shown in Condition 3a and Condition 3b in FIG. 2. In Condition 3a, comparing said alloy in Step 2 and after Step 3, the total elongation and ultimate tensile strength are relatively unaffected but the yield strength is increased. Specifically, the total elongation $X_2$ is equal to $X_1 \pm 7.5\%$, the tensile strength $Y_2$ is equal to $Y_1 \pm 100$ MPa, and the yield strength $Z_2$ is $\geq Z_1+100$ MPa. Preferred properties for this alloy in Condition 3a would be ultimate tensile strength values ($Y_2$) from 800 to 2150 MPa, tensile elongation ($X_2$) from 2.5% to 77.5%, and yield strength ($Z_2$)≥300 MPa. More preferably, yield strength may fall in the range of 300 to 1000 MPa.

In Condition 3b, comparing said alloy in Step 2 and after Step 3, the ultimate tensile strength is relatively unaffected but the yield strength is increased. Specifically, the ultimate tensile strength $Y_3$ is equal to $Y_1 \pm 100$ MPa and yield strength $Z_3$ is $\geq Z_1+200$ MPa. Preferred properties for this alloy in Condition 3b would be ultimate tensile strength values ($Y_3$) from 800 to 2150 MPa and yield strength ($Z_3$)≥400 MPa. More preferably, yield strength may fall in the range of 400 to 1200 MPa. In addition, unlike Condition 3a, the total elongation drop is greater than 7.5%, that is, in Step B, the total elongation ($X_3$) is defined as follows: $X_3<X_1-7.5\%$.

As will be shown by various case examples, with normal deformation, a metallic material will strain harden/work harden. This is shown for example by the strain hardening exponent (n) in the relationship $\sigma=K\,\varepsilon^n$ between stress ($\sigma$) and strain ($\varepsilon$). The ramifications of this is that as a material is permanently deformed the basic material properties change. Comparing the initial condition to the final condition will show the typical and expected behavior where yield strength and tensile strength is increased with commensurate reductions in total ductility. Specific case examples are provided to illustrate this effect and then contrast this with the new material behavior noted in this disclosure.

Figure 3A:
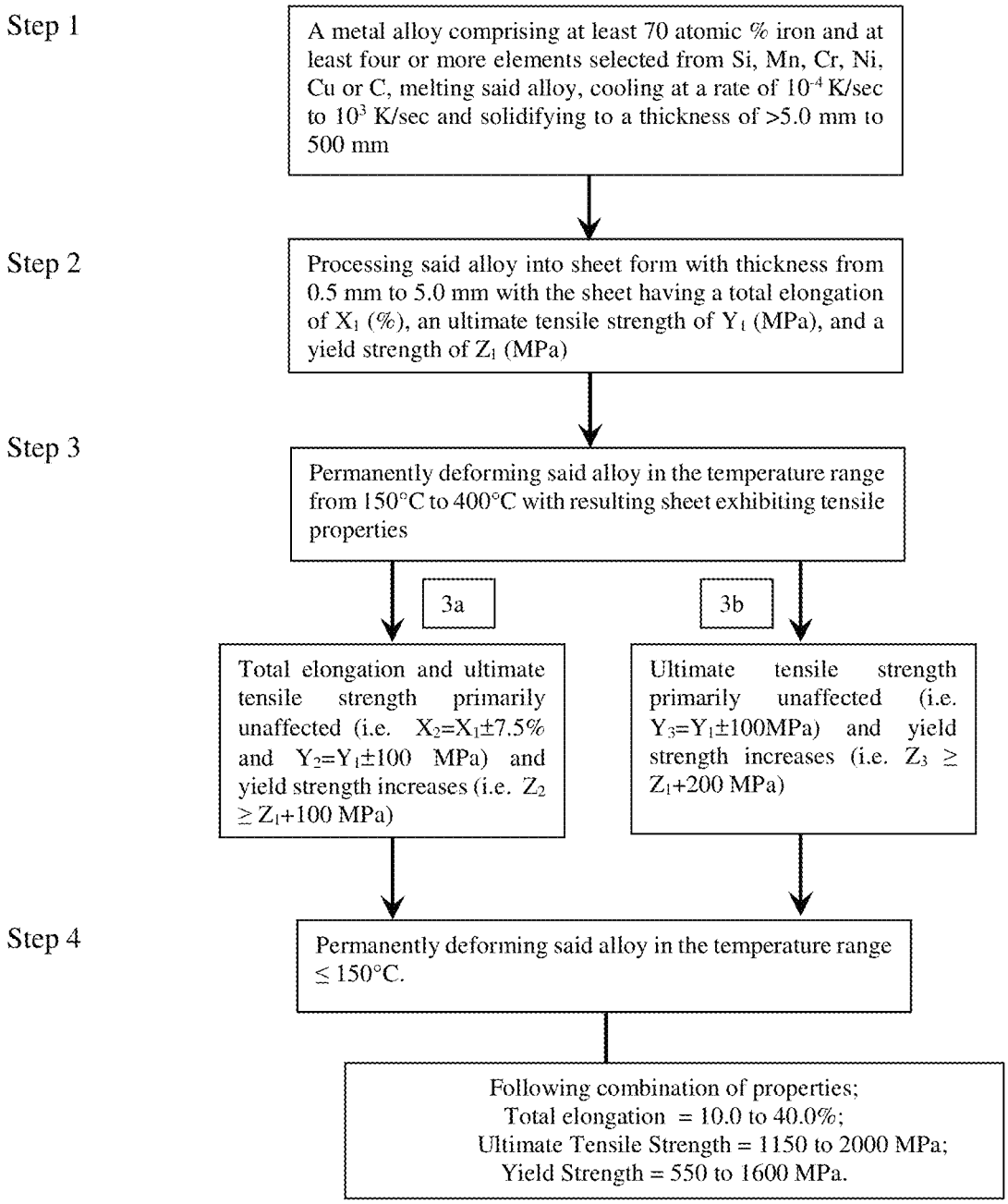
FIG. 3*a* Summary of Method 2 to produce high yield strength and targeted combinations of properties in the alloys herein.

FIG. 3*a* identifies a summary of Method 2 of the present disclosure. The first 3 steps in Method 2 are identical to Method 1 with Step 4 being an additional step for Method 2. As shown Step 4 can be applied to the alloys herein in either Condition 3a or Condition 3b.

As presented previously, in the description of FIG. 2, various combinations of properties (i.e. total elongation, ultimate tensile strength, and yield strength) are provided for each Condition 3a or 3b. As will be further illustrated in the detailed description and subsequent case examples, that alloys in Condition 3a or 3b may be further characterized by their particular structure. This then allows further tailoring of the final properties by the use of a further optional step of permanently deforming the alloys at temperatures from ambient to ≤150° C., or more preferably at a range of temperatures of 0° C. to 150° C. This can be done for example by adding another step during the production of steel coils as illustrated in FIG. 3. In this case Step 4 can be a skin pass (i.e. a small reduction rolling pass sometimes used also for improvements in surface quality or leveling) from 0.5 to 2.0% reduction or at greater reductions from >2% to 50% to develop specific combinations of properties. Alternate approaches can be done for example in making parts out of sheet which has been processed by Method 1. In optional Step 4 of Method 2, the sheet could be subsequently made into parts using a variety of deformation processes including roll forming, metal stamping, metal drawing, hydroforming etc. Notwithstanding the exact process to activate Step 4 in Method 2, final properties can be developed with the said alloy which are contemplated to exhibit properties with tensile elongation from 10 to 40%, ultimate tensile strength from 1150 to 2000 MPa, and yield strength from 550 to 1600 MPa).

Figure 3B:
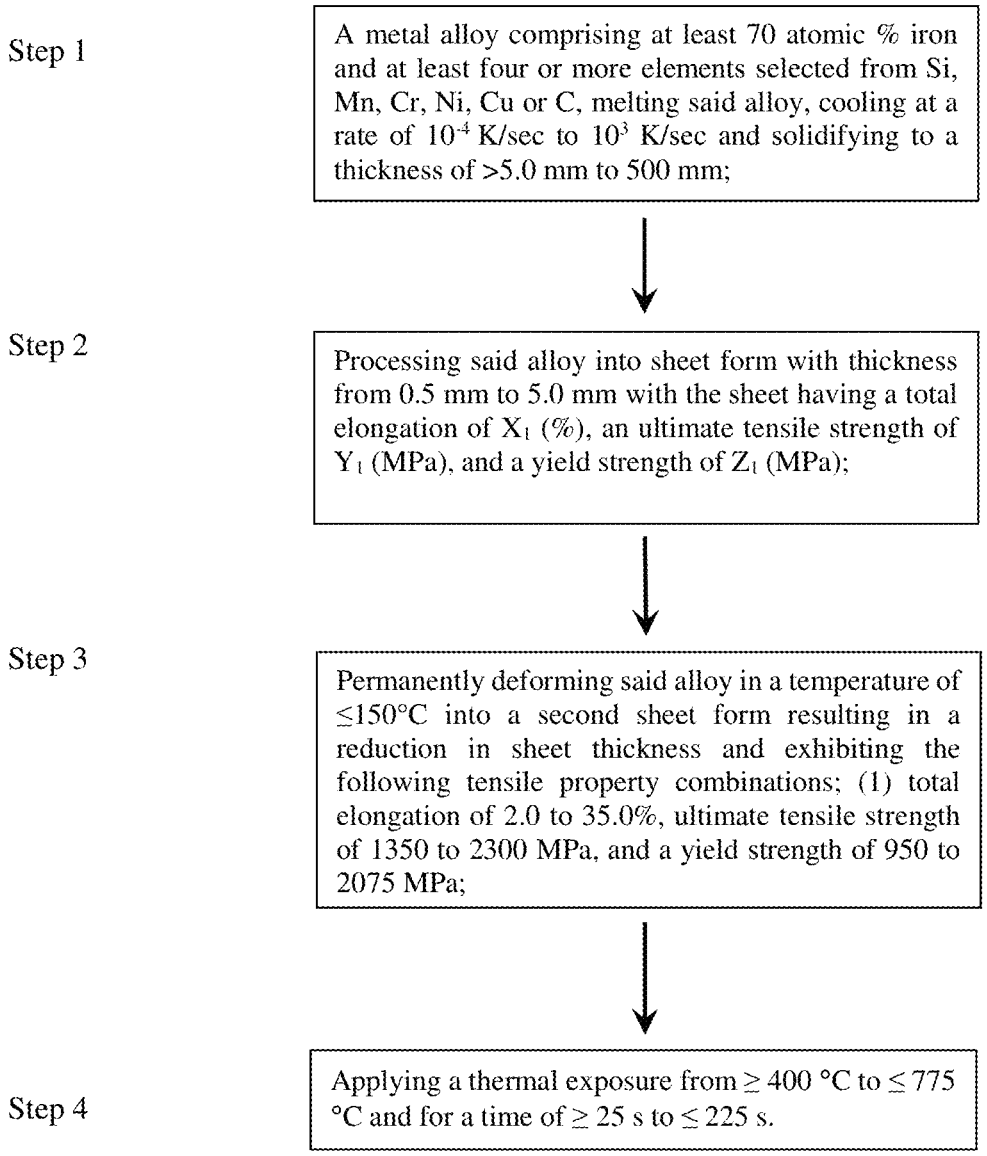
FIG. 3*b* Summary of Method 3 to produce high yield strength and targeted combinations of properties in the alloys herein.

FIG. 3*b* represents a summary of preferred Method 3 to develop high yield strength along with significant ductility. Steps 1 and 2 in Method 3 are identical to Steps 1 and 2 as shown previously in Method 1 and 2, in FIG. 2 and FIG. 3*a* respectively. Step 3 involves permanently deforming said alloy at a temperature of ≤150° C. into a second sheet form, resulting in a reduction in sheet thickness. Preferred embodiments involve a permanent deformation using cold rolling with a 10% reduction in thickness with the maximum reduction limited by the maximum strain level where cracking is initiated. Preferred thickness range after Step 3 is 0.45 mm to 4.5 mm. The preferred properties for the alloys herein after Step 3 of Method 3 are a total elongation of 2.0 to 35.0%, ultimate tensile strength of 1350 to 2300 MPa, and a yield strength of 950 to 2075 MPa.

Step 4 involves subjecting the reduced thickness sheet formed in Step 3 to a thermal exposure from ≥400° C. to ≤775° C. and for a time of ≥25 s to ≤225 s (s=seconds). Preferred properties for the alloys herein after Step 4 of Method 3 is a total elongation from 10.0 to 65%, ultimate tensile strength from 1100 to 1600 MPa, and yield strength from 500 to 1500 MPa. This provides an increase in the range of total elongation identified in Step 3 (2.0 to 35.0%) enabling subsequent forming operations including of roll forming, metal stamping, metal drawing, or hydroforming while preserving preferred levels of yield strength (i.e. 500 to 1500 MPa).

Step 4 of Method 3 is unique compared to Method 1 and Method 2, in that the thermal exposure which is applied is done without simultaneously applying stress/permanent deformation. Additionally, the thermal exposure in Step 4 of Method 3 of >400° C. to <750° C. is higher than that of Step 3 of Method 1 and Step 3 of Method 2.

The thermal exposure needed for Step 4 of Method 3 is preferably done in a relatively short continuous annealing manner as opposed to the relatively longer times that are found in batch annealing, such as 8 to 24 hours of time. These relatively long temperature exposures will result in deleterious changes in structure including complete recovery of cold work, recrystallization, and grain growth all of which will reduce ductility to levels below the preferred levels of yield strength (i.e. 500 to 1500 MPa). Preferably, the thermal exposure that is achieved in Step 4 is provided herein during a galvanization coating operation. Reference to a galvanization coating operation is reference to coating of the sheet from Step 3 by exposure to a bath of molten zinc or zinc alloys. Zinc alloys are those that contain additives (≤5.0 wt. % total) such as iron, aluminum, silicon, lead, cadmium, copper, magnesium, tin, or antimony. Such additives may therefore be present at a level of 0.1 wt. % up to 5.0 wt. %. This is often referred to as a hot dip galvanization process. Such hot dip galvanization process can be configured to provide the thermal exposure requirements noted herein (i.e. thermal exposure from ≥400° C. to ≤775° C. for a time of ≥25 seconds to ≤225 seconds. Typical thickness of zinc or zinc alloys applied, is from 5 μm to 100 μm thick which can be applied on one side or both sides of the sheet. As now can be appreciated, developing the aforementioned properties (a total elongation from 10.0 to 65%, ultimate tensile strength from 1100 to 1600 MPa, and yield strength from 500 to 1500 MPa) during a galvanization coating process is efficient from the perspective that two steps (coating and thermal exposure) are achieved in one.

Alloys

The structures and mechanisms in this application leading to the new process route for developing high yield strength are tied to the following chemistries of alloys provided in Table 1.

TABLE 1

| Chemical Composition of Alloys (Atomic %) | | | | | | | |
|---|---|---|---|---|---|---|---|
| Alloy | Fe | Cr | Ni | Mn | Si | Cu | C |
| Alloy 1 | 75.75 | 2.63 | 1.19 | 13.86 | 5.13 | 0.65 | 0.79 |
| Alloy 2 | 74.75 | 2.63 | 1.19 | 14.86 | 5.13 | 0.65 | 0.79 |
| Alloy 3 | 77.31 | 2.63 | 8.49 | 5.00 | 5.13 | 0.65 | 0.79 |
| Alloy 4 | 77.14 | 2.63 | 6.49 | 7.17 | 5.13 | 0.65 | 0.79 |
| Alloy 5 | 76.24 | 2.63 | 4.49 | 10.07 | 5.13 | 0.65 | 0.79 |
| Alloy 6 | 75.34 | 2.63 | 2.49 | 12.97 | 5.13 | 0.65 | 0.79 |
| Alloy 7 | 78.92 | 2.63 | 6.49 | 5.39 | 5.13 | 0.65 | 0.79 |
| Alloy 8 | 77.34 | 2.63 | 4.49 | 8.97 | 5.13 | 0.65 | 0.79 |
| Alloy 9 | 75.77 | 2.63 | 2.49 | 12.54 | 5.13 | 0.65 | 0.79 |
| Alloy 10 | 75.90 | 2.63 | 3.74 | 11.16 | 5.13 | 0.65 | 0.79 |
| Alloy 11 | 77.73 | 2.63 | 3.74 | 9.33 | 5.13 | 0.65 | 0.79 |
| Alloy 12 | 79.57 | 2.63 | 3.74 | 7.49 | 5.13 | 0.65 | 0.79 |
| Alloy 13 | 75.97 | 2.63 | 3.74 | 10.09 | 5.13 | 1.65 | 0.79 |
| Alloy 14 | 77.80 | 2.63 | 3.74 | 8.26 | 5.13 | 1.65 | 0.79 |
| Alloy 15 | 79.64 | 2.63 | 3.74 | 6.42 | 5.13 | 1.65 | 0.79 |
| Alloy 16 | 76.88 | 2.63 | 3.74 | 9.18 | 5.13 | 1.65 | 0.79 |
| Alloy 17 | 76.83 | 2.63 | 3.74 | 9.85 | 5.13 | 1.03 | 0.79 |
| Alloy 18 | 76.57 | 2.63 | 3.06 | 10.17 | 5.13 | 1.65 | 0.79 |
| Alloy 19 | 76.52 | 2.63 | 3.06 | 10.84 | 5.13 | 1.03 | 0.79 |
| Alloy 20 | 78.02 | 1.13 | 3.06 | 10.84 | 5.13 | 1.03 | 0.79 |
| Alloy 21 | 80.02 | 1.13 | 3.06 | 10.84 | 3.13 | 1.03 | 0.79 |
| Alloy 22 | 76.70 | 2.63 | 3.40 | 10.01 | 5.13 | 1.34 | 0.79 |
| Alloy 23 | 76.20 | 3.13 | 3.40 | 10.01 | 5.13 | 1.34 | 0.79 |
| Alloy 24 | 75.70 | 3.63 | 3.40 | 10.01 | 5.13 | 1.34 | 0.79 |
| Alloy 25 | 77.70 | 2.63 | 3.40 | 10.01 | 4.13 | 1.34 | 0.79 |
| Alloy 26 | 75.70 | 2.63 | 3.40 | 10.01 | 6.13 | 1.34 | 0.79 |
| Alloy 27 | 77.20 | 2.63 | 3.40 | 10.01 | 4.13 | 1.34 | 1.29 |
| Alloy 28 | 75.20 | 2.63 | 3.40 | 10.01 | 6.13 | 1.34 | 1.29 |
| Alloy 29 | 76.98 | 2.88 | 3.40 | 10.01 | 4.63 | 1.34 | 0.76 |
| Alloy 30 | 77.23 | 2.88 | 3.15 | 10.01 | 4.63 | 1.34 | 0.76 |
| Alloy 31 | 77.48 | 2.88 | 2.90 | 10.01 | 4.63 | 1.34 | 0.76 |
| Alloy 32 | 77.73 | 2.88 | 2.65 | 10.01 | 4.63 | 1.34 | 0.76 |
| Alloy 33 | 77.98 | 2.88 | 2.40 | 10.01 | 4.63 | 1.34 | 0.76 |
| Alloy 34 | 74.59 | 2.61 | 0.00 | 15.17 | 3.59 | 1.86 | 2.18 |
| Alloy 35 | 82.22 | 3.69 | 9.94 | 0.00 | 2.26 | 0.37 | 1.52 |
| Alloy 36 | 76.17 | 8.64 | 0.90 | 11.77 | 0.00 | 1.68 | 0.84 |
| Alloy 37 | 82.77 | 4.41 | 6.66 | 3.19 | 1.14 | 1.16 | 0.67 |
| Alloy 38 | 76.55 | 0.78 | 0.72 | 14.43 | 3.42 | 0.42 | 3.68 |
| Alloy 39 | 81.44 | 0.00 | 4.42 | 10.33 | 2.87 | 0.00 | 0.94 |
| Alloy 40 | 81.00 | 1.22 | 0.89 | 13.45 | 2.66 | 0.78 | 0.00 |
| Alloy 41 | 81.68 | 2.24 | 3.25 | 9.87 | 0.00 | 1.55 | 1.41 |

As can be seen from Table 1, the alloys herein are iron based metal alloys, having greater than 70 at. % Fe. In addition, it can be appreciated that the alloys herein are such that they comprise Fe and at least four or more, or five or more, or six elements selected from Si, Mn, Cr, Ni, Cu or C. Accordingly, with respect to the presence of four or more, or five or more elements selected from Si, Mn, Cr, Ni, Cu or C, such elements are present at the following indicated atomic percents: Si (0 to 6.5 at. %); Mn (0 to 15.5 at. %); Cr (0 to 9.0 at. %); Ni (0 to 10.5 at. %); Cu (0 to 2.5 at. %); and C (0 to 4.0 at. %). Most preferably, the alloys herein are such that they comprise, consist essentially of, or consist of Fe at a level of 70 at. % or greater along with Si, Mn, Cr, Ni, Cu and C, wherein the level of impurities of all other elements is in the range from 0 to 2000 ppm. With regards to minimum levels of the elements when selected, they would preferably be as follows: Si (1.0 at. %), Mn (3.0 at. %), Cr (0.5 at. %); Ni (0.5 at. %); Cu (0.25 at. %); C (0.5 at. %). In such regard, if Si is selected, it is preferably at a level of 1.0 at. % to 6.5 at. %, if Mn is selected, it is preferably at a level of 3.0 at. % to 15.5 at. %, if Cr is selected, it is preferably at a level of 0.5 at. % to 9.0 at. %, if Ni is selected, it is preferably at a level of 0.5 at. % to 10.5 at. %, if Cu is selected it is preferably at a level of 0.25 at. % to 2.5 at. %, if C is selected it is preferably at a level of 0.5 at. % to 4.0 at. %. It should be appreciated, however, that when selecting, e.g. a minimum level of Si, the levels of the other elements (including Fe) are preferably selected such that the atomic percent of all elements present (i.e. Fe, selected elements, impurities) totals 100 atomic percent. Finally, it should be appreciated that a preferred level of Fe is in the range of 70 atomic percent to 85 atomic percent.

Laboratory Slab Casting

Alloys were weighed out into 3,400 gram charges using commercially available ferroadditive powders and a base steel feedstock with known chemistry according to the atomic ratios in Table 1. As alluded to above, impurities can be present at various levels depending on the feedstock used. Impurity elements would commonly include the following elements; Al, Co, Mo, N, Nb, P, Ti, V, W, and S which if present would be in the range from 0 to 5000 ppm (parts per million) with preferred ranges of 0 to 500 ppm.

Charges were loaded into a zirconia coated silica crucible which was placed into an Indutherm VTC800V vacuum tilt casting machine. The machine then evacuated the casting and melting chambers and flushed with argon to atmospheric pressure twice prior to casting to prevent oxidation of the melt. The melt was heated with a 14 kHz RF induction coil until fully molten, approximately from 5 to 7 minutes depending on the alloy composition and charge mass. After the last solids were observed to melt it was allowed to heat for an additional 30 to 45 seconds to provide superheat and ensure melt homogeneity. The casting machine then evacuated the chamber and tilted the crucible and poured the melt into a 50 mm thick, 75 to 80 mm wide, and 125 mm deep channel in a water cooled copper die and would represent Step 1 in FIGS. 2 and 3. The process can be adapted to a preferred as-cast thickness at a range from >5.0 to 500 mm. The melt was allowed to cool under vacuum for 200 seconds before the chamber was filled with argon to atmospheric pressure.

Laboratory Hot Rolling

The alloys herein were preferably processed into a laboratory sheet. Laboratory alloy processing is developed to simulate the hot band production from slabs produced by continuous casting and would represent Step 2 in FIGS. 2 and 3. Industrial hot rolling is performed by heating a slab in a tunnel furnace to a target temperature, then passing it through a either a reversing mill or a multi-stand mill or a combination of both to reach the target gauge in a preferred temperature range from 700° C. up to the melting point (Tm) of the alloy. During rolling on either mill type the temperature of the slab is steadily decreasing due to heat loss to the air and to the work rolls so the final hot band is at a much reduced temperature. This is simulated in the laboratory by heating in a tunnel furnace to between 1100° C. and 1250° C., then hot rolling. The laboratory mill is slower than industrial mills causing greater loss of heat during each hot rolling pass so the slab is reheated for 4 minutes between passes to reduce the drop in temperature, the final temperature at target gauge when exiting the laboratory mill commonly is in the range from 1000° C. to 800° C., depending on furnace temperature and final thickness.

Prior to hot rolling, laboratory slabs were preheated in a Lucifer EHS3GT-B18 furnace to heat. The furnace set point varies between 1100° C. to 1250° C., depending on alloy melting point and point in the hot rolling process, with the initial temperatures set higher to facilitate higher reductions, and later temperatures set lower to minimize surface oxidation on the hot band. The slabs were allowed to soak for 40 minutes prior to hot rolling to ensure they reach the target temperature and then pushed out of the tunnel furnace into a Fenn Model 061 2 high rolling mill. The 50 mm casts are hot rolled for 5 to 10 passes though the mill before being allowed to air cool. Final thickness ranges after hot rolling are preferably from 1.8 mm to 4.0 mm with variable reduction per pass ranging from 20% to 50%.

After the hot rolling, the slab thickness has been reduced to a final thickness of the hot band from 1.8 to 2.3 mm. Processing conditions can be adjusted by changing the amount of hot rolling and/or adding cold rolling steps to produce the preferred thickness range from 0.5 to 5.0 mm. Tensile specimens were cut from laboratory hot band using wire EDM. Tensile properties were measured on an Instron mechanical testing frame (Model 3369), utilizing Instron's Bluehill control and analysis software. Tensile properties of the alloys in the hot rolled condition, are listed in Table 2 which have been processed to a thickness from 1.8 to 2.3 mm.

The ultimate tensile strength values may vary from 913 to 2000 MPa with tensile elongation from 13.8 to 68.5%. The yield strength is in a range from 250 to 711 MPa. Mechanical properties of the hot band from steel alloys herein depend on alloy chemistry, processing conditions, and material mechanistic response to the processing conditions.

TABLE 2

Tensile Properties of Alloys in Hot Rolled Condition

| | | Ultimate | | Strain Hardening Exponent (n) in a Strain Range | | |
|---|---|---|---|---|---|---|
| Alloy | Tensile Elongation (%) | Tensile Strength (MPa) | Yield Strength (MPa) | Yield Point to 5% | 5% to 15% | 25% to Max Stress |
| Alloy 1 | 51.4 | 1248 | 294 | 0.29 | 0.38 | 0.67 |
| | 49.2 | 1253 | 310 | 0.31 | 0.42 | 0.64 |
| | 31.2 | 1093 | 396 | 0.28 | 0.39 | 0.71 |
| Alloy 2 | 57.6 | 1175 | 311 | 0.29 | 0.38 | 0.83 |
| | 58.6 | 1209 | 294 | 0.31 | 0.40 | 0.64 |
| | 56.6 | 1167 | 302 | 0.29 | 0.38 | 0.45 |
| Alloy 3 | 55.4 | 1163 | 330 | 0.08 | 0.52 | 0.82 |
| | 59.5 | 1154 | 373 | 0.06 | 0.47 | 0.73 |
| | 58.1 | 1165 | 347 | 0.07 | 0.44 | 0.84 |
| Alloy 4 | 59.8 | 1220 | 342 | 0.12 | 0.40 | 0.78 |
| | 51.6 | 1241 | 338 | 0.12 | 0.41 | 0.78 |
| | 55.5 | 1245 | 375 | 0.10 | 0.38 | 0.80 |
| | 54.6 | 1324 | 377 | 0.11 | 0.41 | 0.77 |
| Alloy 5 | 54.3 | 1248 | 325 | 0.18 | 0.40 | 0.80 |
| | 53.1 | 1218 | 313 | 0.18 | 0.42 | 0.74 |
| | 50.6 | 1258 | 304 | 0.21 | 0.42 | 0.79 |
| | 54.1 | 1242 | 331 | 0.18 | 0.39 | 0.75 |
| Alloy 6 | 58.3 | 1212 | 330 | 0.21 | 0.38 | 0.71 |
| | 53.7 | 1212 | 283 | 0.26 | 0.42 | 0.72 |
| | 58.7 | 1193 | 315 | 0.23 | 0.40 | 0.72 |
| Alloy 7 | 28.1 | 1508 | 333 | 0.28 | 0.89 | — |
| | 28.5 | 1516 | 331 | 0.26 | 0.93 | — |
| | 26.0 | 1520 | 317 | 0.26 | 0.90 | — |
| Alloy 8 | 41.2 | 1343 | 330 | 0.17 | 0.44 | 0.78 |
| | 32.8 | 1281 | 328 | 0.17 | 0.44 | 0.94 |
| | 45.7 | 1387 | 336 | 0.16 | 0.42 | 0.71 |
| | 41.4 | 1375 | 328 | 0.17 | 0.42 | 0.84 |
| Alloy 9 | 48.1 | 1248 | 300 | 0.25 | 0.40 | 0.75 |
| | 50.5 | 1293 | 304 | 0.27 | 0.41 | 0.70 |
| | 52.0 | 1280 | 303 | 0.25 | 0.40 | 0.72 |
| Alloy 10 | 58.5 | 1229 | 379 | 0.18 | 0.31 | 0.73 |
| | 57.8 | 1223 | 384 | 0.18 | 0.32 | 0.72 |
| | 59.0 | 1220 | 389 | 0.19 | 0.31 | 0.71 |
| Alloy 11 | 45.3 | 1411 | 360 | 0.15 | 0.44 | 0.74 |
| | 40.2 | 1460 | 359 | 0.17 | 0.45 | 0.74 |
| | 41.3 | 1429 | 325 | 0.20 | 0.53 | 0.74 |
| | 47.1 | 1448 | 347 | 0.17 | 0.48 | 0.70 |

TABLE 2-continued

Tensile Properties of Alloys in Hot Rolled Condition

| | | Ultimate | | Strain Hardening Exponent (n) in a Strain Range | | |
|---|---|---|---|---|---|---|
| Alloy | Tensile Elongation (%) | Tensile Strength (MPa) | Yield Strength (MPa) | Yield Point to 5% | 5% to 15% | 25% to Max Stress |
| Alloy 12 | 31.3 | 1624 | 250 | — | 1.34 | — |
| | 31.7 | 1581 | 304 | 0.19 | 1.24 | — |
| | 28.7 | 1610 | 319 | 0.16 | 1.23 | — |
| Alloy 13 | 57.1 | 1101 | 358 | 0.16 | 0.34 | 0.79 |
| | 66.1 | 1120 | 362 | 0.14 | 0.34 | 0.82 |
| | 68.5 | 1114 | 362 | 0.15 | 0.33 | 0.80 |
| | 60.1 | 1120 | 350 | 0.14 | 0.34 | 0.83 |
| Alloy 14 | 45.1 | 1371 | 354 | 0.11 | 0.59 | 0.69 |
| | 40.6 | 1403 | 363 | 0.11 | 0.62 | 0.66 |
| | 42.3 | 1403 | 364 | 0.11 | 0.55 | 0.69 |
| | 46.9 | 1379 | 341 | 0.12 | 0.63 | 0.65 |
| Alloy 15 | 26.2 | 1579 | 295 | 0.47 | 0.89 | — |
| | 25.2 | 1593 | 264 | — | 0.98 | — |
| | 24.6 | 1588 | 302 | 0.45 | 0.84 | — |
| Alloy 16 | 54.8 | 1239 | 379 | 0.13 | 0.34 | 0.76 |
| | 58.5 | 1207 | 341 | 0.15 | 0.42 | 0.80 |
| | 55.8 | 1207 | 359 | 0.13 | 0.39 | 0.82 |
| Alloy 17 | 51.3 | 1270 | 354 | 0.16 | 0.36 | 0.80 |
| | 50.1 | 1328 | 384 | 0.15 | 0.35 | 0.81 |
| Alloy 18 | 58.8 | 1224 | 384 | 0.14 | 0.33 | 0.78 |
| | 56.1 | 1245 | 390 | 0.14 | 0.32 | 0.79 |
| | 50.7 | 1190 | 365 | 0.14 | 0.33 | 0.82 |
| Alloy 19 | 47.4 | 1263 | 348 | 0.17 | 0.34 | 0.79 |
| | 50.7 | 1260 | 362 | 0.17 | 0.34 | 0.79 |
| | 51.8 | 1277 | 363 | 0.17 | 0.34 | 0.80 |
| Alloy 20 | 40.1 | 1337 | 376 | 0.15 | 0.36 | 0.85 |
| | 43.9 | 1343 | 375 | 0.14 | 0.35 | 0.83 |
| | 44.7 | 1328 | 394 | 0.15 | 0.36 | 0.88 |
| Alloy 21 | 45.2 | 1277 | 327 | 0.18 | 0.45 | 0.76 |
| | 46.1 | 1318 | 340 | 0.17 | 0.44 | 0.76 |
| | 54.2 | 1310 | 325 | 0.18 | 0.46 | 0.71 |
| Alloy 22 | 49.6 | 1272 | 369 | 0.15 | 0.36 | 0.83 |
| | 54.9 | 1275 | 354 | 0.14 | 0.36 | 0.77 |
| | 54.8 | 1271 | 319 | 0.17 | 0.42 | 0.73 |
| | 52.4 | 1297 | 340 | 0.16 | 0.38 | 0.79 |
| Alloy 23 | 53.5 | 1246 | 344 | 0.16 | 0.4 | 0.78 |
| | 55.9 | 1226 | 359 | 0.15 | 0.34 | 0.76 |
| | 51.2 | 1232 | 346 | 0.16 | 0.36 | 0.77 |
| | 52.7 | 1228 | 375 | 0.14 | 0.34 | 0.78 |
| Alloy 24 | 57.0 | 1209 | 356 | 0.15 | 0.35 | 0.77 |
| | 54.6 | 1202 | 348 | 0.15 | 0.36 | 0.83 |
| | 55.1 | 1207 | 363 | 0.15 | 0.34 | 0.80 |
| | 56.9 | 1225 | 338 | 0.16 | 0.38 | 0.78 |
| Alloy 25 | 53.4 | 1227 | 357 | 0.15 | 0.37 | 0.78 |
| | 56.5 | 1249 | 325 | 0.16 | 0.39 | 0.77 |
| | 54.5 | 1214 | 345 | 0.14 | 0.37 | 0.79 |
| | 49.5 | 1220 | 343 | 0.15 | 0.38 | 0.83 |
| Alloy 26 | 49.0 | 1319 | 340 | 0.16 | 0.37 | 0.79 |
| | 48.4 | 1320 | 344 | 0.17 | 0.35 | 0.79 |
| | 50.5 | 1304 | 331 | 0.19 | 0.38 | 0.79 |
| | 51.1 | 1296 | 346 | 0.16 | 0.36 | 0.77 |
| Alloy 27 | 56.5 | 967 | 404 | 0.11 | 0.31 | 0.66 |
| | 54.5 | 956 | 421 | 0.11 | 0.31 | 0.66 |
| | 67.6 | 979 | 417 | 0.11 | 0.31 | 0.66 |
| | 52.0 | 942 | 390 | 0.12 | 0.33 | 0.66 |
| Alloy 28 | 50.4 | 1121 | 442 | 0.11 | 0.30 | 0.77 |
| | 49.8 | 1088 | 407 | 0.13 | 0.33 | 0.78 |
| | 51.8 | 1116 | 423 | 0.13 | 0.32 | 0.77 |
| Alloy 29 | 56.0 | 1229 | 422 | 0.14 | 0.30 | 0.70 |
| | 56.3 | 1247 | 409 | 0.15 | 0.30 | 0.74 |
| | 54.6 | 1226 | 405 | 0.15 | 0.31 | 0.71 |
| | 50.0 | 1196 | 421 | 0.18 | 0.32 | 0.73 |
| | 56.3 | 1199 | 412 | 0.15 | 0.31 | 0.69 |
| | 53.3 | 1205 | 402 | 0.16 | 0.33 | 0.67 |
| Alloy 30 | 52.1 | 1271 | 421 | 0.16 | 0.30 | 0.74 |
| | 51.4 | 1284 | 416 | 0.14 | 0.32 | 0.74 |
| | 50.6 | 1269 | 407 | 0.15 | 0.33 | 0.72 |
| | 53.9 | 1248 | 418 | 0.14 | 0.32 | 0.68 |
| | 49.9 | 1237 | 399 | 0.16 | 0.34 | 0.69 |
| | 54.8 | 1241 | 407 | 0.17 | 0.31 | 0.71 |

TABLE 2-continued

Tensile Properties of Alloys in Hot Rolled Condition

| Alloy | Tensile Elongation (%) | Ultimate Tensile Strength (MPa) | Yield Strength (MPa) | Strain Hardening Exponent (n) in a Strain Range: Yield Point to 5% | 5% to 15% | 25% to Max Stress |
|---|---|---|---|---|---|---|
| Alloy 31 | 48.6 | 1326 | 379 | 0.17 | 0.34 | 0.74 |
| | 51.3 | 1323 | 390 | 0.16 | 0.33 | 0.71 |
| | 51.6 | 1293 | 372 | 0.17 | 0.35 | 0.72 |
| | 51.4 | 1314 | 374 | 0.17 | 0.34 | 0.72 |
| Alloy 32 | 49.5 | 1347 | 383 | 0.17 | 0.37 | 0.65 |
| | 47.0 | 1367 | 388 | 0.17 | 0.36 | 0.68 |
| | 47.9 | 1341 | 381 | 0.17 | 0.36 | 0.75 |
| | 47.8 | 1391 | 431 | 0.15 | 0.33 | 0.67 |
| Alloy 33 | 44.8 | 1373 | 372 | 0.18 | 0.38 | 0.68 |
| | 42.3 | 1392 | 381 | 0.17 | 0.40 | 0.72 |
| | 40.7 | 1388 | 381 | 0.17 | 0.40 | 0.69 |
| Alloy 34 | 65.9 | 963 | 515 | 0.09 | 0.27 | 0.47 |
| | 58.7 | 954 | 485 | 0.10 | 0.28 | 0.47 |
| | 62.1 | 970 | 545 | 0.08 | 0.26 | 0.46 |
| Alloy 35 | 19.6 | 2000 | 533 | 0.29 | 0.31 | — |
| | 22.3 | 1976 | 511 | 0.20 | 0.30 | — |
| | 19.8 | 1995 | 526 | 0.31 | 0.29 | — |
| Alloy 36 | 60.1 | 1091 | 439 | 0.11 | 0.31 | 0.60 |
| | 61.0 | 1114 | 469 | 0.10 | 0.28 | 0.61 |
| | 59.4 | 1137 | 481 | 0.10 | 0.29 | 0.62 |
| Alloy 37 | 13.8 | 1572 | 649 | 0.13 | — | — |
| | 14.1 | 1619 | 711 | 0.18 | — | — |
| | 14.6 | 1610 | 692 | 0.19 | — | — |
| Alloy 38 | 58.9 | 1105 | 531 | 0.11 | 0.30 | 0.52 |
| | 61.4 | 1108 | 524 | 0.10 | 0.30 | 0.52 |
| | 58.6 | 1106 | 511 | 0.10 | 0.30 | 0.52 |
| Alloy 39 | 51.0 | 1317 | 354 | 0.16 | 0.39 | 0.71 |
| | 50.5 | 1334 | 370 | 0.15 | 0.38 | 0.71 |
| | 50.5 | 1325 | 368 | 0.14 | 0.38 | 0.69 |
| Alloy 40 | 47.9 | 1374 | 330 | 0.22 | 0.38 | 0.74 |
| | 48.8 | 1336 | 317 | 0.24 | 0.39 | 0.64 |
| | 41.5 | 1362 | 321 | 0.23 | 0.39 | 0.77 |
| Alloy 41 | 51.1 | 963 | 472 | 0.08 | 0.29 | 0.58 |
| | 48.4 | 913 | 463 | 0.08 | 0.29 | 0.55 |

CASE EXAMPLES

Comparative Case Example #1 Conventional Response to Rolling at Ambient Temperature The hot band from alloys herein listed in Table 1 was, for comparison purposes, cold rolled to final target gauge thickness of 1.2 mm through multiple cold rolling passes. Tensile specimens were cut from each cold rolled sheet using wire EDM. Tensile properties were measured on an Instron mechanical testing frame (Model 3369), utilizing Instron's Bluehill control and analysis software. All tests were run at ambient temperature in displacement control.

Figure 4:
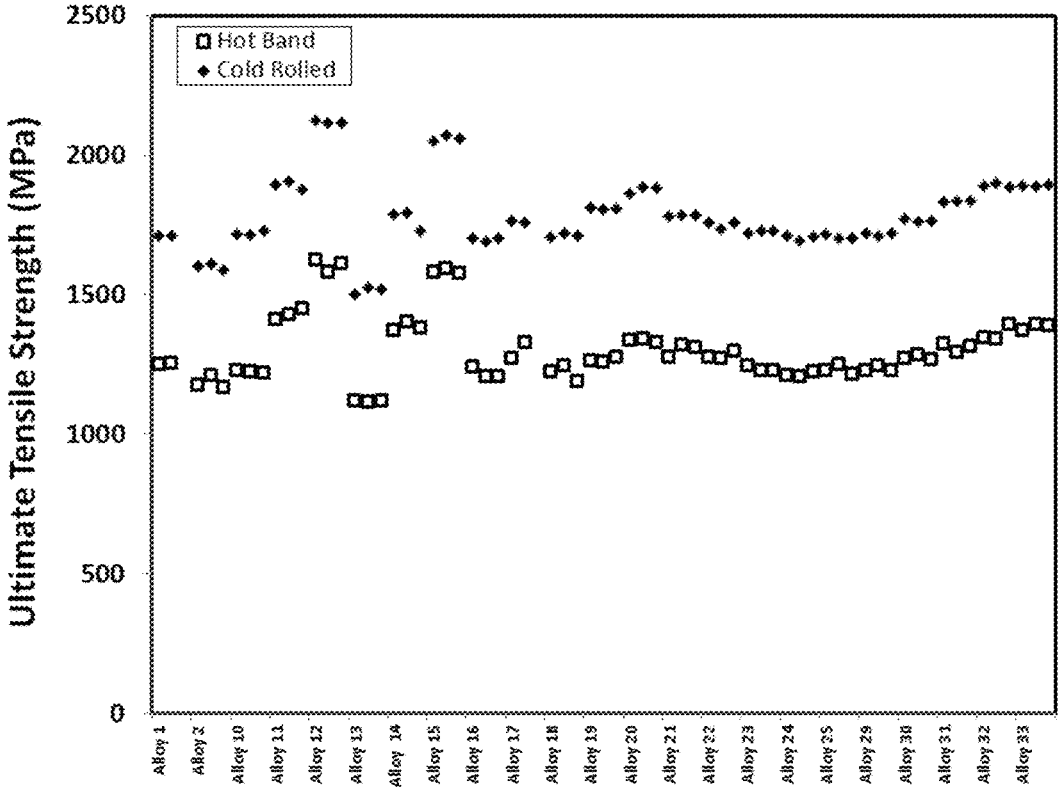
FIG. 4 Ultimate tensile strength in alloys herein before and after cold rolling.
Figure 5:
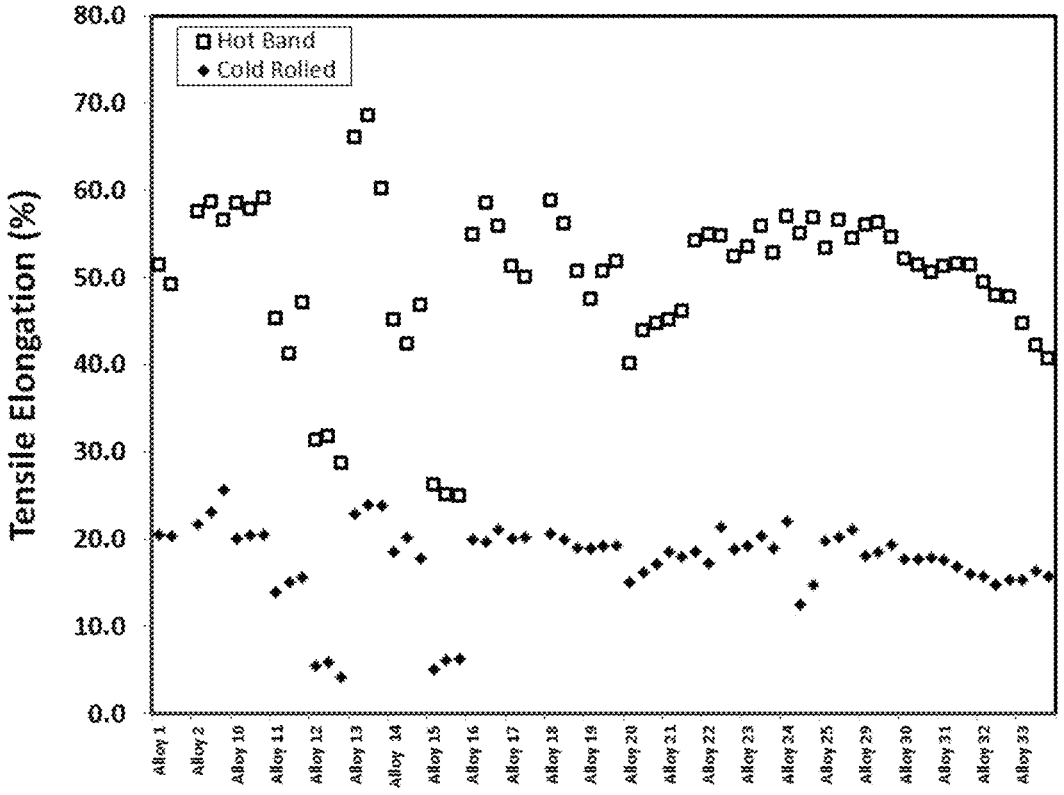
FIG. 5 Tensile elongation in alloys herein before (hot band) and after cold rolling (cold rolled).
Figure 6:
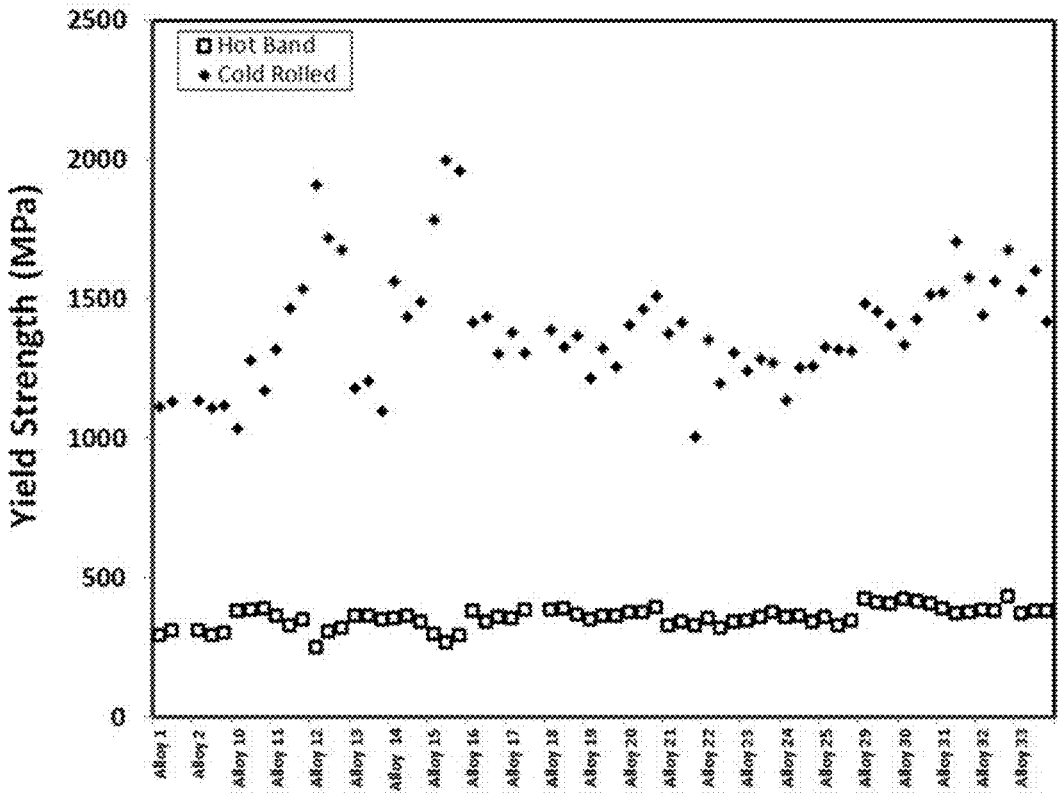
FIG. 6 Yield strength in alloys herein before (hot band) and after cold rolling (cold rolled).

Tensile properties of alloys herein after cold rolling are listed in Table 3. As it can be seen, the yield strength is significantly increased over the range in a hot band with maximum at 711 MPa (Table 2). After cold rolling yield strength varies from 1037 to 2000 MPa. The ultimate tensile strength values after cold rolling are in a range from 1431 to 2222 MPa. However, a drop in tensile elongation is recorded for each alloy herein after cold rolling with variation from 4.2 to 31.1%. The general trends in effect of cold rolling on tensile properties of alloys herein are illustrated in FIG. 4 to FIG. 6.

TABLE 3

Tensile Properties of Alloys at Final Gauge after Cold Rolling

| Alloy | Cold Rolling Reduction (%) | Tensile Elongation (%) | Ultimate Tensile Strength (MPa) | Yield Strength (MPa) |
|---|---|---|---|---|
| Alloy 1 | 38.0 | 20.5 | 1712 | 1114 |
| | | 20.4 | 1712 | 1131 |
| Alloy 2 | 29.4 | 21.8 | 1603 | 1135 |
| | | 23.2 | 1612 | 1111 |
| | | 25.7 | 1589 | 1120 |
| Alloy 10 | 35.1 | 20.1 | 1715 | 1038 |
| | | 20.5 | 1716 | 1280 |
| | | 20.5 | 1729 | 1173 |
| Alloy 11 | 32.7 | 13.9 | 1893 | 1320 |
| | | 15 | 1906 | 1467 |
| | | 15.6 | 1875 | 1536 |
| Alloy 12 | 33.8 | 5.5 | 2125 | 1913 |
| | | 5.9 | 2116 | 1720 |
| | | 4.2 | 2114 | 1675 |
| Alloy 13 | 36.5 | 22.8 | 1500 | 1182 |
| | | 24.0 | 1523 | 1204 |
| | | 23.9 | 1518 | 1098 |
| Alloy 14 | 34.5 | 18.6 | 1790 | 1561 |
| | | 20.2 | 1793 | 1436 |
| | | 17.9 | 1726 | 1491 |
| Alloy 15 | 37.3 | 5.0 | 2051 | 1784 |
| | | 6.2 | 2073 | 2000 |
| | | 6.3 | 2057 | 1957 |
| Alloy 16 | 36.9 | 19.9 | 1700 | 1413 |
| | | 19.7 | 1689 | 1436 |
| | | 21.1 | 1704 | 1302 |
| Alloy 17 | 36.0 | 20.1 | 1765 | 1379 |
| | | 20.2 | 1759 | 1306 |
| | | 17.2 | 1764 | 1374 |
| Alloy 18 | 37.3 | 20.6 | 1708 | 1388 |
| | | 20.0 | 1721 | 1326 |
| | | 18.9 | 1709 | 1369 |
| Alloy 19 | 38.0 | 18.9 | 1810 | 1213 |
| | | 19.3 | 1807 | 1324 |
| | | 19.2 | 1806 | 1260 |
| Alloy 20 | 38.3 | 15.1 | 1864 | 1404 |
| | | 16.2 | 1884 | 1461 |
| | | 17.1 | 1879 | 1512 |
| Alloy 21 | 34.1 | 18.6 | 1780 | 1374 |
| | | 18.0 | 1785 | 1414 |
| | | 18.6 | 1786 | 1423 |
| Alloy 22 | 38.0 | 17.3 | 1759 | 1356 |
| | | 21.3 | 1736 | 1196 |
| | | 18.8 | 1757 | 1304 |
| Alloy 23 | 37.4 | 19.3 | 1718 | 1240 |
| | | 20.4 | 1728 | 1283 |
| | | 19.0 | 1727 | 1271 |
| Alloy 24 | 37.5 | 22.0 | 1709 | 1136 |
| | | 12.6 | 1695 | 1256 |
| | | 14.8 | 1706 | 1258 |
| Alloy 25 | 33.5 | 19.8 | 1715 | 1326 |
| | | 20.2 | 1704 | 1320 |
| | | 21.0 | 1700 | 1316 |
| Alloy 29 | 38.8 | 18.1 | 1718 | 1483 |
| | | 18.6 | 1712 | 1454 |
| | | 19.4 | 1720 | 1407 |
| Alloy 30 | 39.9 | 17.7 | 1770 | 1335 |
| | | 17.7 | 1764 | 1430 |
| | | 17.9 | 1765 | 1515 |
| Alloy 31 | 40.5 | 17.5 | 1834 | 1524 |
| | | 16.9 | 1831 | 1707 |
| | | 16.0 | 1837 | 1578 |
| Alloy 32 | 41.1 | 15.7 | 1890 | 1442 |
| | | 14.8 | 1897 | 1563 |
| | | 15.4 | 1886 | 1676 |
| Alloy 33 | 38.2 | 15.4 | 1891 | 1533 |
| | | 16.3 | 1889 | 1604 |
| | | 15.8 | 1895 | 1419 |
| Alloy 34 | 39.0 | 10.9 | 1519 | 1249 |
| | | 9.4 | 1515 | 1037 |
| | | 10.8 | 1519 | 1345 |

TABLE 3-continued

| Tensile Properties of Alloys at Final Gauge after Cold Rolling | | | | |
|---|---|---|---|---|
| Alloy | Cold Rolling Reduction (%) | Tensile Elongation (%) | Ultimate Tensile Strength (MPa) | Yield Strength (MPa) |
| Alloy 35 | 19.6 | 16.2 | 2222 | 1693 |
| | | 16.4 | 2216 | 1735 |
| | | 16.2 | 2217 | 1657 |
| Alloy 36 | 36.7 | 16.4 | 1641 | 1116 |
| | | 20.6 | 1604 | 1187 |
| | | 19.1 | 1623 | 1295 |
| Alloy 37 | 36.3 | 7.1 | 1949 | 1617 |
| | | 6.6 | 1977 | 1824 |
| | | 6.5 | 1975 | 1834 |
| Alloy 38 | 43.0 | 7.0 | 1727 | 1539 |
| | | 9.7 | 1721 | 1373 |
| | | 10.0 | 1717 | 1490 |
| Alloy 39 | 36.5 | 16.0 | 1869 | 1289 |
| | | 19.0 | 1840 | 1471 |
| | | 19.0 | 1837 | 1245 |
| Alloy 40 | 37.4 | 15.6 | 1917 | 1238 |
| | | 17.2 | 1913 | 1361 |
| | | 17.7 | 1917 | 1192 |
| Alloy 41 | 39.2 | 28.6 | 1452 | 1121 |
| | | 31.1 | 1445 | 1101 |
| | | 31.1 | 1431 | 1231 |

Figure 7:
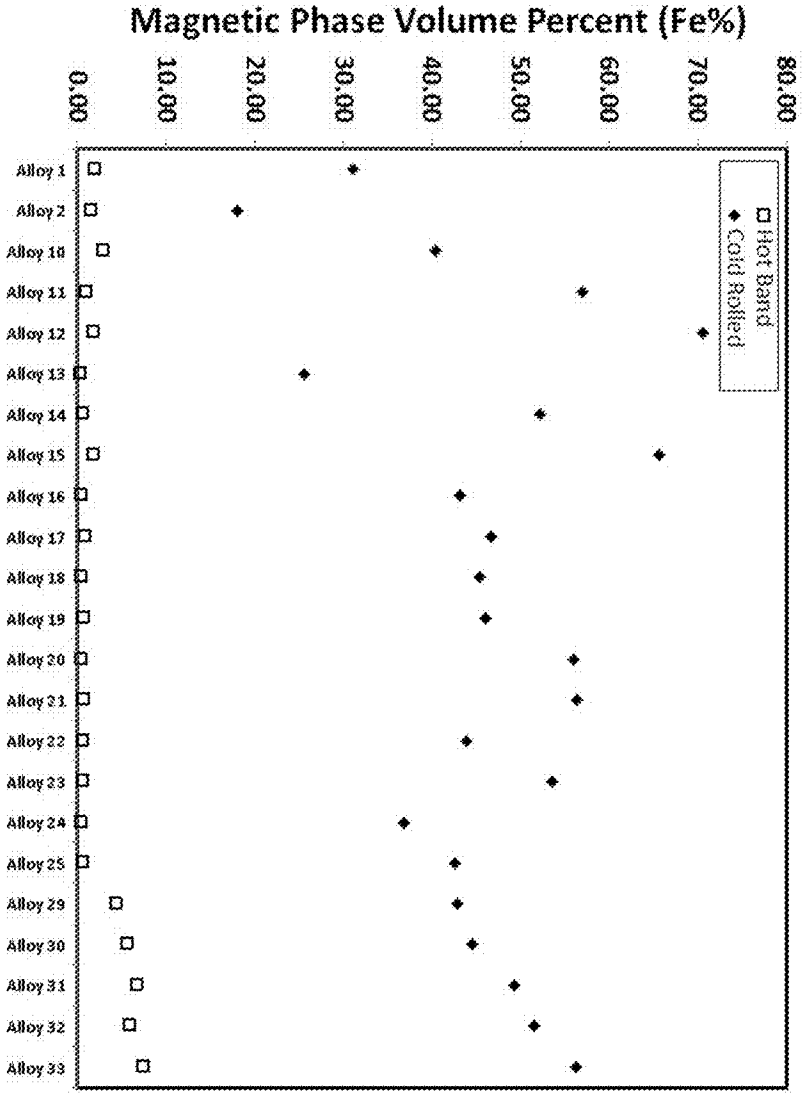
FIG. 7 Magnetic phase volume percent in alloys herein before (hot band) and after cold rolling (cold rolled).

The relative magnetic phases content was measured by Feritscope in both a hot band and after cold rolling for each alloy herein that is listed in Table 4 and illustrated in FIG. 7 for selected alloys. The magnetic phases volume percent of 0.1 to 56.4 Fe % in a hot band increases to the range from 1.6 to 84.9 Fe % after cold rolling confirming a phase transformation during deformation.

TABLE 4

| Magnetic Phases Volume Percent (Fe %) in Alloys after Cold Rolling | | |
|---|---|---|
| Alloy | Hot Band (Fe %) | Cold Rolled Sheet (Fe %) |
| Alloy 1 | 1.7 | 14.7 |
| Alloy 2 | 1.3 | 18.0 |
| Alloy 3 | 3.2 | 43.5 |
| Alloy 4 | 0.3 | 55.8 |
| Alloy 5 | 0.5 | 53.0 |
| Alloy 6 | 0.4 | 45.0 |
| Alloy 7 | 10.4 | 67.7 |
| Alloy 8 | 0.9 | 57.8 |
| Alloy 9 | 1.4 | 44.8 |
| Alloy 10 | 2.7 | 40.3 |
| Alloy 11 | 0.8 | 57.1 |
| Alloy 12 | 1.5 | 70.6 |
| Alloy 13 | 0.1 | 25.6 |
| Alloy 14 | 0.4 | 52.2 |
| Alloy 15 | 1.6 | 65.6 |
| Alloy 16 | 0.2 | 43.2 |
| Alloy 17 | 0.6 | 56.9 |
| Alloy 18 | 0.3 | 45.3 |
| Alloy 19 | 0.4 | 55.9 |
| Alloy 20 | 0.3 | 60.9 |
| Alloy 21 | 0.5 | 56.3 |
| Alloy 22 | 0.3 | 43.9 |
| Alloy 23 | 0.3 | 53.5 |
| Alloy 24 | 0.2 | 36.8 |
| Alloy 25 | 0.4 | 42.6 |
| Alloy 26 | 0.5 | 48.5 |
| Alloy 27 | 0.1 | 12.6 |
| Alloy 28 | 0.4 | 20.6 |
| Alloy 29 | 4.2 | 42.8 |
| Alloy 30 | 5.5 | 44.6 |
| Alloy 31 | 6.5 | 49.3 |
| Alloy 32 | 5.7 | 51.5 |

TABLE 4-continued

| Magnetic Phases Volume Percent (Fe %) in Alloys after Cold Rolling | | |
|---|---|---|
| Alloy | Hot Band (Fe %) | Cold Rolled Sheet (Fe %) |
| Alloy 33 | 7.3 | 56.3 |
| Alloy 34 | 0.3 | 1.6 |
| Alloy 35 | 43.3 | 67.7 |
| Alloy 36 | 2.0 | 29.6 |
| Alloy 37 | 56.4 | 84.9 |
| Alloy 38 | 0.7 | 3.8 |
| Alloy 39 | 8.2 | 50.0 |
| Alloy 40 | 5.8 | 45.8 |
| Alloy 41 | 5.2 | 26.4 |

This comparative Case Example demonstrates that yield strength can be increased in alloys herein by cold rolling (i.e. at ambient temperature). Ultimate tensile strength is also increasing but cold rolling leads to a significant decrease in alloy ductility indicated by a drop in tensile elongation that can be a limiting factor in certain applications. Strengthening, as shown by the increase in ultimate tensile strength, is related to a phase transformation of austenite to ferrite as depicted by measurements of magnetic phases volume percent before and after cold rolling.

Comparative Case Example #2 Cold Rolling Reduction Effect on Yield Strength in Alloy 2

Figure 8:
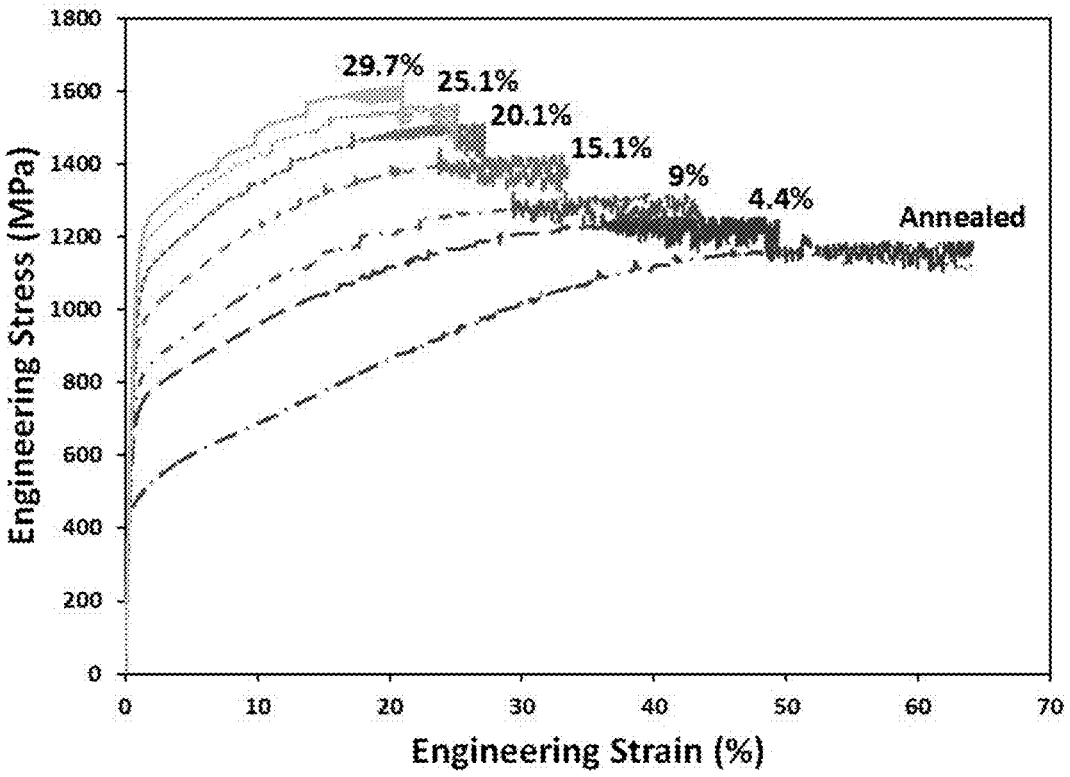
FIG. 8 Tensile stress-strain curves for Alloy 2 after cold rolling with various reductions.

Alloy 2 was processed into a hot band with a thickness of 4.4 mm. The hot band was then cold rolled with different reduction through multiple cold rolling (i.e. at ambient temperature) passes. After cold rolling the samples were heat treated with intermediate annealing at 850° C. for 10 min. This represented a start condition for each sample which represented a fully annealed condition to remove the prior cold work. From this start condition, subsequent cold rolling at different percentages (i.e. 0%, 4.4%, 9.0%, 15.1%, 20.1%, 25.1% and 29.7%) as provided in Table 5 was applied so that the final gauge for tensile testing would be at a targeted constant thickness of 1.2 mm. With increasing cold reduction as a final step after annealing, a corresponding increase of the material yield strength is demonstrated by tensile stress-strain curves in FIG. 8. Tensile properties from the tests are listed in Table 5. The yield strength of the Alloy 2 increases to a range from 666 to 1140 MPa depending on the level of reduction as compared to initial values in annealed state (Table 5). Also, the magnetic phases volume percent measured by Feritscope increases up to 12.9 Fe % as shown in Table 5 in comparison with initial value of 1.0 Fe % in the annealed state. It should be noted that yield strength increase is achieved at expense of alloy ductility with decreased tensile elongation after cold rolling.

TABLE 5

| Tensile Properties and Magnetic Phases Volume Percent in Alloy 2 After Cold Rolling | | | | |
|---|---|---|---|---|
| Cold Rolling Reduction (%) | Tensile Elongation (%) | Ultimate Tensile Strength (MPa) | Yield Strength (MPa) | Magnetic Phases Volume Percent (Fe %) |
| 0.0 (fully annealed, i.e. starting condition) | 60.1 | 1200 | 445 | 1.0 |
| | 58.1 | 1192 | 433 | |
| | 61.6 | 1222 | 444 | |
| | 55.2 | 1197 | 444 | |
| | 64.1 | 1212 | 446 | |

TABLE 5-continued

Tensile Properties and Magnetic Phases Volume Percent in Alloy 2 After Cold Rolling

| Cold Rolling Reduction (%) | Tensile Elongation (%) | Ultimate Tensile Strength (MPa) | Yield Strength (MPa) | Magnetic Phases Volume Percent (Fe %) |
|---|---|---|---|---|
| 4.4 | 49.5 | 1262 | 667 | 1.7 |
| | 35.2 | 1230 | 666 | |
| | 43.4 | 1268 | 673 | |
| | 49.3 | 1298 | 679 | |
| 9.0 | 43.6 | 1325 | 736 | 2.3 |
| | 33.0 | 1340 | 738 | |
| | 40.3 | 1342 | 732 | |
| | 40.3 | 1346 | 737 | |
| 15.1 | 28.2 | 1422 | 865 | 6.2 |
| | 27.8 | 1441 | 865 | |
| | 30.0 | 1454 | 867 | |
| | 33.5 | 1445 | 869 | |
| 20.1 | 27.2 | 1510 | 980 | 9.1 |
| | 21.0 | 1512 | 960 | |
| | 20.4 | 1524 | 970 | |
| | 20.2 | 1515 | 990 | |
| 25.1 | 21.2 | 1555 | 1036 | 11.5 |
| | 22.7 | 1565 | 1037 | |
| | 24.5 | 1563 | 1051 | |
| | 25.1 | 1566 | 1058 | |
| 29.7 | 17.8 | 1628 | 1121 | 12.9 |
| | 21.0 | 1629 | 1105 | |
| | 19.0 | 1627 | 1137 | |
| | 20.0 | 1631 | 1140 | |

This Comparative Case Example #2 demonstrates that yield strength in alloys herein can be altered by cold rolling reduction to achieve relatively higher yield strength values with increase in tensile strength but with decrease in ductility. The higher cold rolling reduction that is applied, the higher yield strength achieved and the lower tensile elongation recorded.

Comparative Case Example #3 Structural Transformation During Cold Rolling in a Hot Band from Alloy 2

Hot band from Alloy 2 with thickness of 4 mm was cold rolled to a final thickness of 1.2 mm through multiple cold rolling passes with intermediate annealing at 850° C. for 10 min. Microstructures of the hot band and the cold rolled sheet were studied by scanning electron microscopy (SEM) and transmission electron microscopy (TEM).

To prepare SEM samples, pieces were cut by EDM and mounted in epoxy, and polished progressively with 9 μm, 6 μm and 1 μm diamond suspension solution, and finally with 0.02 μm silica. To prepare TEM specimens, the samples were cut from the sheet with EDM, and then thinned by grinding with pads of reduced grit size every time. Further thinning to 60 to 70 μm thick is done by polishing with 9 μm, 3 μm and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling usually is done at 4.5 keV, and the inclination angle is reduced from 4° to 2° to open up the thin area. The TEM studies were done using a JEOL 2100 high-resolution microscope operated at 200 kV.

Figure 9:
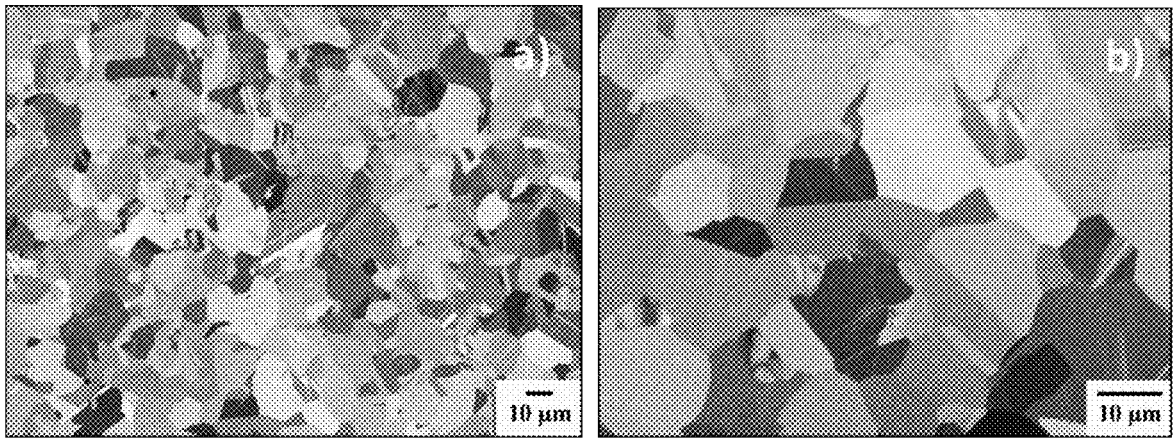
FIG. 9 Back-scattered SEM micrograph of the microstructure in the hot band from Alloy 2: a) low magnification image; b) high magnification image.
Figure 10:
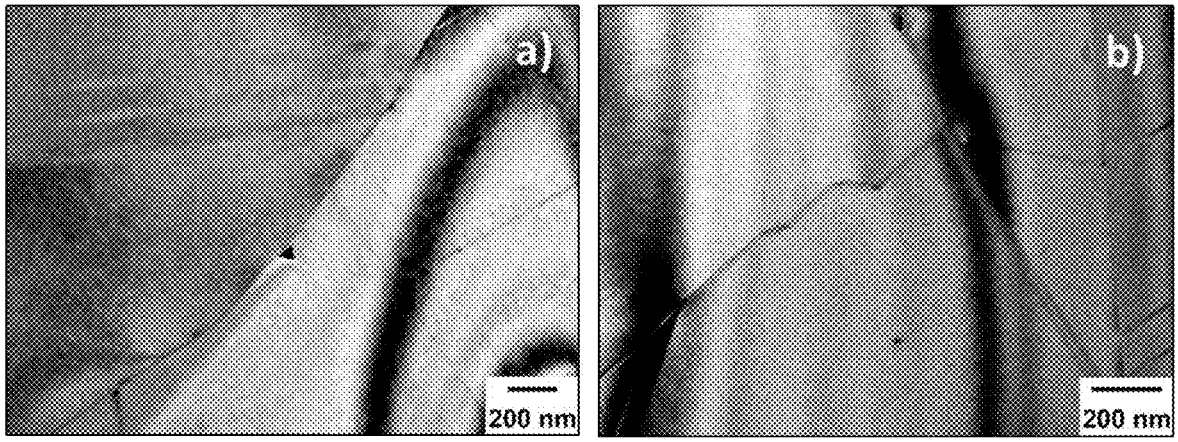
FIG. 10 Bright-field TEM micrograph of the microstructure in the hot band from Alloy 2: a) low magnification image; b) high magnification image.
Figure 11:
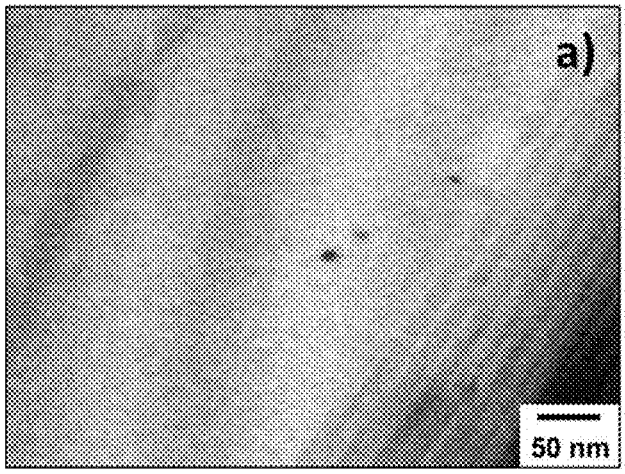
FIG. 11 TEM micrograph showing nanoscale precipitates in the hot band from Alloy 2.

SEM analysis of the hot band structure revealed relatively large austenite grains with straight boundaries (FIG. 9). Bright-field TEM image shows that the hot band structure contains very few dislocations and the grains boundaries are straight and sharp (FIG. 10) that is typical for recrystallized structures. TEM studies also showed that nanoprecipitates are present in the microstructure (FIG. 11).

Figure 12:
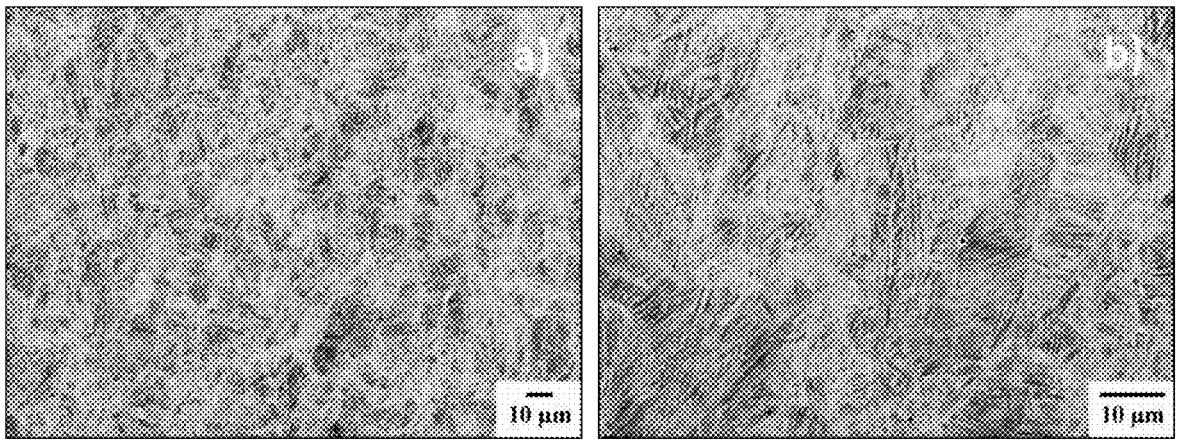
FIG. 12 Back-scattered SEM micrograph of the microstructure in the cold rolled sheet from Alloy 2: a) low magnification image; b) high magnification image.
Figure 13:
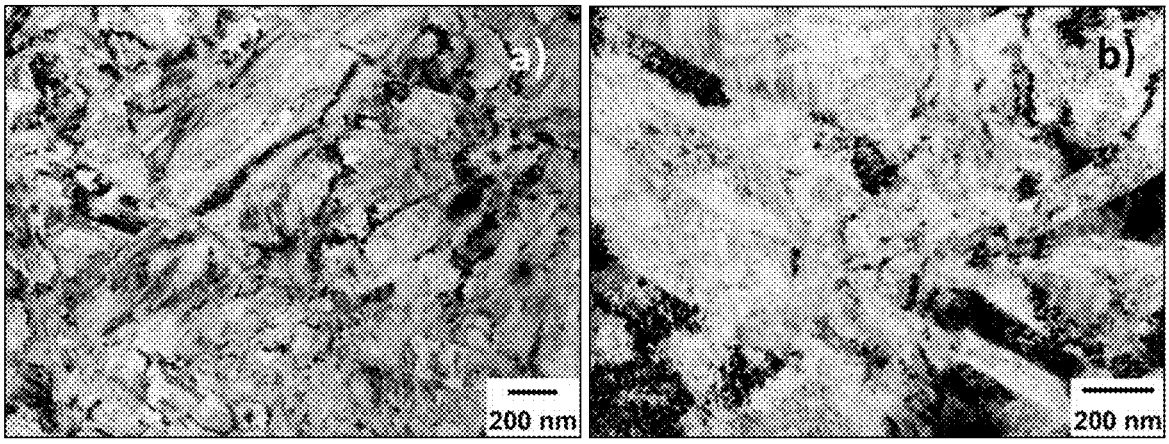
FIG. 13 TEM micrograph of the microstructure in the cold rolled sheet from Alloy 2: a) low magnification image; b) high magnification image.
Figure 14:
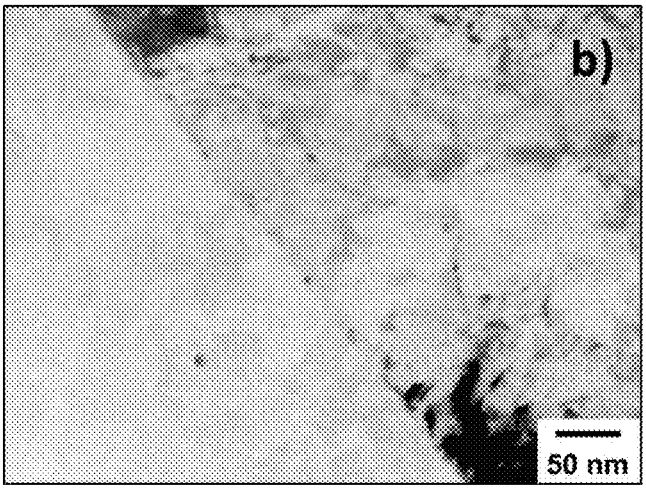
FIG. 14 TEM micrograph showing nanoscale precipitates found in Alloy 2 sheet after cold deformation.

When the hot band was subjected to cold rolling, the austenite phase in selected areas of the hot band structure transforms to refined ferrite phase under stress. Backscattered SEM images of the cold rolled sheet show the transformed and refined structure, and the presence of deformation twins (FIG. 12). As shown by TEM images in FIG. 13, high dislocation density is generated in retained austenite grains and refined grains of ferrite with a size of 200 to 300 nm are formed. Deformation twinning was also observed in the retained austenite grains. Additional nanoprecipitation as a part of phase transformation process during cold rolling was also observed (FIG. 14).

This Case Example demonstrates a microstructure evolution from the initial hot band austenitic structure during cold rolling leading to alloy strengthening (increase in ultimate tensile strength) by grain refinement due to phase transformation into ferrite with nanoprecipitation as well as dislocation density increase and deformation twinning.

Case Example #4 Rolling Temperature Effect on Yield Strength of Alloy 2

The starting material was a hot band from Alloy 2 with approximately 2.5 mm thickness prepared by hot rolling of 50 mm thick laboratory cast slab mimicking processing at commercial hot band production. The starting material had an average ultimate tensile strength of 1166 MPa, an average tensile elongation of 53.0% and an average yield strength of 304 MPa. The starting material also had a magnetic phases volume percent of 0.9 Fe %.

The hot band was media blasted to remove oxide and loaded into a Yamato DKN810 mechanical convection oven for at least 30 minutes prior to rolling to allow the plate to reach temperature. The hot band was rolled on a Fenn Model 061 rolling mill with steadily decreasing roll gaps, and was loaded into the furnace for at least 10 minutes between passes to ensure a constant starting temperature (i.e. 50, 100, 150, 200, 250° C., 300° C., 350° C., and 400° C.) for each subsequent rolling pass for a total targeted 20% reduction. Samples were EDM cut in the ASTM E8 Standard geometry. Tensile properties were measured on an Instron mechanical testing frame (Model 5984), utilizing Instron's Bluehill control and analysis software. All tensile tests were run at ambient temperature in displacement control with the bottom fixture held rigid and the top fixture moving; the load cell is attached to the top fixture.

Figure 15:
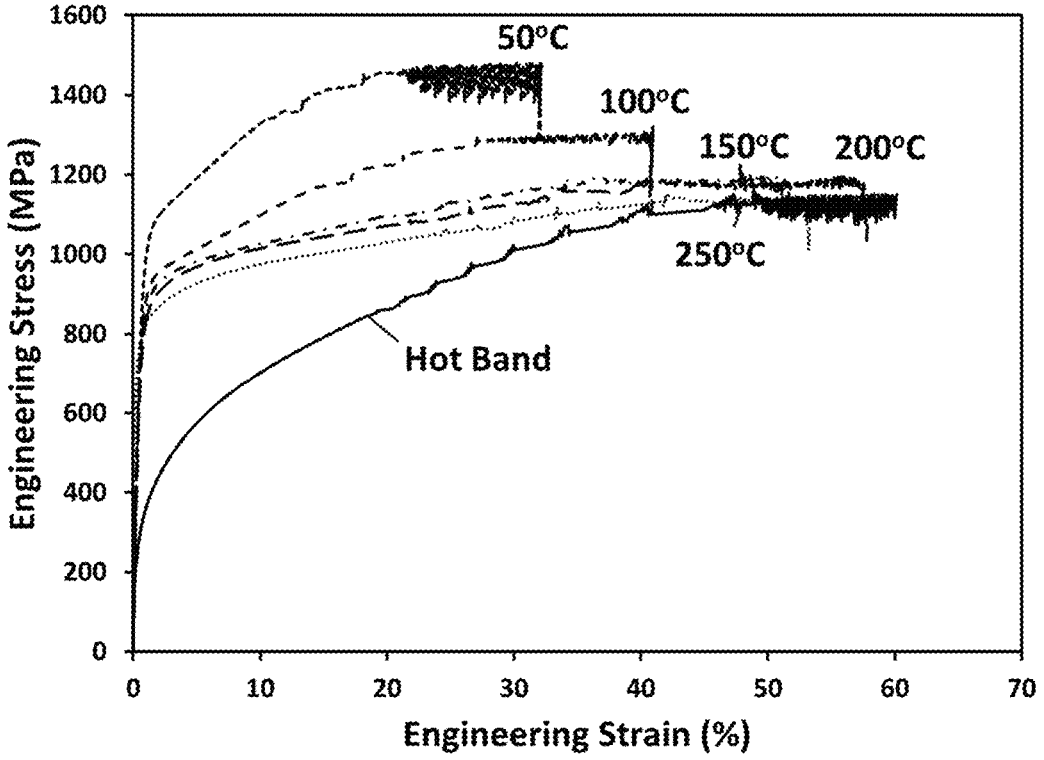
FIG. 15 Engineering tensile stress-strain curves for Alloy 2 after rolling with 20% reduction at different temperatures.

Tensile properties of the Alloy 2 after rolling at identified temperatures are listed in Table 6. Depending on rolling temperature, the yield strength is increased to a range from 589 to 945 MPa as compared to the values of 250 to 711 MPa in a hot band (Table 2). The ultimate tensile strength of the Alloy 2 varies from 1132 to 1485 MPa with tensile elongation from 21.2 to 60.5%. An example stress-strain curves are shown in FIG. 15. As can be seen, rolling at temperature of 200° C. of the hot band from Alloy 2 demonstrates the possibility to increase yield strength with minimal changes in ductility and ultimate strength consistent with Step 3a in FIG. 3.

Figure 16:
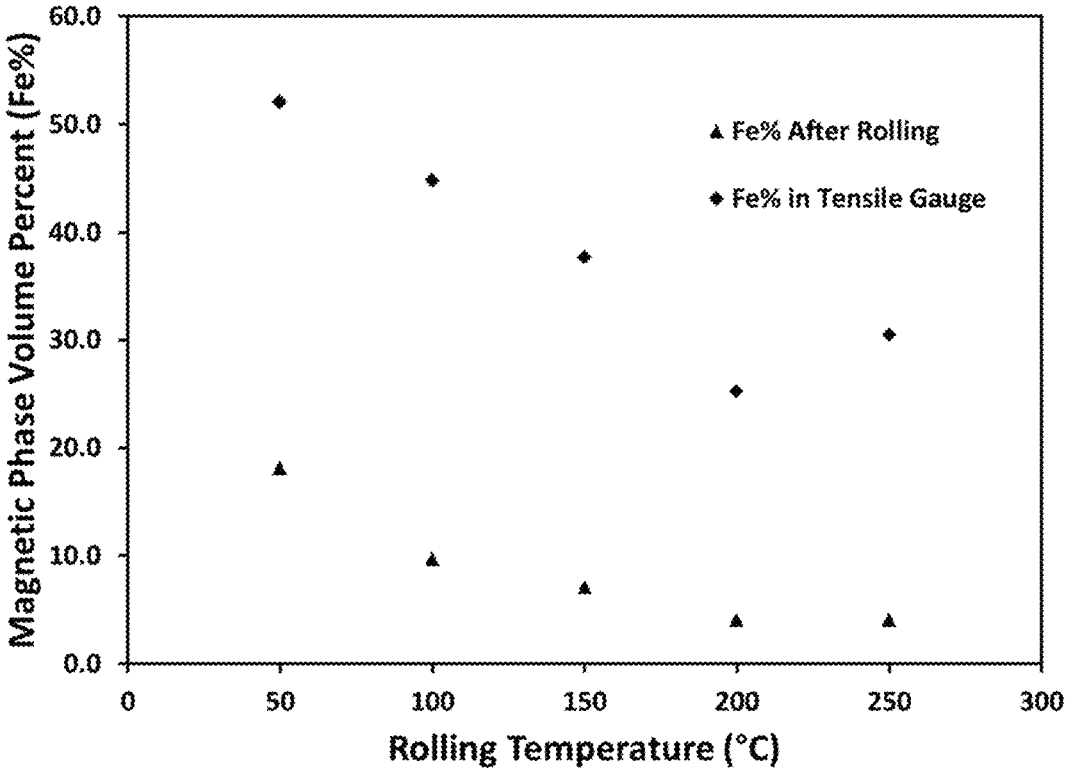
FIG. 16 Change in magnetic phases volume percent (Fe %) during tensile testing in Alloy 2.
Figure 17:
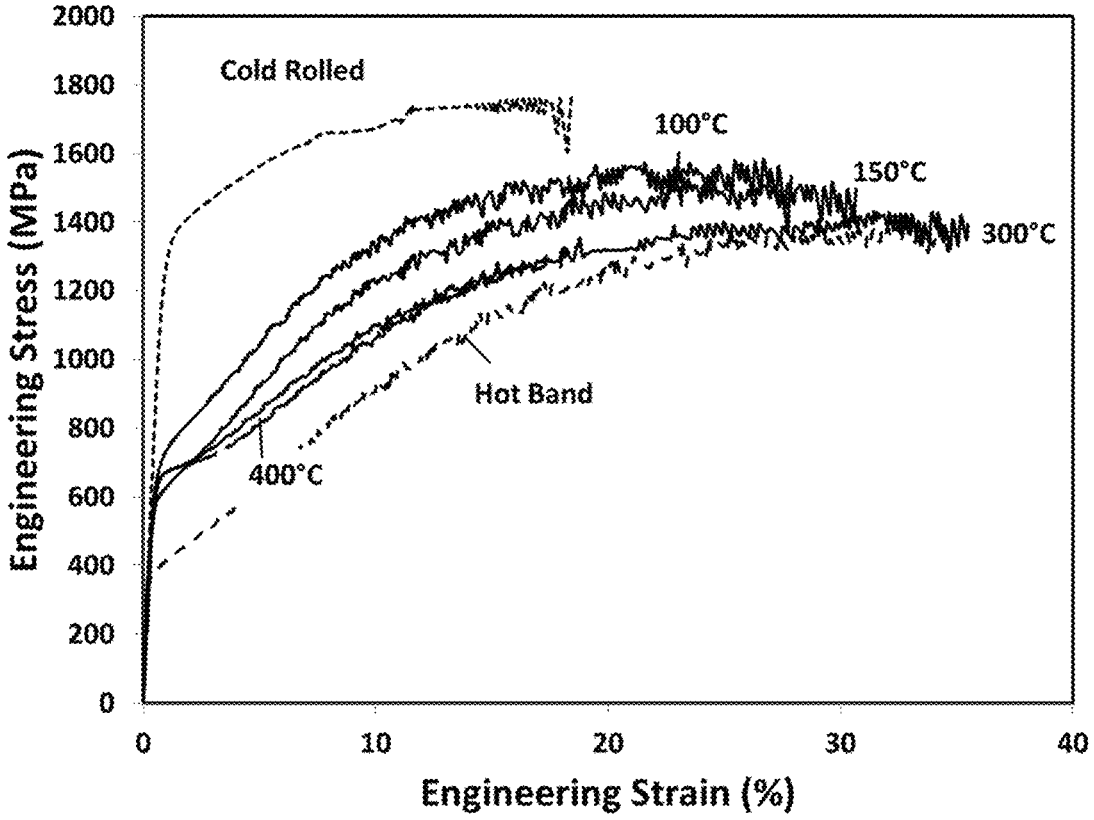
FIG. 17 Engineering stress-strain curves for Alloy 7 after rolling with 20% reduction at different temperatures.
Figure 18:
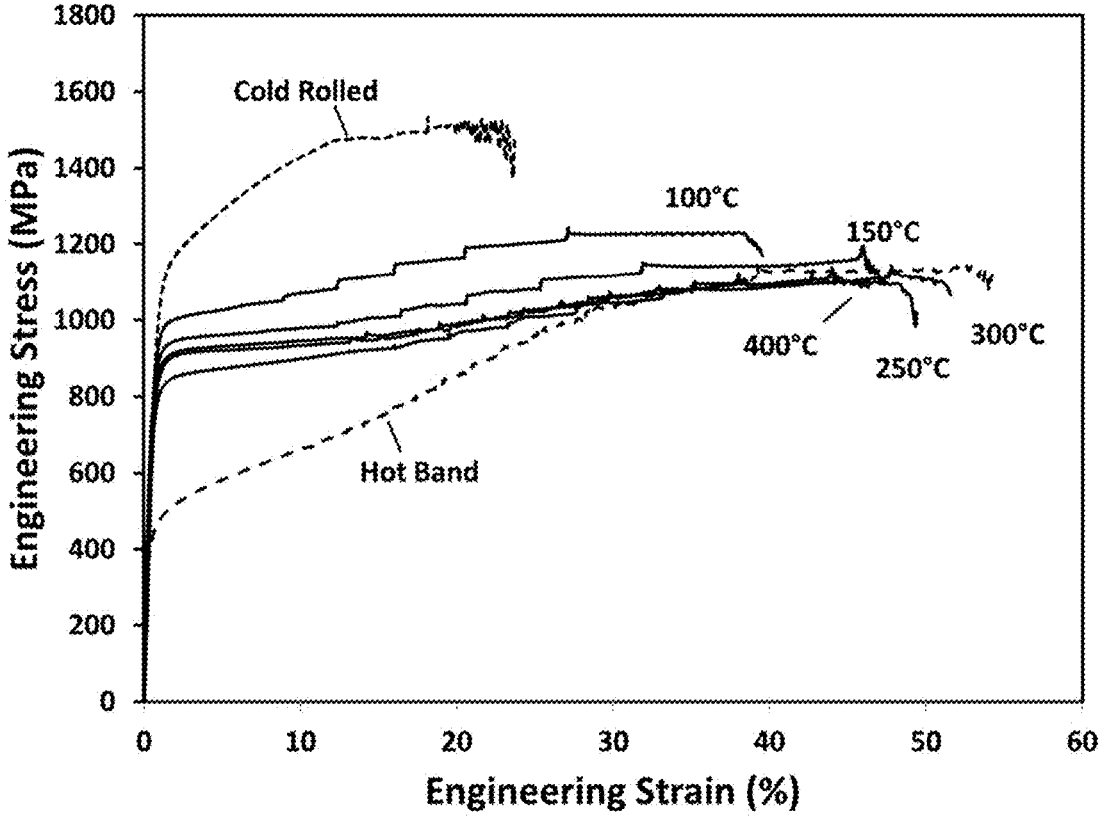
FIG. 18 Engineering stress-strain curves for Alloy 18 after rolling with 20% reduction at different temperatures.
Figure 19:
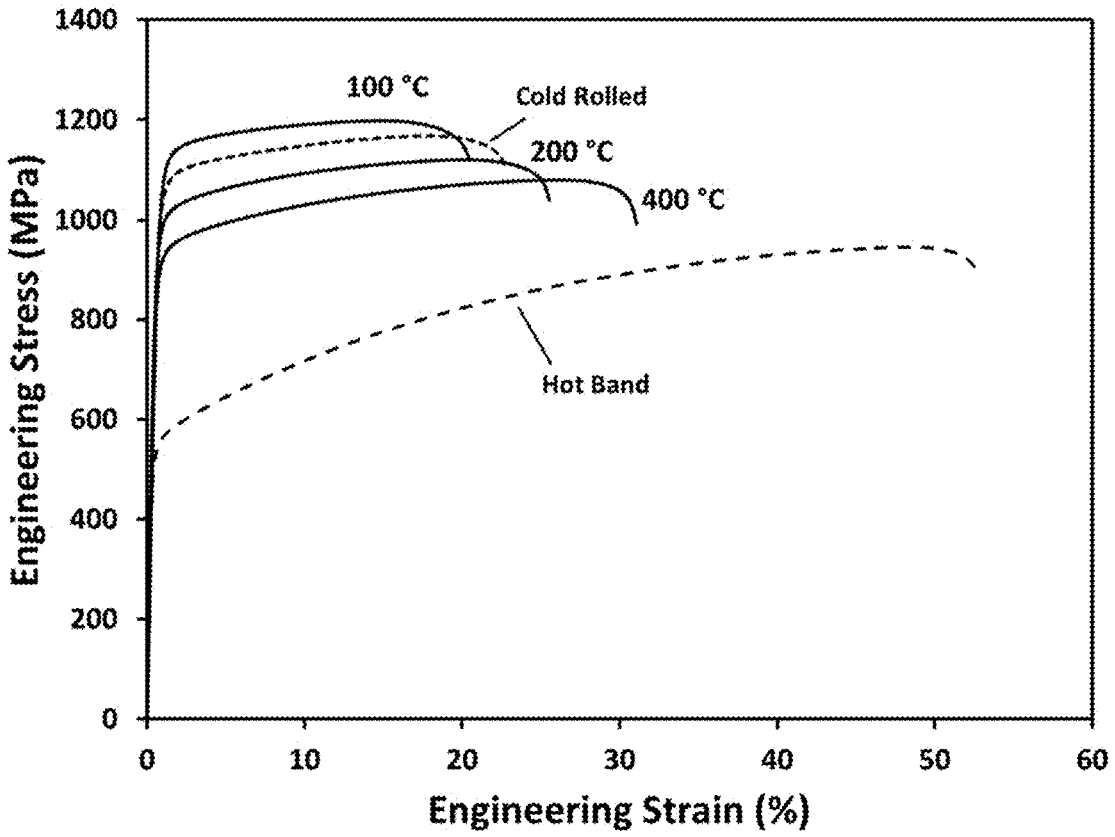
FIG. 19 Engineering stress-strain curves for Alloy 34 after rolling with 20% reduction at different temperatures.
Figure 20:
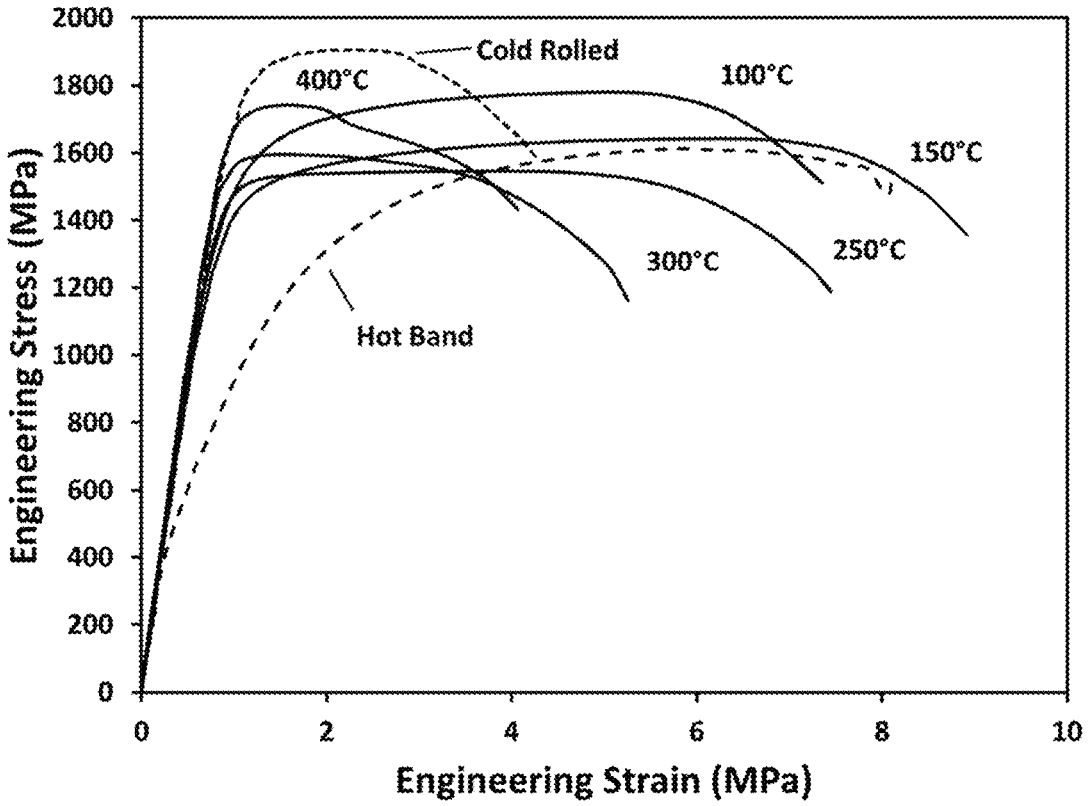
FIG. 20 Engineering stress-strain curves for Alloy 37 after rolling with 20% reduction at different temperatures.

The magnetic phases volume percent (Fe %) was measured after rolling, in the tensile gauge at least 10 mm from fracture are reported in Table 7. As it can be seen, the magnetic phases volume percent after rolling at temperature of 100° C. and above is significantly lower in a range from 0.3 to 9.7 Fe % as compared to that after cold rolling Alloy 2 at ambient temperature (18.0 Fe %, Table 4). A significant increase in a magnetic phases volume percent was measured in the Alloy 2 after rolling at temperature and tensile tested (Table 7, FIG. 16). After tensile testing, magnetic phases volume percent in tensile gauge of the samples varies from 25.2 to 52.1 Fe % depending on rolling temperature.

TABLE 6

Tensile Properties of Alloy 2 After ~20% Rolling Reduction at Different Temperatures

| Tensile Elongation (%) | Ultimate Tensile Strength (MPa) | Yield Strength (Offset 0.2%) (MPa) | Rolling Reduction (%) | Rolling Temperature (° C.) |
|---|---|---|---|---|
| 47.4 | 1165 | 296 | 0 | |
| 51.5 | 1171 | 309 | | |
| 60.2 | 1162 | 306 | | |
| 27.5 | 1485 | 945 | | |
| 32.1 | 1481 | 942 | 21.1 | 50 |
| 21.2 | 1468 | 934 | | |
| 40.9 | 1326 | 819 | | |
| 36.6 | 1321 | 825 | 19.4 | 100 |
| 39.5 | 1334 | 823 | | |
| 51.8 | 1224 | 804 | | |
| 48.3 | 1219 | 803 | 19.6 | 150 |
| 48.1 | 1225 | 809 | | |
| 52.3 | 1205 | 803 | | |
| 58.0 | 1196 | 775 | 20.1 | 200 |
| 53.3 | 1218 | 773 | | |
| 50.6 | 1158 | 745 | | |
| 53.0 | 1166 | 733 | 22.0 | 250 |
| 53.4 | 1152 | 723 | | |
| 53.2 | 1157 | 738 | | |
| 55.4 | 1145 | 752 | 20.6 | 300 |
| 52.0 | 1157 | 724 | | |
| 52.9 | 1186 | 691 | 19.8 | 350 |
| 56.2 | 1168 | 686 | | |
| 57.7 | 1168 | 695 | | |
| 60.5 | 1150 | 651 | 18.6 | 400 |
| 53.0 | 1144 | 621 | | |
| 60.2 | 1158 | 655 | | |

TABLE 7

Magnetic Phases Volume Percent (Fe %) as a Function of Rolling Temperature Before and After Tensile Testing of Alloy 2

| Rolling Temperature (° C.) | Fe % After Rolling | Fe % in Tested Tensile Gauge |
|---|---|---|
| Hot Band | 18.0 | 54.3 |
| 50 | 18.1 | 52.1 |
| 100 | 9.7 | 44.8 |
| 150 | 7.1 | 37.7 |
| 200 | 4.1 | 25.2 |
| 250 | 4.1 | 30.5 |
| 300 | 2.3 | 30.5 |
| 350 | 1.8 | 32.8 |
| 400 | 1.0 | 31.1 |

This Case Example demonstrates that yield strength in alloys herein can be increased by rolling at elevated temperatures whereby phase transformation of austenite into ferrite is reduced. Significant drops in Fe % occur when rolling temperature is greater than 100° C. Moreover, rolling of the hot band from alloys herein at temperatures of 150° C. to 400° C. demonstrates the ability to increase yield strength (e.g. increasing yield strength to a value of at least 100 MPa or more over the original value) without significant change in ductility (i.e. change limited to plus or minus seven and one half percent (±7.5% tensile elongation) and maintain the ultimate tensile strength at about the same level (i.e. ±100 MPa as compared to the original value).

Case Example #5 Rolling Temperature Effect on Yield Strength of Alloy 7, Alloy 18, Alloy 34 and Alloy 37

The starting material was a hot band from each of Alloy 7, Alloy 18, Alloy 34, and Alloy 37 with approximately 2.5 mm initial thickness prepared by hot rolling of 50 mm thick laboratory cast slab mimicking commercial processing. Alloys 7, 18, 34, and 37 were processed into hot bands with a thickness of approximately 2.5 mm by hot rolling at temperatures between 1100° C. and 1250° C. and subsequently media blasted to remove the oxide. The tensile properties of hot band material were previously listed in Table 2. The hot band was media blasted to remove oxide and loaded into a Yamato DKN810 mechanical convection oven for at least 30 minutes prior to rolling to allow the plate to reach the desired temperature. The resulting cleaned hot band was rolled on a Fenn Model 061 rolling mill with steadily decreasing roll gaps, and was loaded into the furnace for at least 10 minutes between passes to ensure constant temperature. The hot band was rolled to a targeted 20% reduction and samples were EDM cut in the ASTM E8 Standard geometry. Tensile properties were measured on an Instron mechanical testing frame (Model 5984), utilizing Instron's Bluehill control and analysis software. All tensile tests were run at ambient temperature in displacement control with the bottom fixture held rigid and the top fixture moving; the load cell is attached to the top fixture.

The responses of each alloy, in particular of their elongation, yield strength, and ultimate tensile strength were monitored across the entire range of temperatures investigated. Each alloy was tested after rolling at temperatures ranging from 100° C. at the lowest to 400° C. at the highest. For Alloy 7, tensile elongation ranged from 14.7% to 35.5%, ultimate tensile strength ranged from 1218 MPa to 1601 MPa, and yield strength ranged from 557 MPa to 678 MPa across the investigated temperature range (Table 8), with Fe % numbers ranging from 29.9 to 41.7 before tensile testing, and 57.7 to 65.4 after testing (Table 9). For Alloy 18, tensile elongation ranged from 43.0% to 51.9%, ultimate tensile strength ranged from 1083 MPa to 1263 MPa, and yield strength ranged from 772 MPa to 924 MPa from 150 to 400° C. (Table 10), with Fe % numbers ranging from 6.8 to 12.3 before tensile testing and from 31.5 to 39.6 after testing in the 150 to 400° C. range (Table 11). For Alloy 34, tensile elongation ranged from 21.1% to 31.1%, ultimate tensile strength ranged from 1080 MPa to 1140 MPa, and yield strength ranged from 869 MPa to 966 MPa in the 150 to 400° C. range (Table 12), with Fe % numbers ranging from 0.4 to 1.0 before tensile testing and 0.8 to 2.1 after testing (Table 13). For Alloy 37, tensile elongation ranged from 1.5% to 9.0%, ultimate tensile strength ranged from 1537 MPa to 1750 MPa, and yield strength ranged from 1384 MPa to 1708 MPa in the 150 to 400° C. range (Table 14), with Fe % numbers ranging from 74.5 to 84.3 before tensile testing and 71.1 to 85.6 after testing (Table 15).

TABLE 8

Tensile Properties of Alloy 7 After ~20% Rolling Reduction at Different Temperatures

| Tensile Elongation (%) | Ultimate Tensile Strength (MPa) | Yield Strength (Offset 0.2%) (MPa) | Rolling Reduction (%) | Rolling Temperature (° C.) |
|---|---|---|---|---|
| 32.9 | 1396 | 389 | 0 | |
| 34.7 | 1425 | 373 | | |

TABLE 8-continued

Tensile Properties of Alloy 7 After ~20% Rolling Reduction at Different Temperatures

| Tensile Elongation (%) | Ultimate Tensile Strength (MPa) | Yield Strength (Offset 0.2%) (MPa) | Rolling Reduction (%) | Rolling Temperature (° C.) |
|---|---|---|---|---|
| 33.3 | 1392 | 382 | | |
| 25.4 | 1575 | 676 | 20.2 | 100 |
| 27.9 | 1601 | 678 | | |
| 26.5 | 1597 | 665 | | |
| 28.1 | 1519 | 593 | 21.2 | 150 |
| 30.7 | 1529 | 586 | | |
| 28.8 | 1503 | 609 | | |
| 33.8 | 1478 | 557 | 19.3 | 200 |
| 31.9 | 1458 | 575 | | |
| 35.1 | 1501 | 567 | | |
| 31.8 | 1464 | 631 | 19.8 | 250 |
| 33.5 | 1491 | 607 | | |
| 31.7 | 1491 | 583 | | |
| 35.5 | 1449 | 647 | 19.5 | 300 |
| 33.5 | 1462 | 645 | | |
| 34.0 | 1468 | 647 | | |
| 33.9 | 1468 | 663 | 19.2 | 350 |
| 34.5 | 1428 | 673 | | |
| 30.2 | 1469 | 673 | | |
| 14.7 | 1218 | 651 | 20.2 | 400 |
| 17.4 | 1287 | 648 | | |
| 17.7 | 1270 | 665 | | |

TABLE 9

Fe % Before and After Testing of Alloy 7 at Different Temperatures

| Rolling Temperature (° C.) | Fe % After Rolling | Fe % in Tested Gauge |
|---|---|---|
| 100 | 41.7 | 65.4 |
| 150 | 33.5 | 65.2 |
| 200 | 29.9 | 64.5 |
| 250 | 30.4 | 62.7 |
| 300 | 32.0 | 61.9 |
| 350 | 30.5 | 60.6 |
| 400 | 30.5 | 57.7 |

TABLE 10

Tensile Properties of Alloy 18 After ~20% Rolling Reduction at Different Temperatures

| Tensile Elongation (%) | Ultimate Tensile Strength (MPa) | Yield Strength (Offset 0.2%) (MPa) | Rolling Reduction (%) | Rolling Temperature (C.) |
|---|---|---|---|---|
| 54.3 | 1145 | 415 | 0 | |
| 53.8 | 1168 | 401 | | |
| 53.3 | 1167 | 401 | | |
| 39.6 | 1243 | 911 | | |
| 37.3 | 1242 | 922 | 20.4 | 100 |
| 37.6 | 1263 | 924 | | |
| 46.5 | 1184 | 856 | | |
| 43.4 | 1155 | 869 | 20.3 | 150 |
| 47.4 | 1195 | 859 | | |
| 43.0 | 1142 | 828 | | |
| 50.5 | 1153 | 830 | 20.5 | 200 |
| 47.2 | 1155 | 834 | | |
| 48.6 | 1125 | 797 | | |
| 49.4 | 1138 | 808 | 19.9 | 250 |
| 47.9 | 1118 | 801 | | |
| 51.7 | 1144 | 812 | | |
| 49.6 | 1100 | 798 | 20.3 | 300 |
| 51.9 | 1123 | 825 | | |

TABLE 10-continued

Tensile Properties of Alloy 18 After ~20% Rolling Reduction at Different Temperatures

| Tensile Elongation (%) | Ultimate Tensile Strength (MPa) | Yield Strength (Offset 0.2%) (MPa) | Rolling Reduction (%) | Rolling Temperature (C.) |
|---|---|---|---|---|
| 50.3 | 1139 | 784 | | |
| 49.1 | 1127 | 811 | 19.3 | 350 |
| 46.8 | 1145 | 812 | | |
| 43.0 | 1083 | 782 | 20.5 | 400 |
| 46.6 | 1130 | 778 | | |
| 46.5 | 1097 | 772 | | |

TABLE 11

Fe % Before and After Testing of Alloy 18 at Different Temperatures

| Rolling Temperature (° C.) | Fe % After Rolling | Fe % in Tested Gauge |
|---|---|---|
| 100 | 14.9 | 42.7 |
| 150 | 12.3 | 39.6 |
| 200 | 10.2 | 37.3 |
| 250 | 9.5 | 36.6 |
| 300 | 8.7 | 34.7 |
| 350 | 7.7 | 33.2 |
| 400 | 6.8 | 31.5 |

TABLE 12

Tensile Properties of Alloy 34 After ~20% Rolling Reduction at Different Temperatures

| Tensile Elongation (%) | Ultimate Tensile Strength (MPa) | Yield Strength (Offset 0.2%) (MPa) | Rolling Reduction (%) | Rolling Temperature (C.) |
|---|---|---|---|---|
| 50.3 | 944 | 509 | 0 | |
| 52.7 | 946 | 524 | | |
| 52.1 | 942 | 520 | | |
| 20.3 | 1194 | 1031 | 20.5 | 100 |
| 20.8 | 1189 | 1039 | | |
| 20.6 | 1199 | 1040 | | |
| 25.7 | 1136 | 962 | 19.9 | 150 |
| 24.2 | 1140 | 966 | | |
| 24.9 | 1136 | 961 | | |
| 25.6 | 1120 | 948 | 20.3 | 200 |
| 25.4 | 1115 | 942 | | |
| 24.4 | 1112 | 947 | | |
| 29.8 | 1092 | 904 | 19.3 | 250 |
| 29.7 | 1097 | 911 | | |
| 29.0 | 1099 | 899 | | |
| 24.0 | 1115 | 945 | 19 | 300 |
| 23.8 | 1111 | 957 | | |
| 24.0 | 1105 | 955 | | |
| 30.7 | 1088 | 869 | 20.3 | 350 |
| 21.1 | 1088 | 913 | | |
| 28.6 | 1081 | 881 | | |
| 31.1 | 1080 | 877 | 19.8 | 400 |
| 29.3 | 1084 | 883 | | |
| 30.7 | 1081 | 898 | | |

TABLE 13

| Fe % Before and After Testing of Alloy 34 at Different Temperatures | | |
|---|---|---|
| Rolling Temperature (° C.) | Fe % After Rolling | Fe % in Tested Gauge |
| 100 | 1.5 | 3.5 |
| 150 | 1.0 | 2.1 |
| 200 | 0.9 | 1.6 |
| 250 | 0.4 | 0.8 |
| 300 | 0.4 | 1.0 |
| 350 | 0.6 | 1.0 |
| 400 | 0.5 | 0.8 |

TABLE 14

| Tensile Properties of Alloy 37 After ~20% Rolling Reduction at Different Temperatures | | | | |
|---|---|---|---|---|
| Tensile Elongation (%) | Ultimate Tensile Strength (MPa) | Yield Strength (Offset 0.2%) (MPa) | Rolling Reduction (%) | Rolling Temperature (C.) |
| 8.2 | 1612 | 998 | 0 | |
| 7.7 | 1617 | 1004 | | |
| 7.8 | 1607 | 995 | | |
| 7.4 | 1780 | 1483 | | |
| 4.8 | 1763 | 1469 | 20.5 | 100 |
| 7.3 | 1771 | 1484 | | |
| 8.5 | 1645 | 1420 | | |
| 8.4 | 1634 | 1384 | 20.1 | 150 |
| 9.0 | 1642 | 1413 | | |
| 7.5 | 1631 | 1494 | 20.7 | 200 |
| 7.4 | 1635 | 1499 | | |
| 7.3 | 1629 | 1474 | | |
| 6.5 | 1537 | 1481 | 19.4 | 250 |
| 6.9 | 1542 | 1484 | | |
| 7.5 | 1546 | 1482 | | |
| 4.8 | 1591 | 1561 | 20.2 | 300 |
| 5.0 | 1588 | 1558 | | |
| 5.2 | 1596 | 1559 | | |
| 4.1 | 1649 | 1618 | 20.6 | 350 |
| 1.5 | 1644 | 1616 | | |
| 4.1 | 1647 | 1615 | | |
| 3.7 | 1750 | 1706 | 20 | 400 |
| 4.1 | 1742 | 1698 | | |
| 4.1 | 1747 | 1708 | | |

TABLE 15

| Fe % Before and After Testing of Alloy 37 at Different Temperatures | | |
|---|---|---|
| Rolling Temperature (° C.) | Fe % After Rolling | Fe % in Tensile Gauge |
| 100 | 84.3 | 85.6 |
| 150 | 77.2 | 84.4 |
| 200 | 79.9 | 76.8 |
| 250 | 75.1 | 80.9 |
| 300 | 76.7 | 71.1 |
| 350 | 77.5 | 75.7 |
| 400 | 74.5 | 72.8 |

Representative curves for each alloy herein are shown in FIG. 17 through FIG. 20 with reference curves from tested hot band and after cold rolling to the same approximate 20% reduction for parallel comparison.

This Case Example demonstrates that yield strength in alloys herein can be increased although phase transformation of austenite into ferrite is reduced when rolling at temperatures of 100° C. or greater up to 400° C. Examples of changes in yield strength, ultimate tensile strength, and tensile elongation were provided for both Steps 3a and **3*b* in FIG. 2**.

Case Example #6 Effect of Reduction of Rolling at 200° C. on Yield Strength of Alloy 2

Alloy 2 was processed into a hot band with thickness of approximately 2.5 mm from the laboratory cast. Following hot rolling, Alloy 2 was rolled at 200° C. to varying rolling reductions ranging from approximately 10% to 40%. Between rolling passes, the Alloy 2 sheet material was placed in a convection furnace at 200° C. for 10 minutes to maintain the temperature. When the desired rolling reduction was achieved, ASTM E8 tensile samples were cut via wire-EDM and tested.

Figure 21:
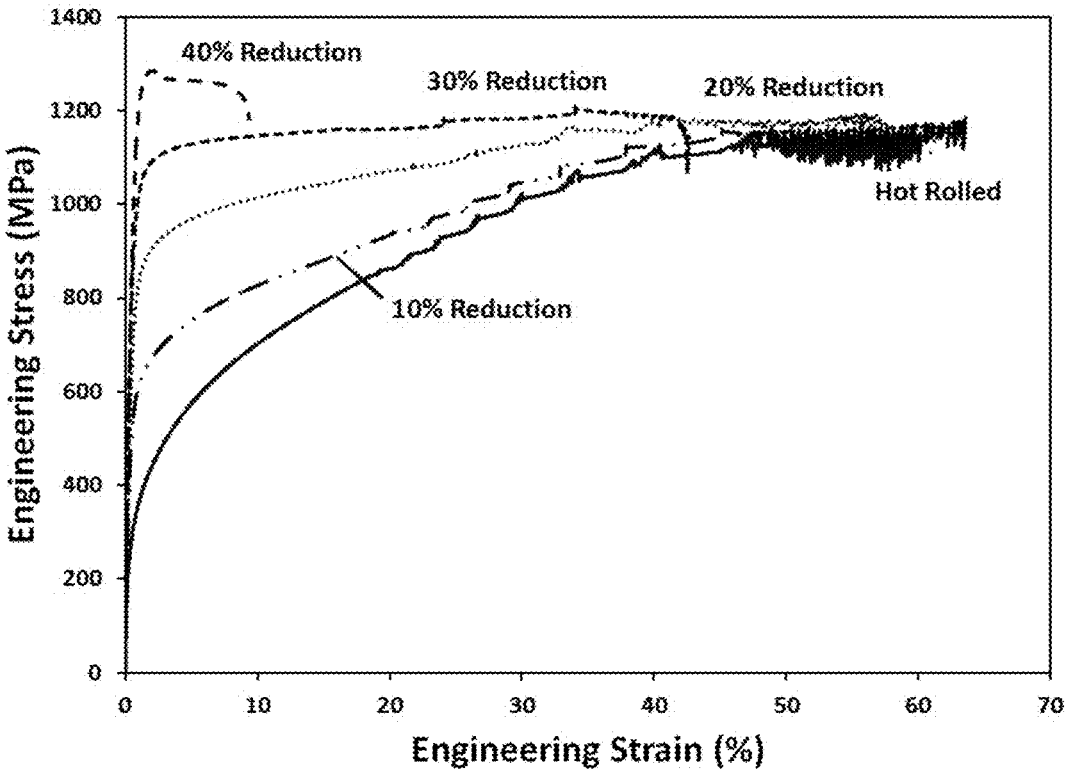
FIG. 21 Representative engineering stress-strain curves for Alloy 2 that was rolled at 200° C. to various rolling reductions.
Figure 22:
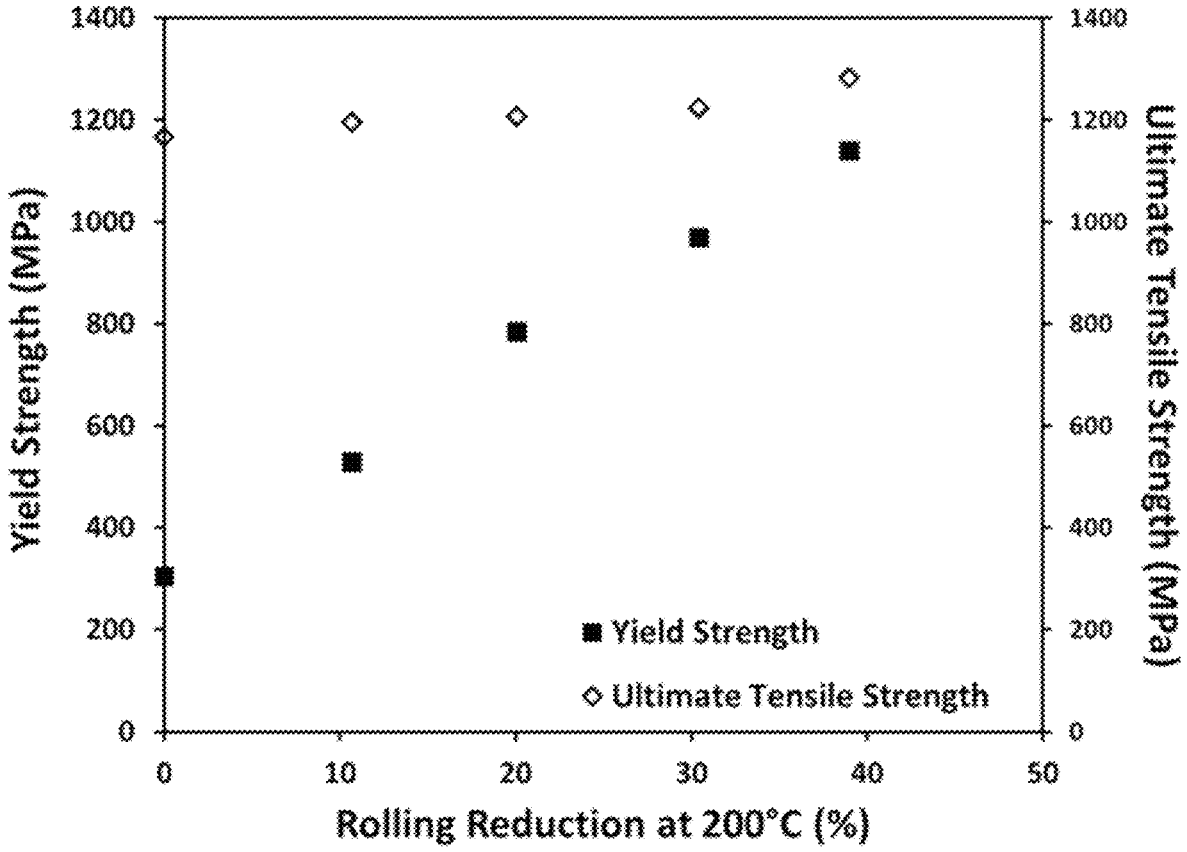
FIG. 22 The yield and ultimate tensile strength of Alloy 2 as a function of rolling reduction at 200° C. (Note that the yield strength increases rapidly as rolling reduction is increased, while the ultimate tensile strength is only slightly increased.)

Tensile properties of Alloy 2 after rolling at 200° C. with different rolling reduction (0.0 to 70.0%) are listed in Table 16, which also includes data prior to any rolling experiments. FIG. 21 shows the representative tensile curves for Alloy 2 as a function of rolling reduction at 200° C. It is observed that the yield strength of the material increases rapidly with increasing reduction, without changing the ultimate tensile strength (i.e. a change of plus or minus 100 MPa) up to 30% reduction. FIG. 22 provides a comparison of the trends for yield strength and ultimate tensile strength as a function of rolling reduction at 200° C., showing that while the yield strength increase is relatively rapid, the ultimate tensile strength change is consistent with step 3a property changes in FIG. 2 up to 30.4% rolling reduction and is consistent with step 3b property changes at 39.0% rolling reduction.

Figure 23:
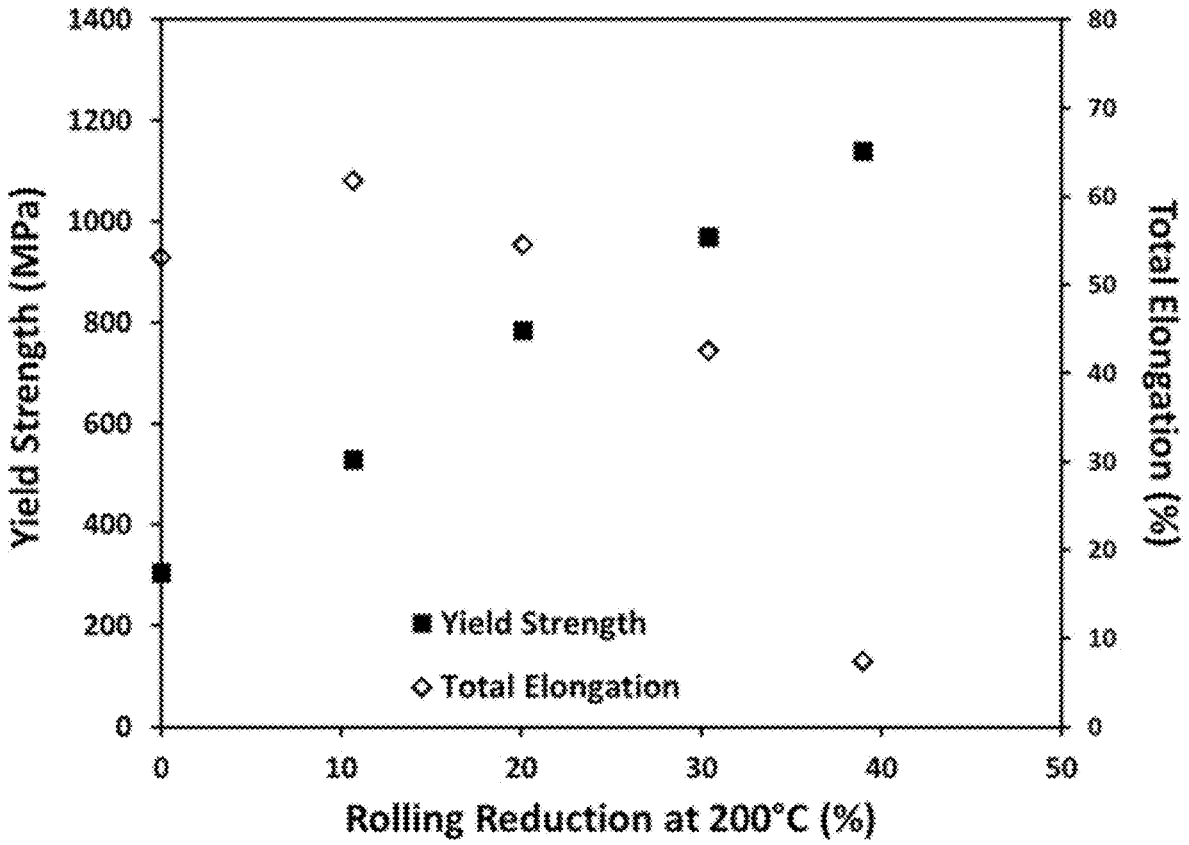
FIG. 23 The yield strength and total elongation of Alloy 2 as a function of rolling reduction at 200° C. (Note that the yield strength increases rapidly as rolling reduction is increased, while the total elongation decreases slowly up to 30% reduction with rapid drop at 40%.)

The total elongation of Alloy 2 is plotted as a function of rolling reduction at 200° C. in FIG. 23. It demonstrates that while the yield strength of Alloy 2 is increasing with additional reduction during rolling at 200° C., the available ductility does not decrease rapidly until >30% reduction. Note that this is simulated using laboratory rolling and commercial rolling methods including tandem mill rolling, Z-mill rolling, and reversing mill rolling will additionally apply a strip tension during rolling so the exact amount of reduction whereby ductility decreases may change.

Figure 24:
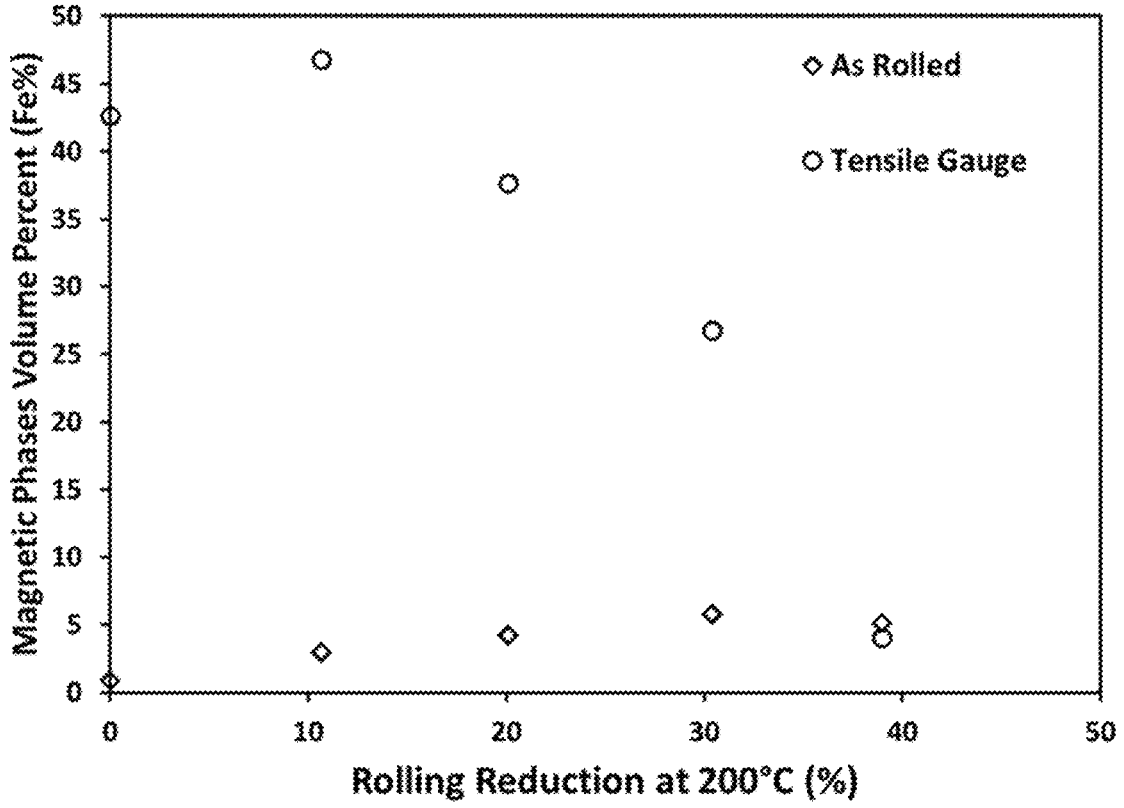
FIG. 24 The effect of rolling at 200° C. on the deformation induced phase transformation in Alloy 2 as a function of rolling reduction. (Note that the transformation measured in the as rolled material is slightly increasing, whereas the transformation after tensile testing is rapidly decreasing across the range of rolling reductions tested.)

The magnetic phases volume percent (Fe %) was measured using a Fischer Feritscope FMP30 for the samples after rolling at 200° C. and again after tensile testing in the tensile gauge (i.e. the reduced gauge section present in the tensile specimen). These measurements, shown in Table 17, are indicative of the amount of deformation-induced phase transformation that is occurring in the alloy during the rolling process and during subsequent tensile testing. The amount of deformation-induced phase transformation in Alloy 2 after rolling and tensile testing is shown in FIG. 24. It can be seen that the deformation-induced phase transformation is largely suppressed at 200° C., as the magnetic phases volume percent only increases slightly with increasing rolling reduction. Rolling at 200° C. is demonstrated to have an effect on the deformation-induced phase transformation during tensile testing also, with increasing rolling reductions suppressing the amount of transformation in the material.

TABLE 16

Average Tensile Properties of Alloy 2 after Rolling at 200° C. to Various Reductions

| Rolling Reduction (%) | Yield Strength (MPa) | Ultimate Tensile Strength (MPa) | Tensile Elongation (%) |
|---|---|---|---|
| 0.0 | 296 | 1165 | 47.4 |
| | 309 | 1171 | 51.5 |
| | 306 | 1162 | 60.2 |
| 10.7 | 496 | 1175 | 60.8 |
| | 556 | 1223 | 63.5 |
| | 536 | 1187 | 61.0 |
| 20.1 | 803 | 1205 | 52.3 |
| | 775 | 1196 | 58.0 |
| | 773 | 1218 | 53.3 |
| 30.4 | 986 | 1226 | 42.3 |
| | 938 | 1209 | 42.7 |
| | 979 | 1233 | 42.6 |
| 39.0 | 1123 | 1274 | 5.5 |
| | 1148 | 1290 | 7.2 |
| | 1147 | 1285 | 9.4 |
| 50.4* | 805 | 1425 | 5.11 |
| | 1107 | 1445 | 5.17 |
| | 786 | 1427 | 3.1 |
| 60.1* | 1258 | 1520 | 6.92 |
| | 1200 | 1520 | 6.93 |
| | 1216 | 1524 | 4.29 |
| 70.0* | 1299 | 1623 | 6.06 |
| | 1361 | 1625 | 6.58 |
| | 1348 | 1626 | 6.14 |

*Different processing was applied: Alloy 2 was processed into hot band at 1250° C. with a thickness of approximately 9.3 mm, subsequently media blasted to remove the oxide and then rolled at 200° C. to 4.6 mm (~50% reduction). The material was then annealed at 850° C. for 10 minutes and rolled at 200° C. to approximately 50.4, 60.1, and 70% reduction.

TABLE 17

Magnetic Phases Volume Percent (Fe %) as a Function of Rolling Reduction

| Rolling Reduction (%) | Fe % After Rolling | Fe % in Tensile Gauge |
|---|---|---|
| 0.0 | 0.9 | 42.6 |
| 10.7 | 3.0 | 46.7 |
| 20.1 | 4.2 | 37.9 |
| 30.4 | 5.8 | 26.7 |
| 39.0 | 5.1 | 16.2 |
| 50.4 | 2.5 | 15.3 |
| 60.1 | 2.4 | 13.5 |
| 70.0 | 2.3 | 16.1 |

This Case Example demonstrates that the yield strength of the alloys described herein may be tailored by varying the rolling reduction at temperatures greater than ambient as shown here for Alloy 2 by rolling at 200° C. In the broad context of the present disclosure, the temperature range is contemplated to be between 150° C. to 400° C. as provided in the previous case example for Table 7. During this rolling, the deformation pathway is modified such that relatively limited deformation-induced phase transformation is occurring, which results in the ability to retain significant ductility and maintain ultimate tensile strength while increasing yield strength in the cold rolled state. Thereby, the parameters of the rolling can be optimized to improve the yield strength of the material without sacrificing the ductility or ultimate tensile strength.

Case Example #7 Microstructure in Alloy 2 after Rolling at 200° C.

Alloy 2 was processed into a hot band with thickness of 9 mm from the laboratory cast mimicking processing at commercial hot band production. The hot band was cold rolled with 50% reduction and annealed at 850° C. for 10 minutes with air cooling mimicking cold rolling processing at commercial sheet production. Media blasting was used to remove the oxides which formed during annealing. Then the alloys were cold rolled again until failure or the mill limited reduction. Samples were heated to 200° C. in a convection oven for at least 30 minutes prior to cold rolling to ensure they were at uniform temperature, and reheated for 10 minutes between passes to ensure constant temperature. Alloy 2 sheet was cold rolled first with reduction of 30% and then to a maximum reduction of 70%. Microstructure of the initial structure and after rolling was studied by scanning electron microscopy (SEM). To prepare SEM samples, pieces were cut by EDM and mounted in epoxy, and polished progressively with 9 μm, 6 μm and 1 μm diamond suspension solution, and finally with 0.02 μm silica.

Figure 25:
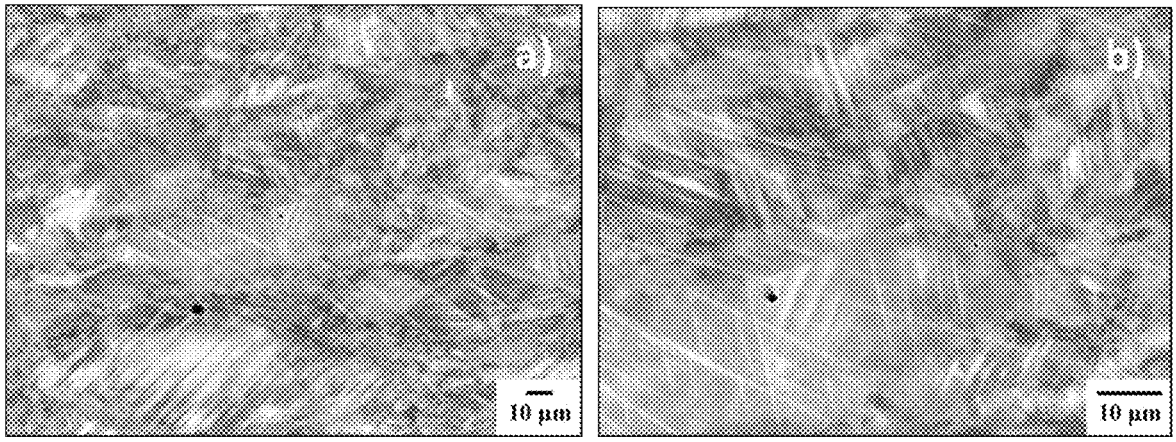
FIG. 25 Backscattered SEM micrograph of microstructure in hot band from Alloy 2: a) low magnification image; b) high magnification image.
Figure 26:
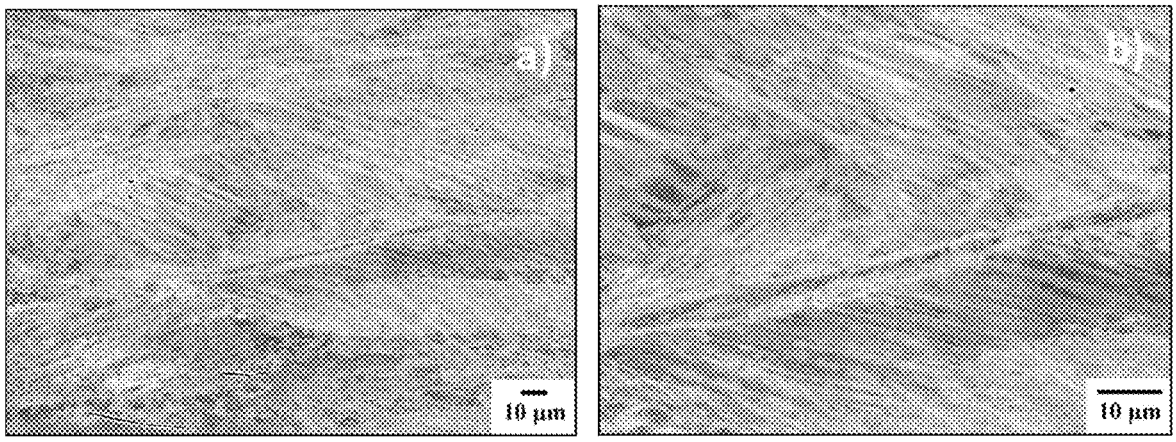
FIG. 26 Backscattered SEM micrographs of microstructure in Alloy 2 after rolling at 200° C. to 30% reduction: a) low magnification image; b) high magnification image.

FIG. 25 shows the backscattered SEM images of the microstructure before cold rolling that is mostly austenitic with annealing twins inside micron-sized grains. After cold rolling with 30% reduction, as shown in FIG. 26, a band structure can be seen in different areas with different orientations. Presumably, the bands with similar orientation are deformation twins in one austenitic grain while bands in different direction are twins in another crystal orientation grain. Some grain refinement can be observed in selected areas.

Figure 27:
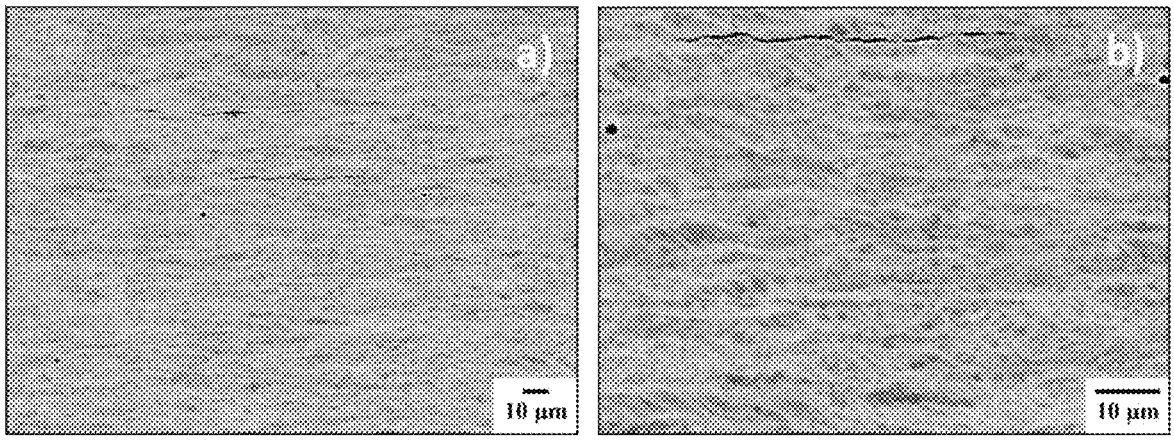
FIG. 27 Backscattered SEM micrographs of microstructure in Alloy 2 after rolling at 200° C. to 70% reduction: a) low magnification image; b) high magnification image.

After the rolling reduction is increased to 70%, the bands are no longer visible, and refined structure through the volume can be seen (FIG. 27). As shown in the high magnification image in FIG. 27*b*, fine islands with size much smaller than 10 μm can be discerned. Considering the high deformation exerted in the stable austenite during the rolling process, the austenite could be dramatically refined typically in the range of 100 to 500 nm. Feritscope measurements suggest that the austenite is stable at 200° C. with nearly 100% austenite maintained after rolling.

This Case Example demonstrates austenite stabilization (i.e. the resistance to transformation to ferrite) in alloys herein during the rolling at 200° C. even at high rolling reduction of 70% and microstructural refinement of the austenite in contrast to cold rolling when refinement occurs through austenite transformation to ferrite.

Case Example #8 Effect of Rolling Reduction at 200° C. on Microstructure in Alloy 2

Rolling at temperature resulted in significant increase in yield strength of the Alloy 2 while high tensile elongation was maintained. TEM study was conducted on the Alloy 2 rolled at 200° C. to analyze the structural changes during the rolling at 200° C. as a function of rolling strain. In this case example, 50 mm thick laboratory cast slab was hot rolled first, and the resultant hot band was then rolled at 200° C. to different strains. To show structural evolution, microstructures of the rolled sheets were studied by transmission electron microscopy (TEM). To prepare TEM specimens, the samples were cut from the sheet using wire-EDM, and then thinned by grinding with pads of reduced grit size every time. Further thinning to 60 to 70 μm thick samples was done by polishing with 9 μm, 3 μm and 1 μm diamond suspension solutions, respectively. Discs of 3 mm in diameter were punched from the foils and the final polishing was fulfilled by electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling usually is done at 4.5 keV, and the inclination angle is reduced from 4° to 2° to open up the thin area. The TEM studies were done using a JEOL 2100 high-resolution microscope operated at 200 kV.

Figure 28:
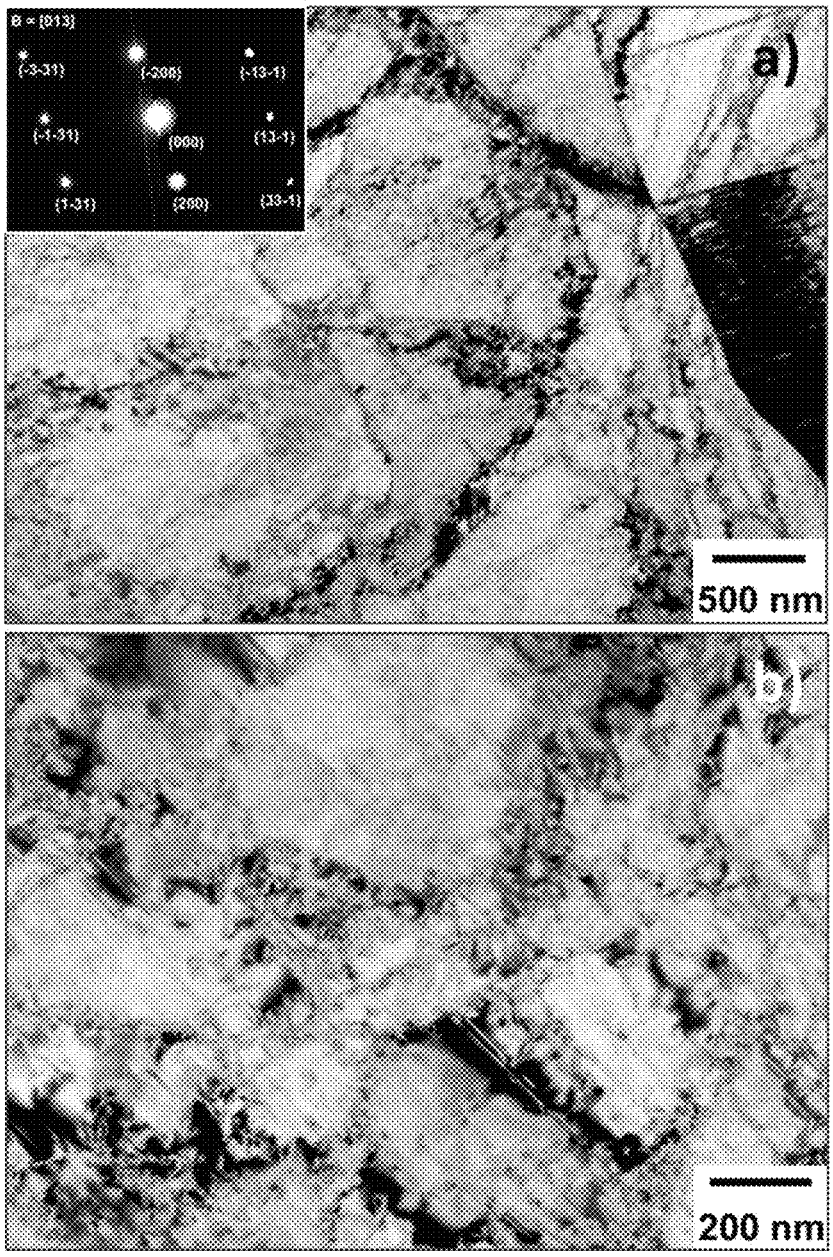
FIG. 28 Bright-field TEM micrographs of the microstructure in Alloy 2 after rolling at 200° C. with 10% reduction: a) low magnification image and b) high magnification image.
Figure 29:
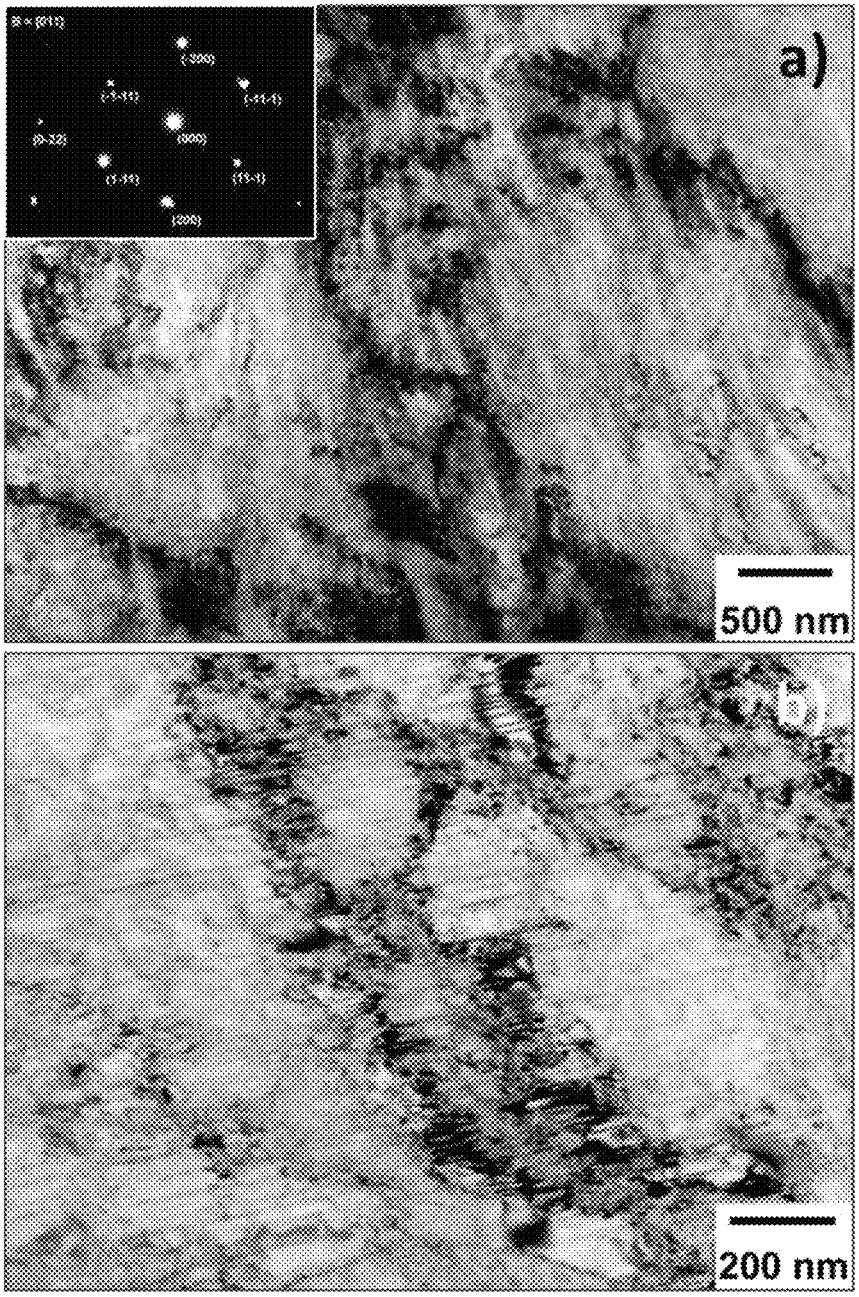
FIG. 29 Bright-field TEM micrographs of the microstructure in Alloy 2 after rolling at 200° C. with 30% reduction: a) low magnification image and b) high magnification image.
Figure 30:
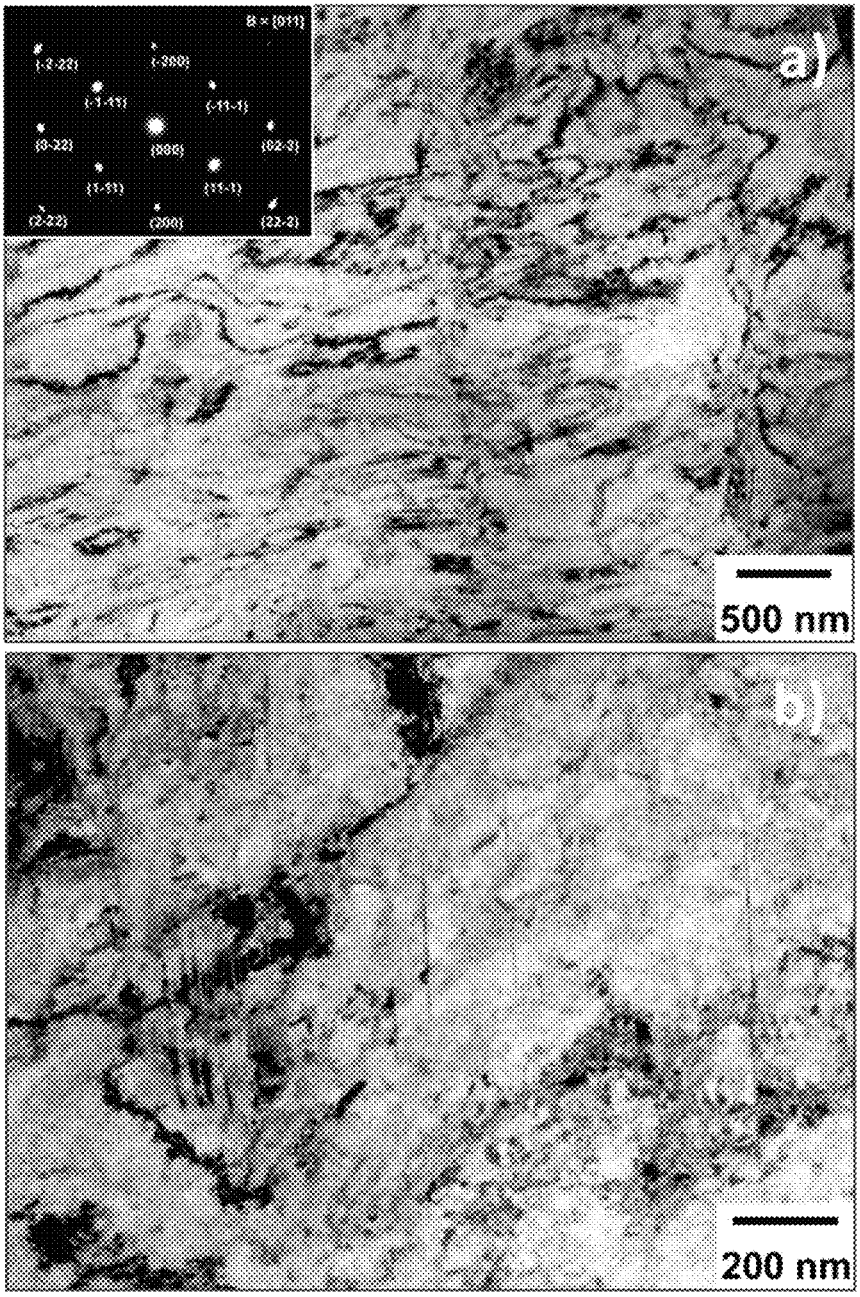
FIG. 30 Bright-field TEM micrographs of the microstructure in Alloy 2 after rolling at 200° C. with 70% reduction: a) low magnification image and b) high magnification image.
Figure 31:
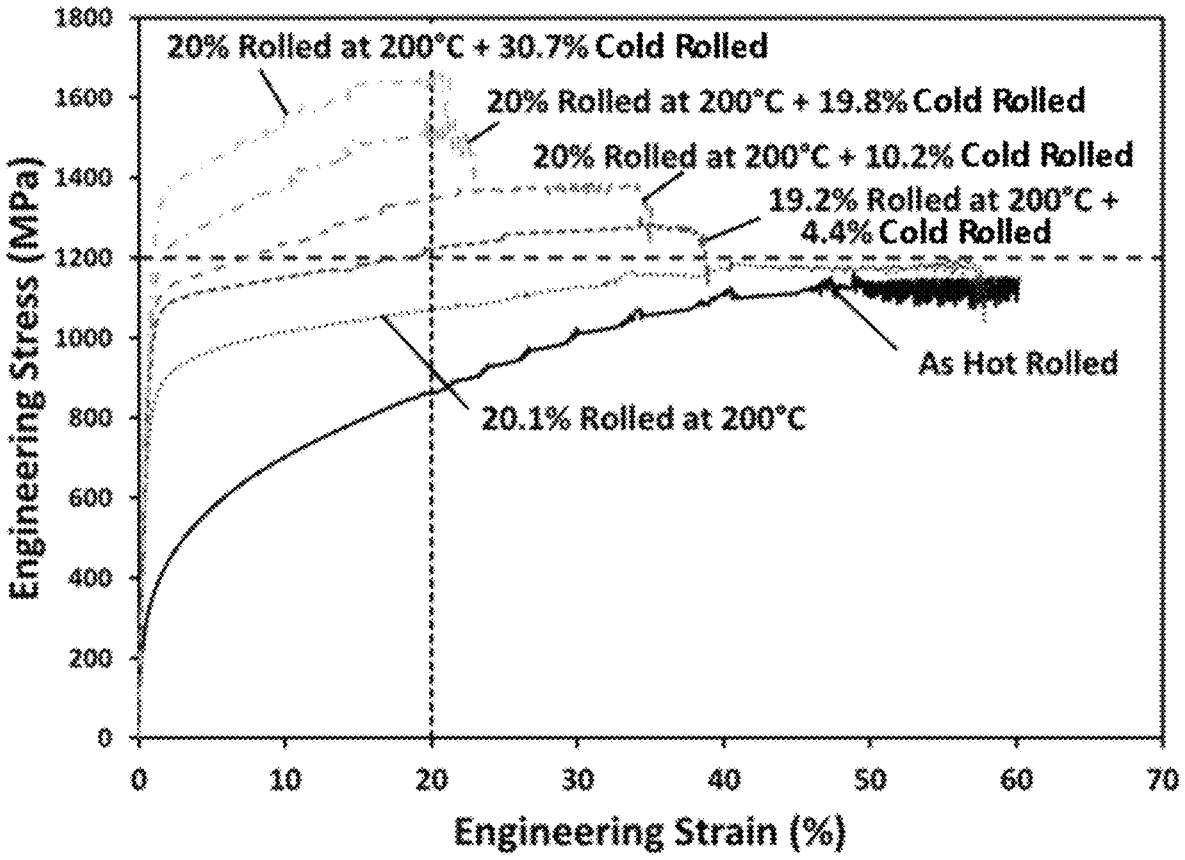
FIG. 31 Engineering stress-strain curves for Alloy 2 processed by combination of rolling methods. (Note specific processing condition variations are listed which include the as-hot rolled condition and either single step or multiple step rolling.)
Figure 32:
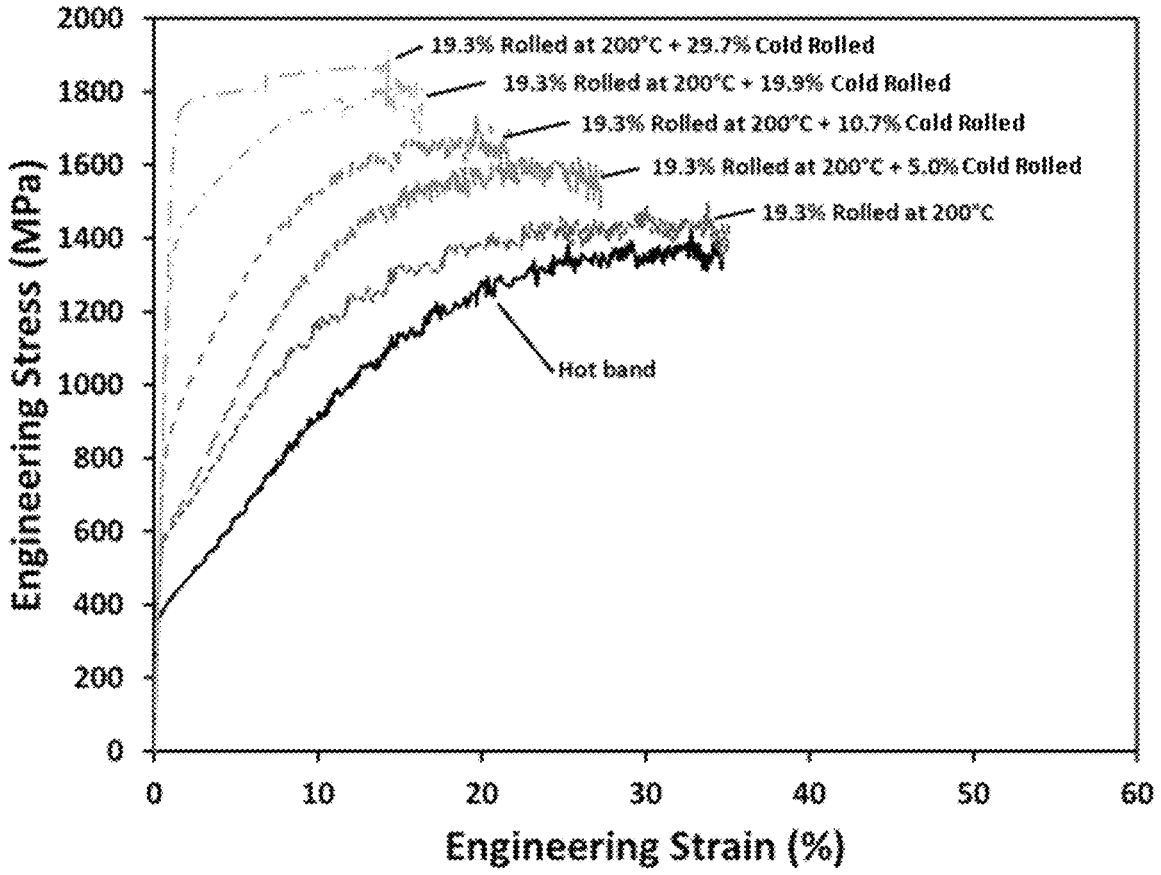
FIG. 32 Engineering stress-strain curves for Alloy 7 processed by combination of rolling methods. (Note specific processing condition variations are listed which include the as-hot rolled condition and either single step or multiple step rolling.)
Figure 33:
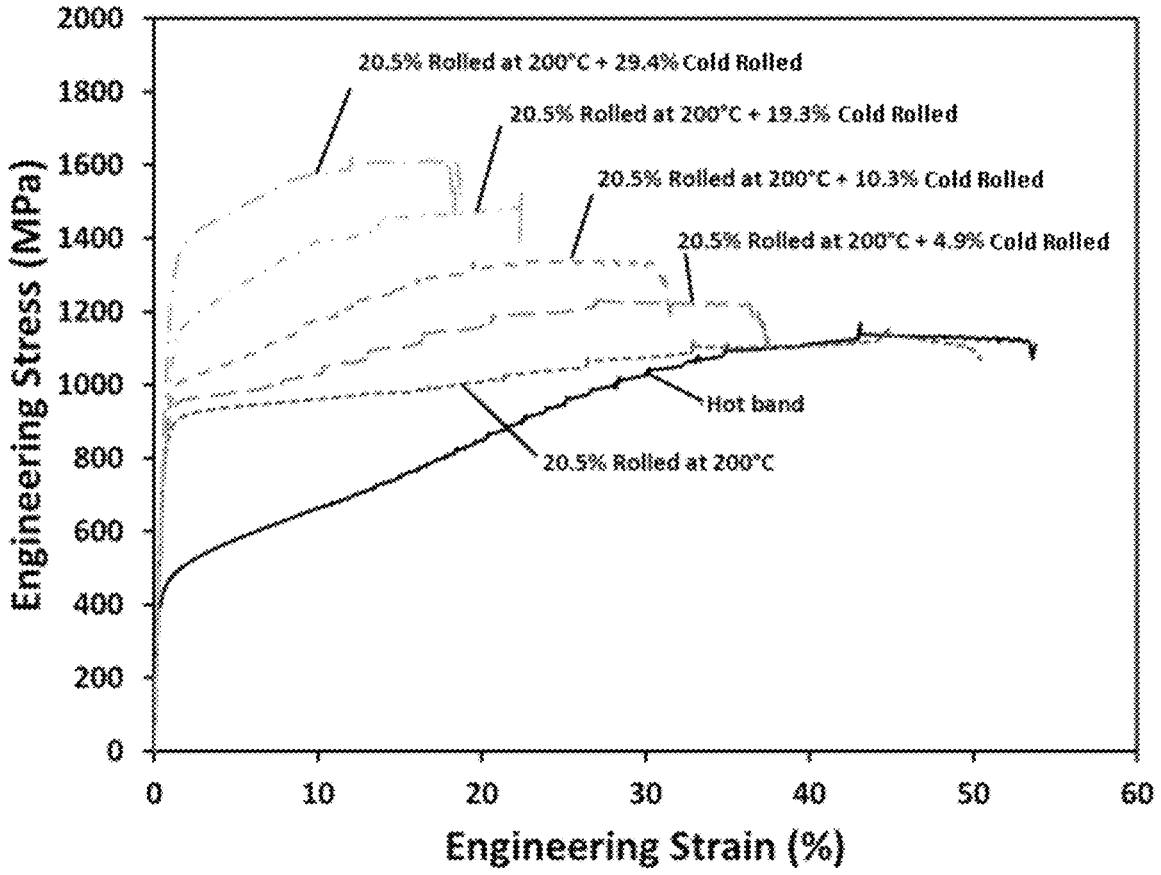
FIG. 33 Engineering stress-strain curves for Alloy 18 processed by combination of rolling methods. (Note specific processing condition variations are listed which include the as-hot rolled condition and either single step or multiple step rolling.)
Figure 34:
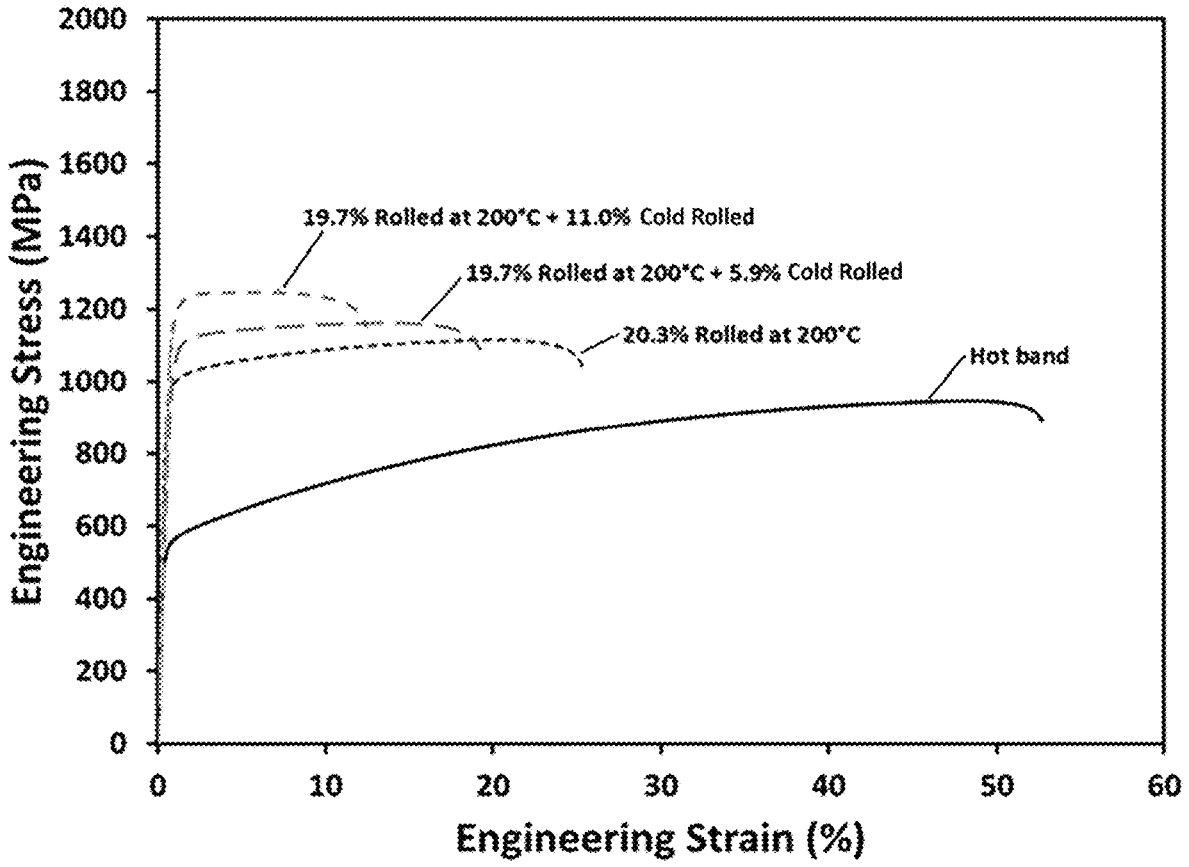
FIG. 34 Engineering stress-strain curves for Alloy 34 processed by combination of rolling methods. (Note specific processing condition variations are listed which include the as-hot rolled condition and either single step or multiple step rolling.)

FIG. 28 shows the bright-field TEM images of the microstructure in the Alloy 2 rolled at 200° C. with 10% reduction. It can be seen that the austenite grains are filled with tangled dislocations, and dislocation cell structure is exhibited. However, due to the relatively low rolling strain, the original austenite grain boundaries are still visible. It is noted that the austenite is stable during the rolling at 200° C. Electron diffraction suggests that austenite is the predominant phase that was also consistent with Feritscope measurement. Rolling at 200° C. with 10% reduction increases the average yield strength from 303 MPa in the hot band to 529 MPa (see Table 16). When the sheet is rolled to 30%, TEM qualitatively shows higher dislocations density in the grains, as shown in FIG. 29, and clear dislocation cell structure is exhibited. In addition, some deformation twins are seen within the austenite grains. Similar to the 10% rolled sample, the austenite phase is maintained, as confirmed by the electron diffraction. However, the original grain boundaries of austenite are no longer visible. Rolling at 200° C. with 30% reduction results in average yield strength of 968 MPa (Table 16). After rolling with 70% reduction (FIG. 30), a qualitatively higher dislocation density continues can be seen from TEM, and dislocation cells are similar to that in the 30% rolled sample (FIG. 29). In addition, deformation twins are also present in the sample. Similar to the 30% rolled sample, the austenite still remains stable during rolling that is verified by electron diffraction.

This Case Example demonstrates that the alloys herein maintain austenite structure during rolling at 200° C. with up to 70% reduction. Structural changes including dislocation cell formation and twinning leads to increase in yield strength after rolling at 200° C.

Case Example #9 Process Route by Combination of Rolling Methods

Alloys 2, Alloy 7, Alloy 18, and Alloy 34 were processed into hot band with a thickness of ~2.7 mm, this was media blasted to remove the oxide and rolled at 200° C. to 20% reduction. The material was sectioned and then rolled at a range of reductions at ambient temperature. ASTM E8 tensile samples were cut by wire EDM and tested in an Instron 5984 frame using Instron's Bluehill software.

Tensile properties of the selected alloys after combined rolling are listed in Table 18 through Table 21. Significant increase in yield strength after combination of rolling methods was observed in all three alloys as compared to the hot band state or just after rolling with ~20% reduction in rolling thickness at 200° C. and subsequent rolling reduction at ambient temperature. Yield strength up to 1216 MPa recorded for Alloy 2 (yield strength in hot band is 309 MPa and 803 MPa after rolling at 200° C.), up to 1571 MPa in Alloy 7 (yield strength in hot band is 333 MPa and 575 MPa after rolling at 200° C.), up to 1080 MPa in Alloy 18 (yield strength in hot band is 390 MPa and 834 MPa after rolling at 200° C.), and up to 1248 MPa in Alloy 34 (yield strength in hot band is 970 MPa and 1120 MPa after rolling at 200° C.). FIG. 31 through FIG. 34 shows the corresponding tensile curves for alloys 2, 7, 18, and 34, respectively. An increase in ultimate tensile strength after cold rolling was also observed in all alloys herein with decrease in tensile elongation (see Tables 18 through 21). Analysis of the magnetic phases volume percent of the selected alloys herein in each examined condition, both prior to and after tensile testing is listed in Table 22 through Table 25. Cold rolling leads to higher Fe % in the processed sheet from the alloys herein followed by further increase in Fe % due to the transformation occurring during tensile testing.

TABLE 18

Tensile Properties of Alloy 2 after Combination of Rolling Methods

| First Reduction by Rolling at 200° C. | Second Reduction by Cold Rolling | Tensile Elongation (%) | Ultimate Tensile Strength (MPa) | Yield Strength (MPa) |
|---|---|---|---|---|
| Hot Band | | 47.4 | 1165 | 296 |
| | | 51.5 | 1171 | 309 |
| | | 60.2 | 1162 | 306 |
| 20.1 | — | 52.3 | 1205 | 803 |
| 20.1 | — | 58.0 | 1196 | 775 |
| 20.1 | — | 53.3 | 1218 | 773 |
| 19.2 | 4.4 | 36.1 | 1298 | 951 |
| 19.2 | 4.4 | 39.0 | 1303 | 974 |
| 19.2 | 4.4 | 37.4 | 1275 | 944 |
| 20.0 | 10.2 | 35.1 | 1386 | 994 |
| 20.0 | 10.2 | 31.8 | 1393 | 1018 |
| 20.0 | 10.2 | 34.0 | 1409 | 999 |
| 20.0 | 19.8 | 19.2 | 1544 | 1064 |
| 20.0 | 19.8 | 23.1 | 1542 | 1079 |
| 20.0 | 19.8 | 18.5 | 1541 | 1068 |
| 20.0 | 30.7 | 21.3 | 1662 | 1199 |
| 20.0 | 30.7 | 15.2 | 1665 | 1216 |
| 20.0 | 30.7 | 20.3 | 1672 | 1212 |

TABLE 19

Tensile Properties of Alloy 7 after Combination of Rolling Methods

| First Reduction by Rolling at 200° C. | Second Reduction by Cold Rolling | Tensile Elongation (%) | Ultimate Tensile Strength (MPa) | Yield Strength (MPa) |
|---|---|---|---|---|
| Hot Band | | 28.1 | 1508 | 333 |
| | | 28.5 | 1516 | 331 |
| | | 26.0 | 1520 | 317 |
| 19.3 | — | 33.8 | 1478 | 557 |
| 19.3 | — | 31.9 | 1458 | 575 |
| 19.3 | — | 35.1 | 1501 | 567 |
| 19.3 | 5 | 27.4 | 1598 | 625 |
| 19.3 | 5 | 26.1 | 1619 | 608 |
| 19.3 | 5 | 27.4 | 1629 | 597 |
| 19.3 | 10.7 | 23.4 | 1689 | 795 |
| 19.3 | 10.7 | 20.4 | 1710 | 774 |
| 19.3 | 10.7 | 21.7 | 1737 | 778 |
| 19.3 | 19.9 | 15.1 | 1817 | 1199 |
| 19.3 | 19.9 | 16.3 | 1802 | 1217 |
| 19.3 | 19.9 | 16.5 | 1838 | 1265 |
| 19.3 | 29.7 | 12.0 | 1872 | 1510 |
| 19.3 | 29.7 | 14.4 | 1907 | 1492 |
| 19.3 | 29.7 | 13.1 | 1920 | 1571 |

TABLE 20

Tensile Properties of Alloy 18 after Combination of Rolling Methods

| First Reduction by Rolling at 200° C. | Second Reduction by Cold Rolling | Tensile Elongation (%) | Ultimate Tensile Strength (MPa) | Yield Strength (MPa) |
|---|---|---|---|---|
| Hot Band | | 58.8 | 1224 | 384 |
| | | 56.1 | 1245 | 390 |
| | | 50.7 | 1190 | 365 |
| 20.5 | — | 43.0 | 1142 | 828 |
| 20.5 | — | 50.5 | 1153 | 830 |

TABLE 20-continued

| Tensile Properties of Alloy 18 after Combination of Rolling Methods | | | | |
|---|---|---|---|---|
| First Reduction by Rolling at 200° C. | Second Reduction by Cold Rolling | Tensile Elongation (%) | Ultimate Tensile Strength (MPa) | Yield Strength (MPa) |
| 20.5 | — | 47.2 | 1155 | 834 |
| 20.5 | 4.9 | 35.7 | 1244 | 846 |
| 20.5 | 4.9 | 37.5 | 1243 | 856 |
| 20.5 | 4.9 | 34.8 | 1251 | 769 |
| 20.5 | 10.3 | 30.7 | 1339 | 830 |
| 20.5 | 10.3 | 31.6 | 1340 | 905 |
| 20.5 | 10.3 | 26.6 | 1337 | 819 |
| 20.5 | 19.3 | 22.4 | 1529 | 1025 |
| 20.5 | 19.3 | 22.3 | 1523 | 898 |
| 20.5 | 19.3 | 22.0 | 1521 | 885 |
| 20.6 | 29.4 | 17.0 | 1625 | 1008 |
| 20.6 | 29.4 | 17.3 | 1641 | 1080 |
| 20.6 | 29.4 | 18.8 | 1622 | 1074 |

TABLE 21

| Tensile Properties of Alloy 34 after Combination of Rolling Methods | | | | |
|---|---|---|---|---|
| First Reduction by Rolling at 200° C. | Second Reduction by Cold Rolling | Tensile Elongation (%) | Ultimate Tensile Strength (MPa) | Yield Strength (MPa) |
| Hot Band | | 65.9 | 963 | 515 |
| | | 58.7 | 954 | 485 |
| | | 62.1 | 970 | 545 |
| 20.3 | — | 25.6 | 1120 | 948 |
| 20.3 | — | 25.4 | 1115 | 942 |
| 20.3 | — | 24.4 | 1112 | 947 |
| 19.7 | 5.9 | 18.2 | 1173 | 1037 |
| 19.7 | 5.9 | 18.8 | 1163 | 1020 |
| 19.7 | 5.9 | 19.3 | 1162 | 1005 |
| 19.7 | 11 | 12.4 | 1247 | 866 |
| 19.7 | 11 | 11.9 | 1243 | 1028 |
| 19.7 | 11 | 12.2 | 1248 | 1055 |

TABLE 22

| Magnetic Phases Volume Percent (Fe %) in Alloy 2 after Combination of Rolling Methods | | | |
|---|---|---|---|
| First Reduction by Rolling at 200° C. (%) | Second Reduction by Cold Rolling (%) | Fe % After Rolling (Fe %) | Fe % in Tensile Gauge (Fe %) |
| 0.0 | 0.0 | 0.9 | 42.6 |
| 20.1 | 0.0 | 4.2 | 37.6 |
| 19.2 | 4.4 | 3.6 | 34.0 |
| 20.0 | 10.2 | 6.1 | 40.0 |
| 20.0 | 19.8 | 11.6 | 44.9 |
| 20.0 | 30.7 | 16.8 | 49.3 |

TABLE 23

| Magnetic Phases Volume Percent (Fe %) in Alloy 7 after Combination of Rolling Methods | | | |
|---|---|---|---|
| Rolling Reduction at 200° C. (%) | Reduction at Cold Rolling (%) | Fe % After Rolling (Fe %) | Fe % in Tensile Gauge (Fe %) |
| 0 | 0 | 10.4 | 63.6 |
| 19.3 | 0 | 29.9 | 64.5 |
| 19.3 | 5.0 | 33.8 | 64.9 |

TABLE 23-continued

| Magnetic Phases Volume Percent (Fe %) in Alloy 7 after Combination of Rolling Methods | | | |
|---|---|---|---|
| Rolling Reduction at 200° C. (%) | Reduction at Cold Rolling (%) | Fe % After Rolling (Fe %) | Fe % in Tensile Gauge (Fe %) |
| 19.3 | 10.7 | 44.0 | 66.2 |
| 19.3 | 19.9 | 56.4 | 67.9 |
| 19.3 | 29.7 | 59.8 | 67.3 |

TABLE 24

| Magnetic Phases Volume Percent (Fe %) in Alloy 18 after Combination of Rolling Methods | | | |
|---|---|---|---|
| First Reduction by Rolling at 200° C. (%) | Second Reduction by Cold Rolling (%) | Fe % After Rolling (Fe %) | Fe % in Tensile Gauge (Fe %) |
| 0.0 | 0.0 | 0.3 | 48.6 |
| 20.5 | 0.0 | 10.2 | 37.3 |
| 20.5 | 4.9 | 9.9 | 38.5 |
| 20.5 | 10.3 | 14.4 | 42.0 |
| 20.5 | 19.3 | 23.0 | 48.2 |
| 20.6 | 29.4 | 32.5 | 49.2 |

TABLE 25

| Magnetic Phases Volume Percent (Fe %) in Alloy 34 after Combination of Rolling Methods | | | |
|---|---|---|---|
| First Reduction by Rolling at 200° C. (%) | Second Reduction by Cold Rolling (%) | Fe % After Rolling (Fe %) | Fe % in Tensile Gauge (Fe %) |
| 0.0 | 0.0 | 0.3 | 2.2 |
| 20.3 | 0.0 | 0.9 | 1.6 |
| 19.7 | 5.9 | 1.1 | 1.6 |
| 19.7 | 11.0 | 1.4 | 2.9 |
| 19.7 | 19.7 | 1.8 | 2.7 |
| 19.7 | 29.7 | 2.0 | 2.7 |

This Case Example demonstrates a pathway to creating a third distinct set of property combinations, which may be achieved by processing the alloy into a sheet at a thickness of 0.5 mm to 5.0 mm, followed by deforming (rolling) and reducing thickness in one pass at a temperature in the range of 150° C. to 400° C., and then subsequent reductions in thickness at temperatures ≤150° C. temperature. This is observed to provide relatively higher yield strength compared to only cold rolling, and higher tensile strengths compared to only rolling at temperature.

Case Example #10 Example Methods to Tailor Property Combinations

A hot band from Alloy 2 was processed into a sheet by different methods herein towards higher yield strength and property combination according to the steps provided in FIG. 2 and FIG. 3. Alloy 2 was first cast and then processed into a sheet via hot rolling which was from 2.5 to 2.7 mm thick. For tensile comparison, the reference hot band material was hot rolled to ~1.8 mm to reduce gauge prior to testing. For the FIG. 2 example (i.e. Rolled 20% at 200° C.), the hot band was rolled with a 20% reduction at 200° C. Prior to rolling, it was heated up to 200° C. for 30 minutes before being rolled 20% at 200° C. with a 10 minute reheat between rolling passes to maintain temperature. For the FIG. 3 example (i.e. rolled 20% at 200° C. and then 10% cold roll at ambient temperature), the process steps were repeated which included a 20% reduction at 200° C. and with the additional step of a 10% ambient temperature rolling reduction applied. Tensile specimens were cut from the sheet processed by each method using wire EDM. Tensile properties were measured on an Instron mechanical testing frame (Model 5984), utilizing Instron's Bluehill control and analysis software. All tests were run at ambient temperature in displacement control.

Figure 35:
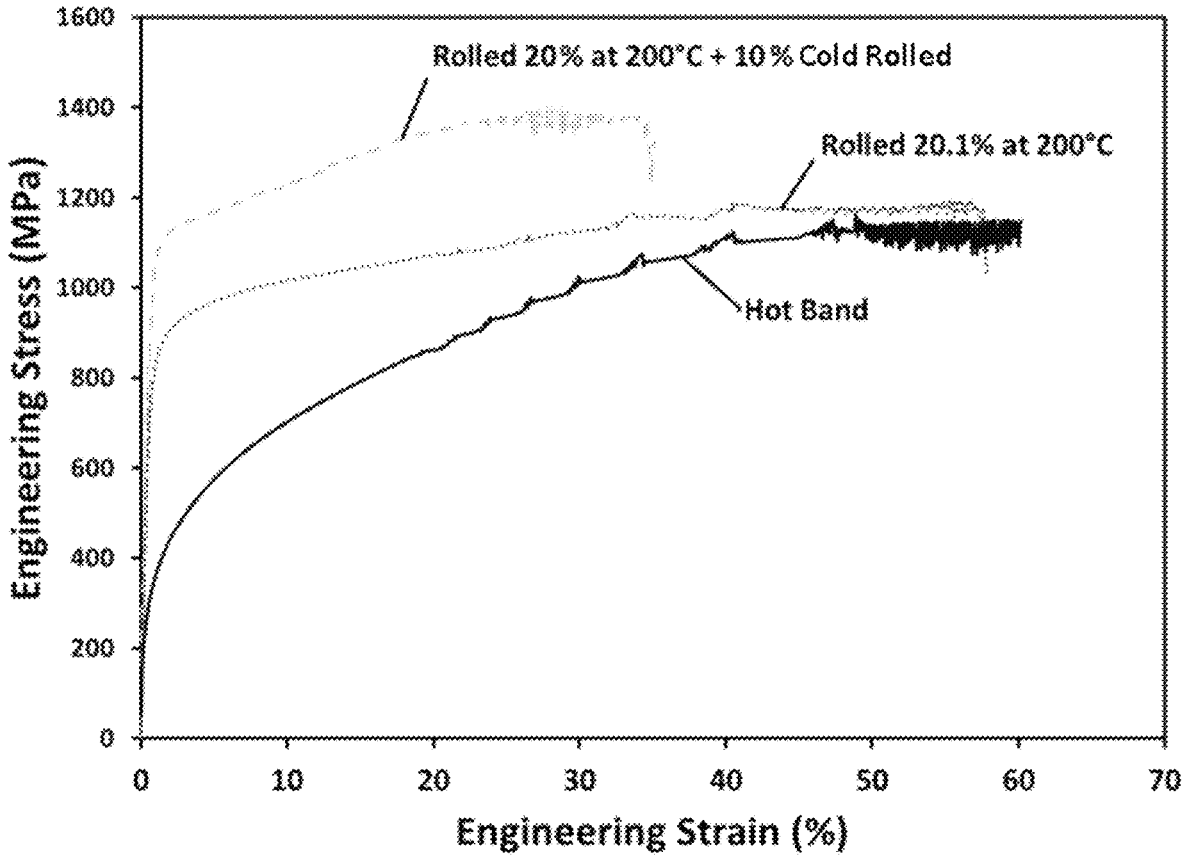
FIG. 35 Comparison of engineering stress-strain curves for Alloy 2 sheet processed by different methods and their combination. (Note specific processing condition variations are listed which include the as-hot rolled condition and either single step or multiple step rolling.)

Representative stress-strain curves with property combination achieved at each processing method close to optimal are shown in FIG. 35. As it can be seen, the yield strength can be significantly increased (i.e. 469 MPa increase) by rolling at 200° C. with minimal change in alloy ultimate tensile strength (i.e. 34 MPa increase) and elongation (i.e. 1.8% decrease). This is provided by the example condition 3a in FIG. 2. For the sample additionally rolled at 10% at ambient temperature from the starting condition of Step 3, then this would satisfy Step 4 in FIG. 3. As can be seen, in this case, this is a route to higher yield strength (i.e. 688 MPa increase) and tensile strength (i.e. 224 MPa increase) but comes with a reduction in total elongation (i.e. 25.1% decrease). Note that satisfying Step 4 in FIG. 3 could also be done by for example by cold stamping the part by various processes whereby the areas in the stamped part would experience higher yield strength and tensile strength with commensurate lower ductility which was used up partially in forming the part.

This Case Example demonstrates an achievement of high yield strength in alloys herein by various methods or their combination which provides a variety of the strength/elongation combinations in the resultant sheet from alloys herein.

Case Example #11 Effect of Test Temperature on Tensile Properties of Alloy 2

Alloy 2 was produced in a sheet form with 1.4 mm thickness from the slab by hot rolling and cold rolling to a targeted thickness with subsequent annealing. Tensile specimens were cut from the Alloy 2 sheet using wire EDM. Tensile properties were measured at different temperatures in a range from −40° C. to 200° C.

Figure 36:
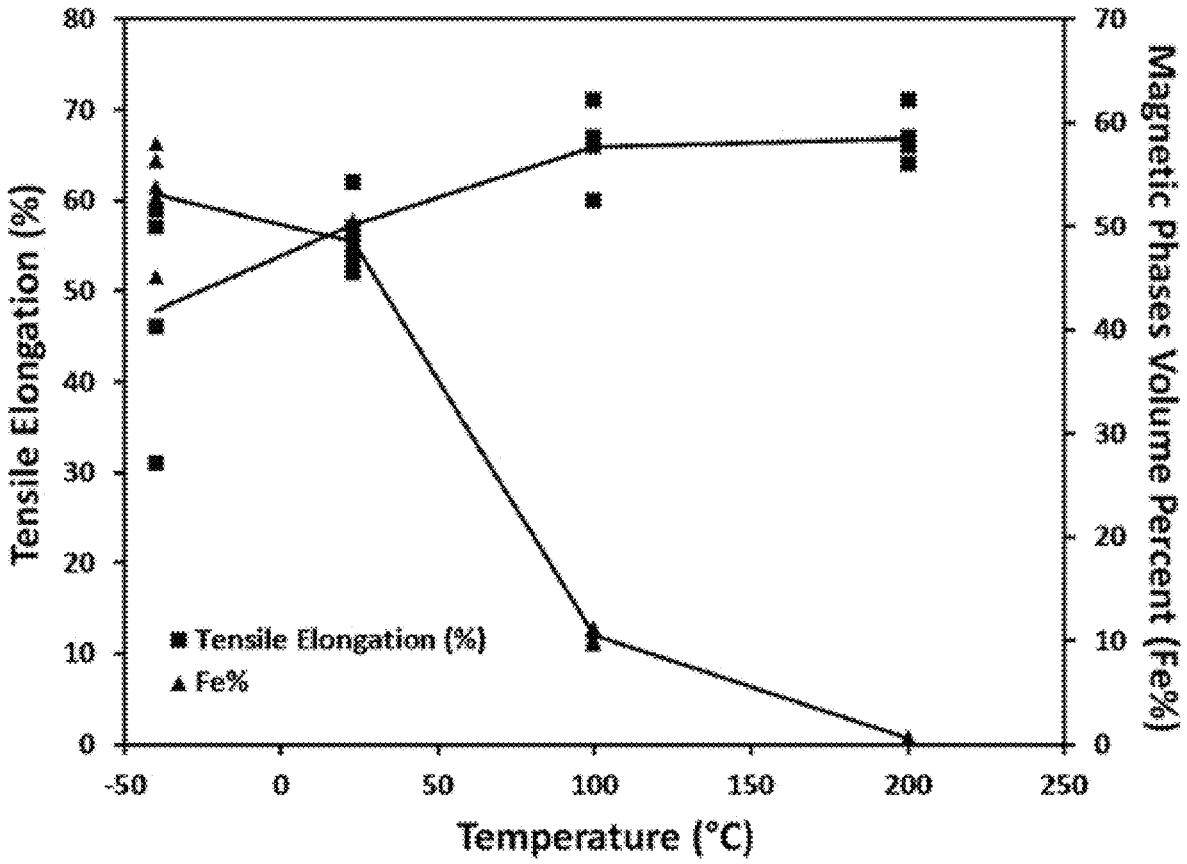
FIG. 36 Tensile elongation and magnetic phases volume percent in a tensile sample gauge after testing of Alloy 2 at different temperatures.

Tensile properties of the Alloy 2 sheet at different temperatures are listed in Table 26. The magnetic phases volume percent was measured in the tensile sample gauge after testing at each temperature using Feritscope that is also listed in Table 26. As it can be seen, yield and ultimate tensile strength are decreasing with increasing test temperature while tensile elongation is increasing. Tensile elongation and magnetic phases volume percent (Fe %) as a function of test temperature are plotted in FIG. 36 showing that despite higher elongation at elevated temperatures, the magnetic phases volume percent in a tensile sample gauge after testing drops significantly and close to zero after testing at 200° C. A decrease in the magnetic phases volume percent in a tensile sample gauge after testing indicates higher austenite stability at elevated temperatures suppressing its transformation to ferrite under the stress.

TABLE 26

Tensile Properties of Alloy 2 Tested at Different Temperatures

| Test Temperature (° C.) | Ultimate Tensile Strength (MPa) | Yield Strength (MPa) | Tensile Elongation (%) | Magnetic Phases Volume Percent (Fe %) |
|---|---|---|---|---|
| | 1240 | 358 | 59 | 56.3 |
| −40 | 1180 | 345 | 46 | 52.7 |
| | 1180 | 340 | 57 | 58.0 |
| | 1190 | 338 | 46 | 53.8 |
| | 1120 | 364 | 31 | 45.1 |
| 23 | 1210 | 370 | 62 | 48.7 |
| | 1220 | 355 | 62 | 49.3 |
| | 1220 | 371 | 57 | 47.0 |
| | 1230 | 362 | 56 | 48.4 |
| | 1210 | 353 | 56 | 50.6 |
| | 1230 | 376 | 56 | 46.6 |
| | 1230 | 369 | 54 | 48.6 |
| | 1200 | 361 | 52 | 49.2 |
| | 1200 | 359 | 56 | 47.9 |
| | 1200 | 364 | 62 | 49.4 |
| 100 | 890 | 329 | 66 | 10.0 |
| | 905 | 333 | 71 | 10.8 |
| | 900 | 332 | 67 | 11.0 |
| | 905 | 342 | 66 | 9.7 |
| | 905 | 334 | 60 | 11.1 |
| 200 | 685 | 226 | 67 | 0.5 |
| | 690 | 230 | 66 | 0.6 |
| | 695 | 224 | 71 | 0.6 |
| | 695 | 217 | 64 | 0.7 |
| | 710 | 228 | 66 | 0.6 |

This Case Example demonstrates that multicomponent alloying of the alloys herein resulted in significant increase of austenite stability and transformation to ferrite during rolling is shown to be suppressed at elevated temperatures as compared to cold rolling as clearly provided in the last column in Table 26. It provides higher ductility during rolling itself and higher formability at subsequent sheet forming operations such as stamping, drawing, etc.

Case Example #12 Reduction in Processing Steps Towards Targeted Gauge

Alloy 2 was processed into a hot band with thickness of 4.4 mm. Two sections of the hot band were then rolled, one at ambient temperature and one at 200° C. The plate at 200° C. was heated in a mechanical convection oven for 30 minutes prior to rolling and reheated for 10 minutes between passes to ensure constant temperature.

In a case of rolling at ambient temperature, the failure occurred at approximately 42% reduction while a reduction of more than 70% was applied during rolling at 200° C. without the failure when the limit of the mill achieved. Mill limitations occurred when the Fenn Model 061 rolling mill could no longer make significant reductions per pass during cold rolling while the material still has ability for further rolling reduction.

Figure 37:
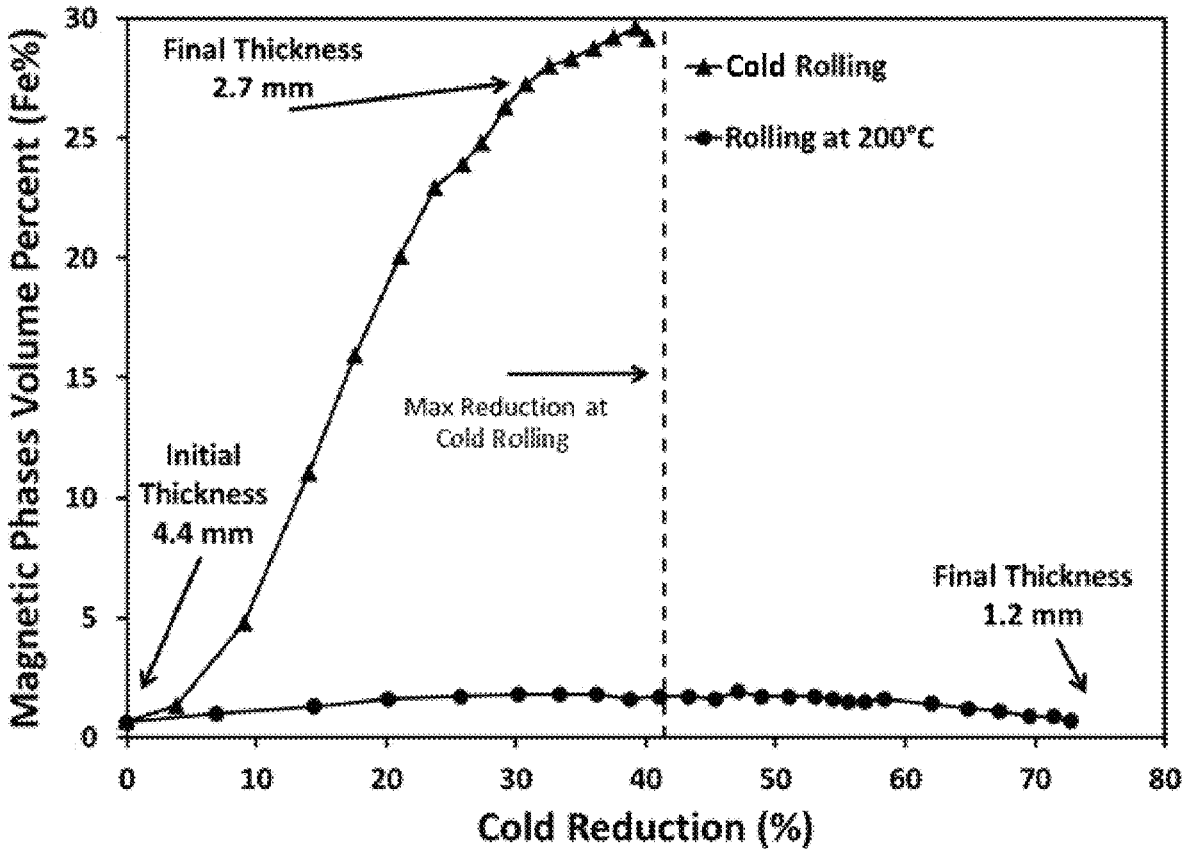
FIG. 37 Magnetic phases volume percent as a function of rolling reduction at ambient temperature and at 200° C.

The magnetic phases volume percent (Fe %) was measured by Feritscope at different levels of reductions during cold rolling and rolling at 200° C. The data are shown in FIG. 37. As it can be seen, the magnetic phases volume percent (Fe %) increases rapidly with reduction at ambient temperature leading to the material limit for rolling at ~42%. In a case of the rolling at 200° C., the magnetic phases volume percent (Fe %) remains under 3 Fe % even at maximum rolling reduction of >70%.

A sheet from Alloy 2 with final thickness of 1.2 mm was produced by utilizing both cold rolling and rolling at 200° C. In a case of cold rolling, the rolling was cycled with intermediate annealing to restore the alloy ductility and achieve the targeted thickness with reduction of 29% at final rolling step. Tensile samples were EDM cut from the sheet with 1.2 mm thickness produced by both rolling methods and annealed at 1000° C. for 135 sec. Tensile properties were measured on an Instron mechanical testing frame (Model 3369), utilizing Instron's Bluehill control and analysis software. All tests were run at ambient temperature in displacement control with the bottom fixture held rigid and the top fixture moving; the load cell is attached to the top fixture.

Figure 38:
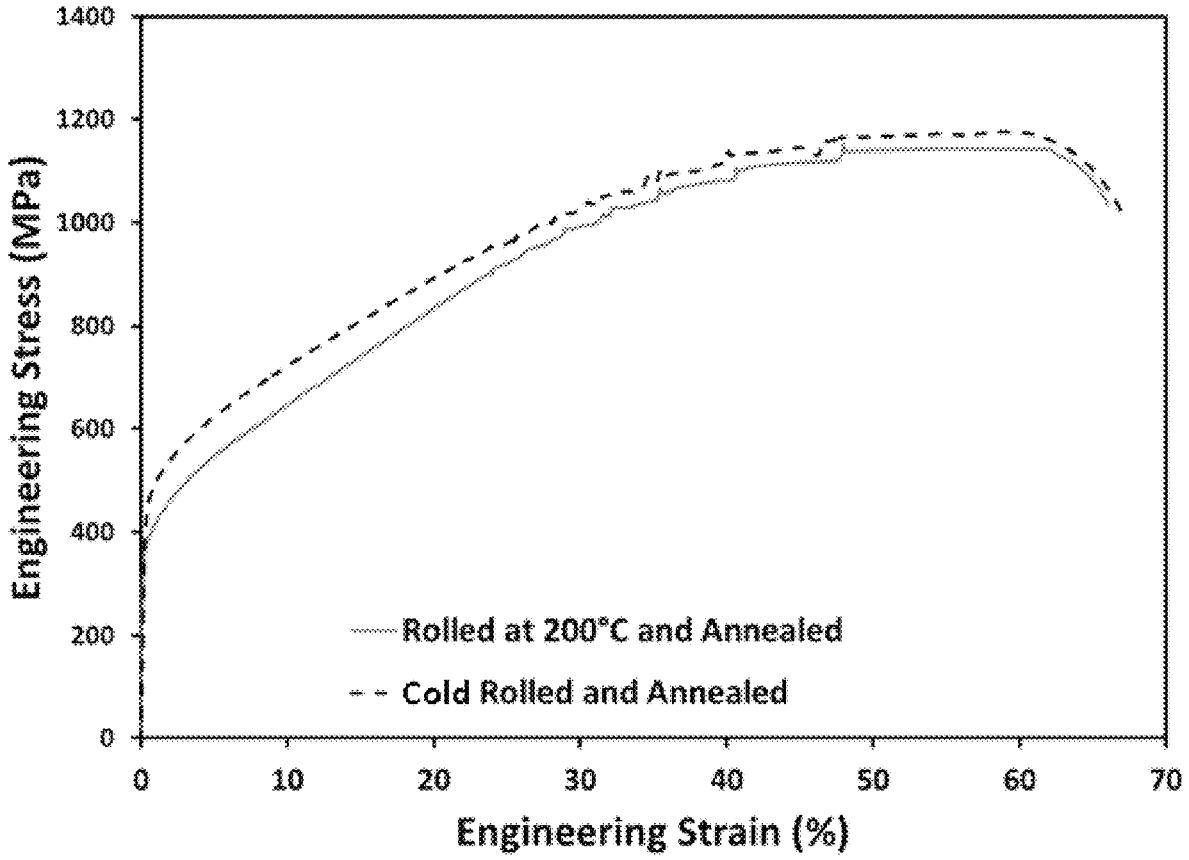
FIG. 38 Examples of engineering stress-strain curves for the annealed sheet produced by both cold rolling and rolling at 200° C.

Examples of the engineering stress-strain curves for the annealed sheet produced by both cold rolling and rolling at 200° C. are shown in FIG. 38. As it can be seen, despite different rolling methods towards targeted thickness, the final properties of the sheet after annealing are similar.

This Case Example demonstrates that rolling where the austenite is stable and does not transfer to ferrite as demonstrated here for Alloy 2 at 200° C. significantly improves rolling ability of the alloys herein that will allow reduction in processing steps towards targeted sheet gauges. Thus, this elevated temperature rolling can be used to hit a near final targeted gauge with high cold rolling reduction as provided in this example of >70%. This near final gauge material can then be annealed to restore the starting properties (i.e. the initial condition). Subsequently, the final targeted gauge can be obtained by rolling in the temperature range provided in this application from 150 to 400° C. following the steps and procedures in FIG. 2 or FIG. 3.

Case Example #13 Change in Limiting Rolling Reduction

Figure 39:
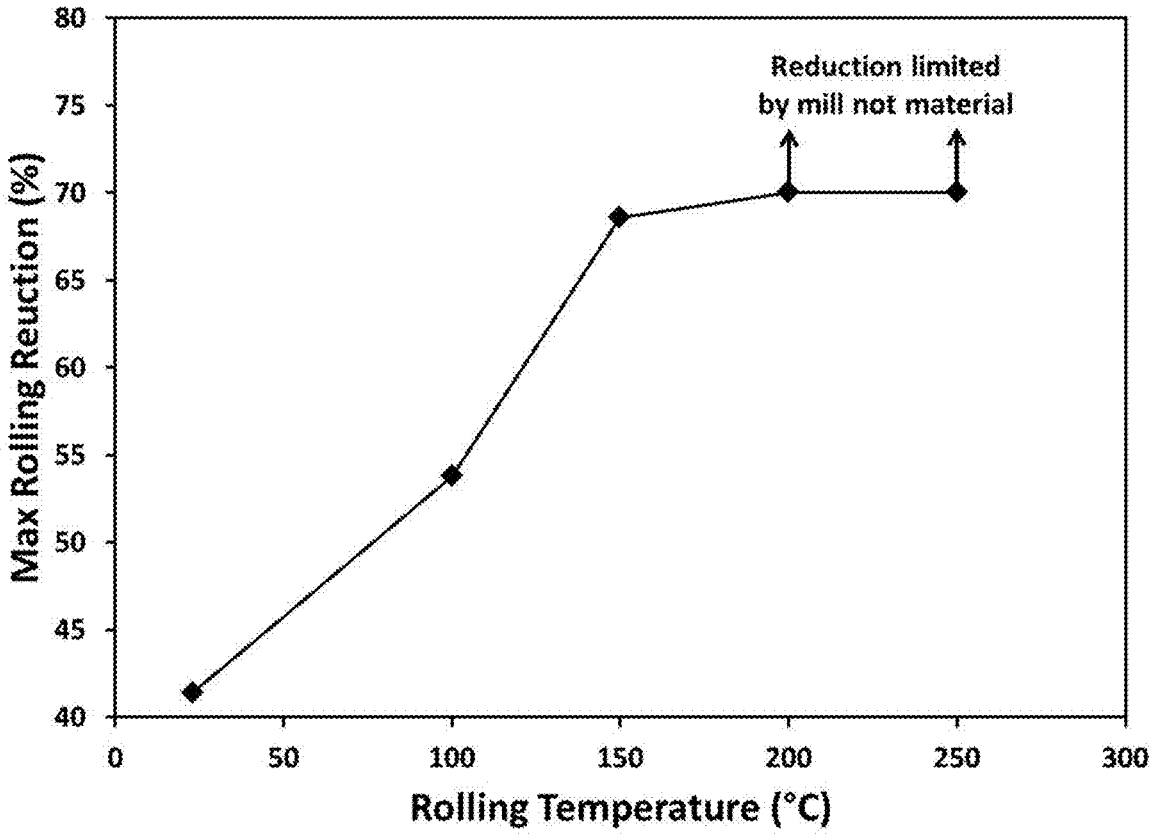
FIG. 39 Rolling reduction limit vs rolling temperature for Alloy 2.
Figure 40:
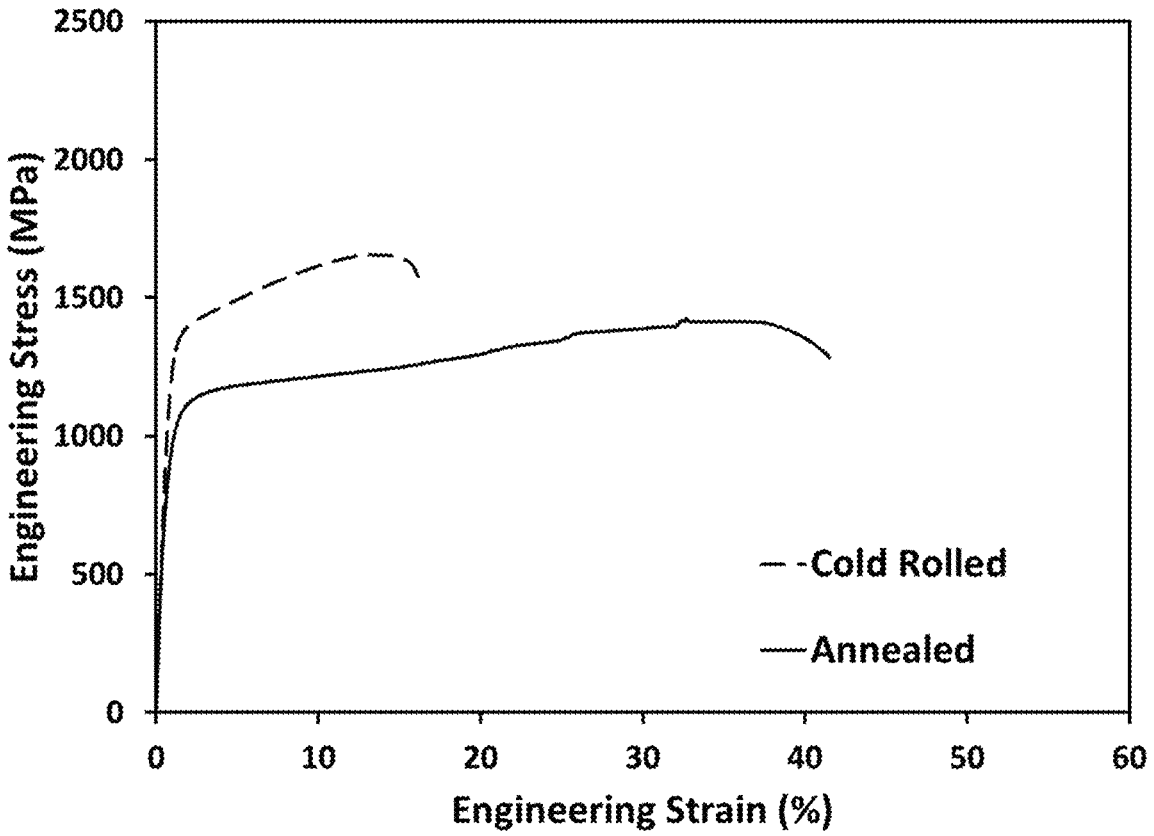
FIG. 40 Representative uniaxial tensile stress-strain curves for Alloy 1 in the cold rolled state and after annealing.
Figure 41:
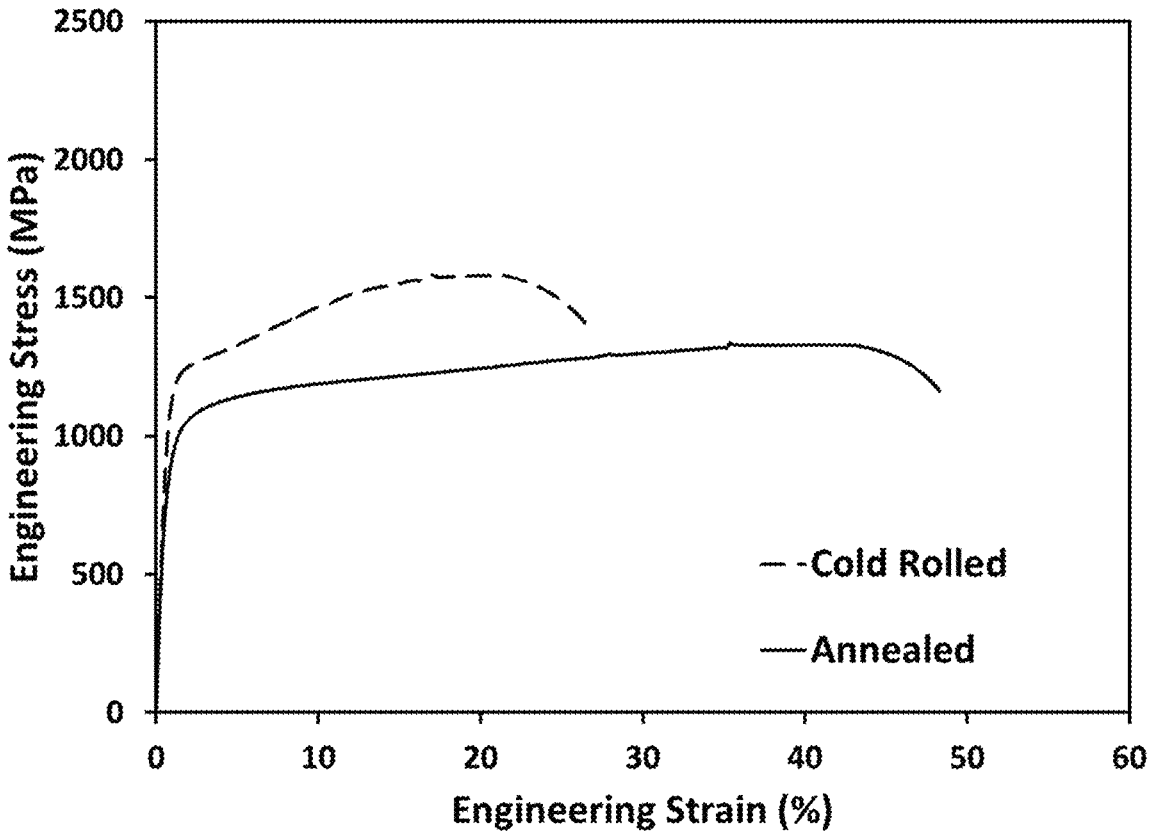
FIG. 41 Representative uniaxial tensile stress-strain curves for Alloy 2 in the cold rolled state and after annealing.
Figure 42:
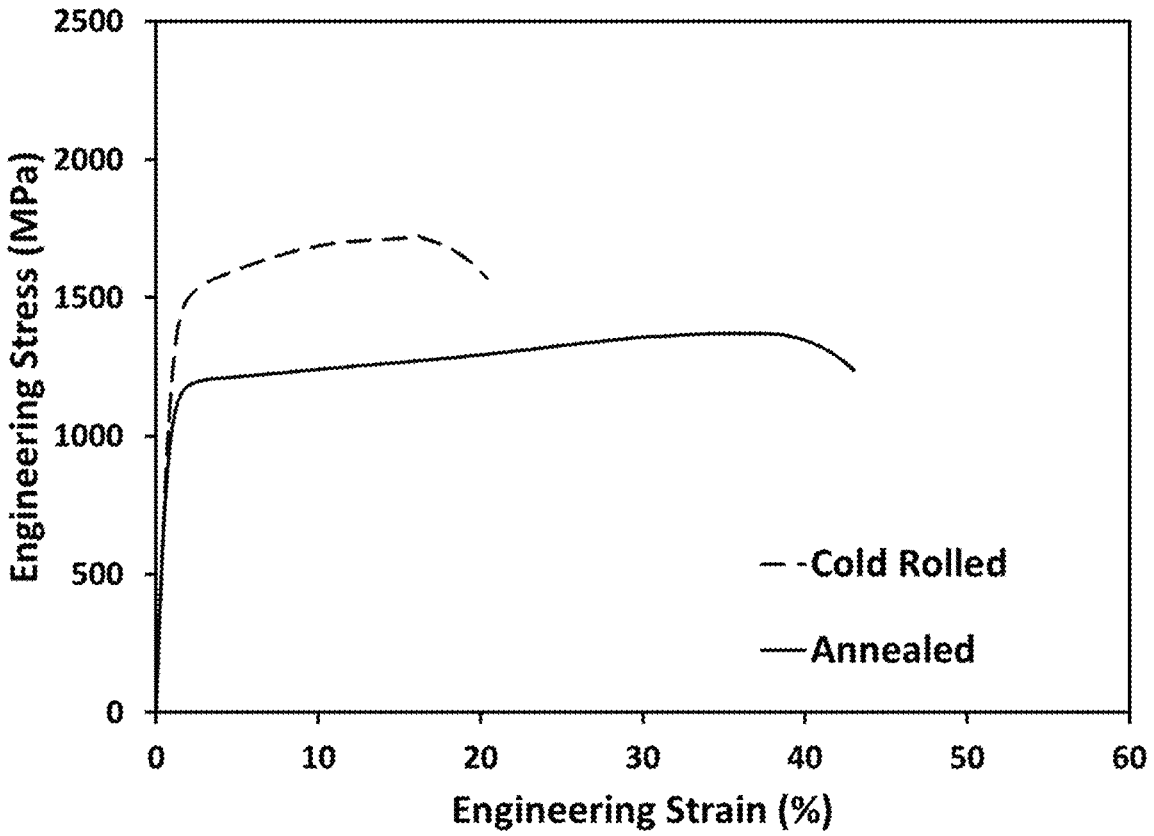
FIG. 42 Representative uniaxial tensile stress-strain curves for Alloy 10 in the cold rolled state and after annealing.
Figure 43:
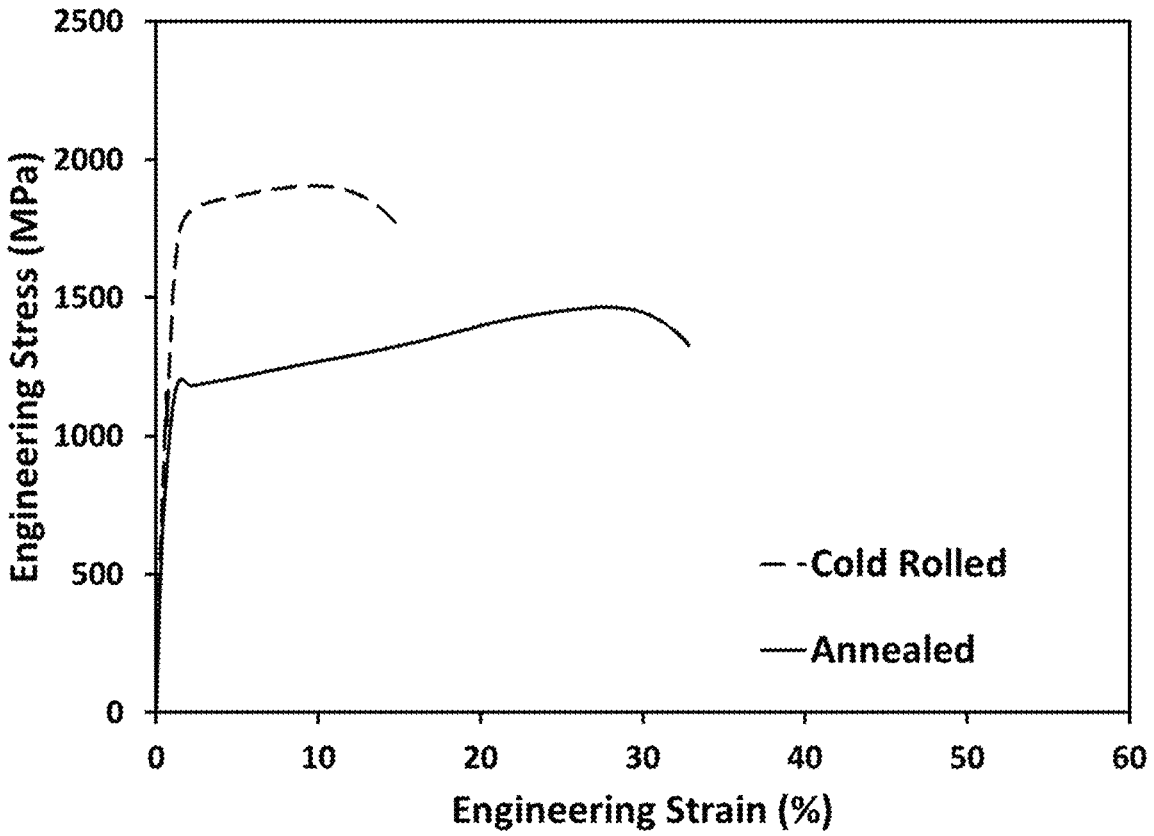
FIG. 43 Representative uniaxial tensile stress-strain curves for Alloy 11 in the cold rolled state and after annealing.
Figure 44:
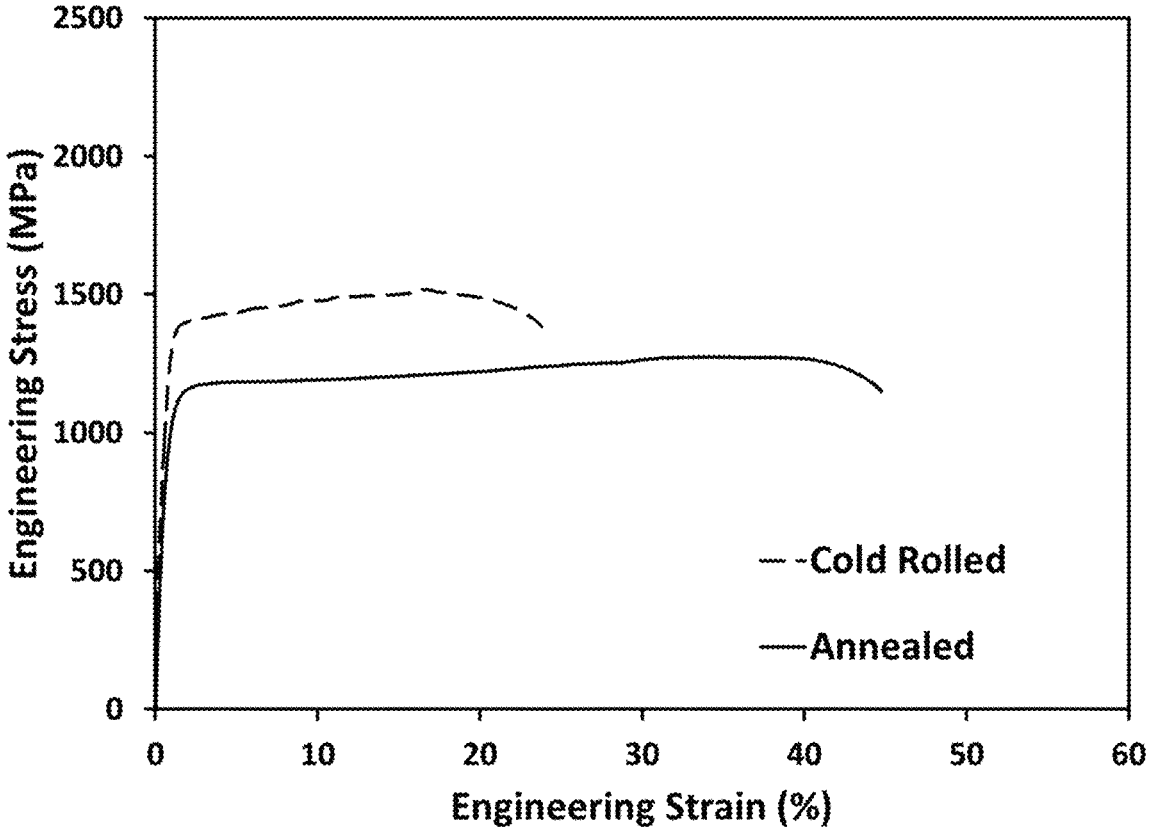
FIG. 44 Representative uniaxial tensile stress-strain curves for Alloy 13 in the cold rolled state and after annealing.
Figure 45:
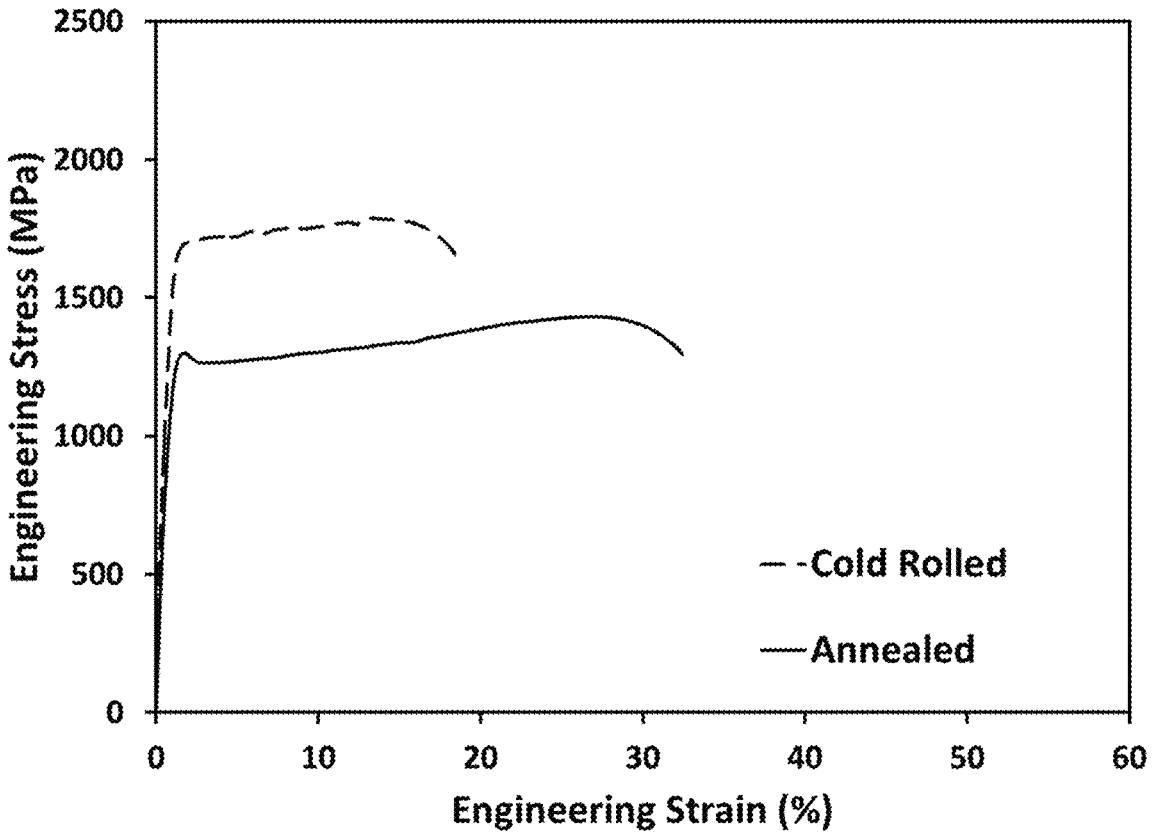
FIG. 45 Representative uniaxial tensile stress-strain curves for Alloy 14 in the cold rolled state and after annealing.
Figure 46:
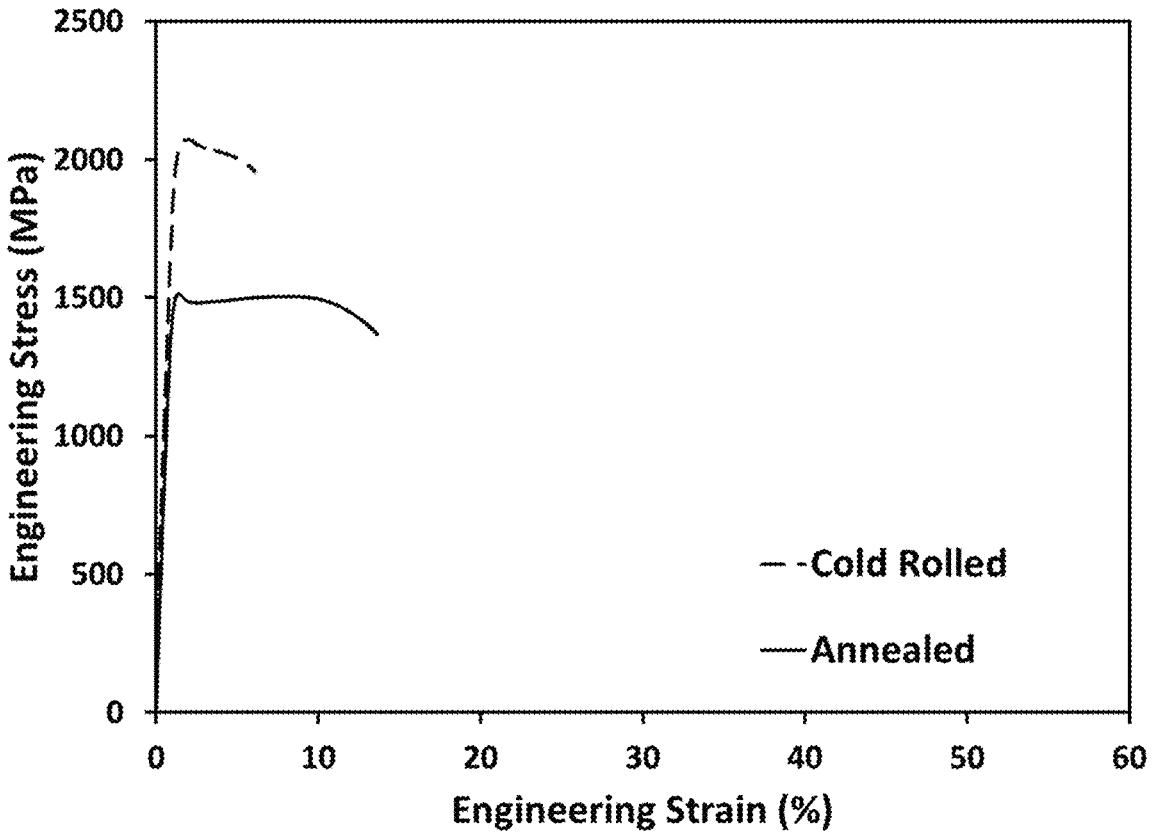
FIG. 46 Representative uniaxial tensile stress-strain curves for Alloy 15 in the cold rolled state and after annealing.
Figure 47:
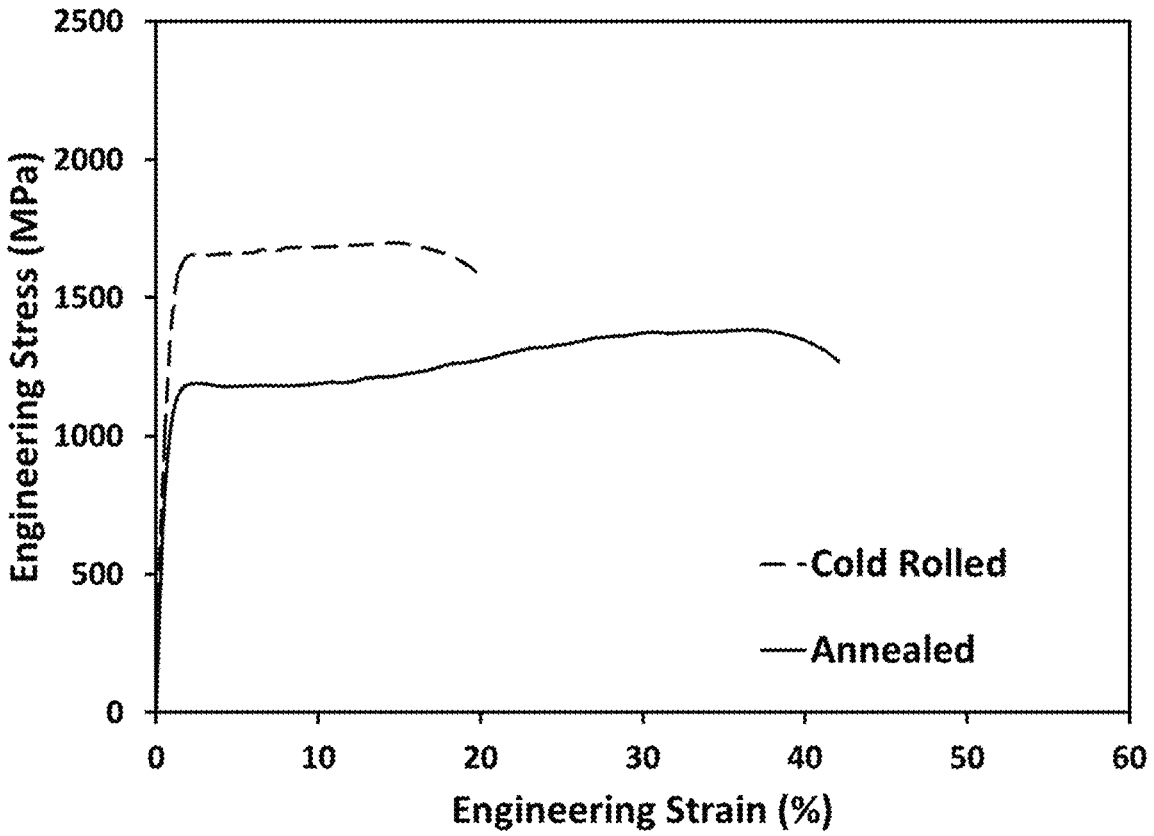
FIG. 47 Representative uniaxial tensile stress-strain curves for Alloy 16 in the cold rolled state and after annealing.
Figure 48:
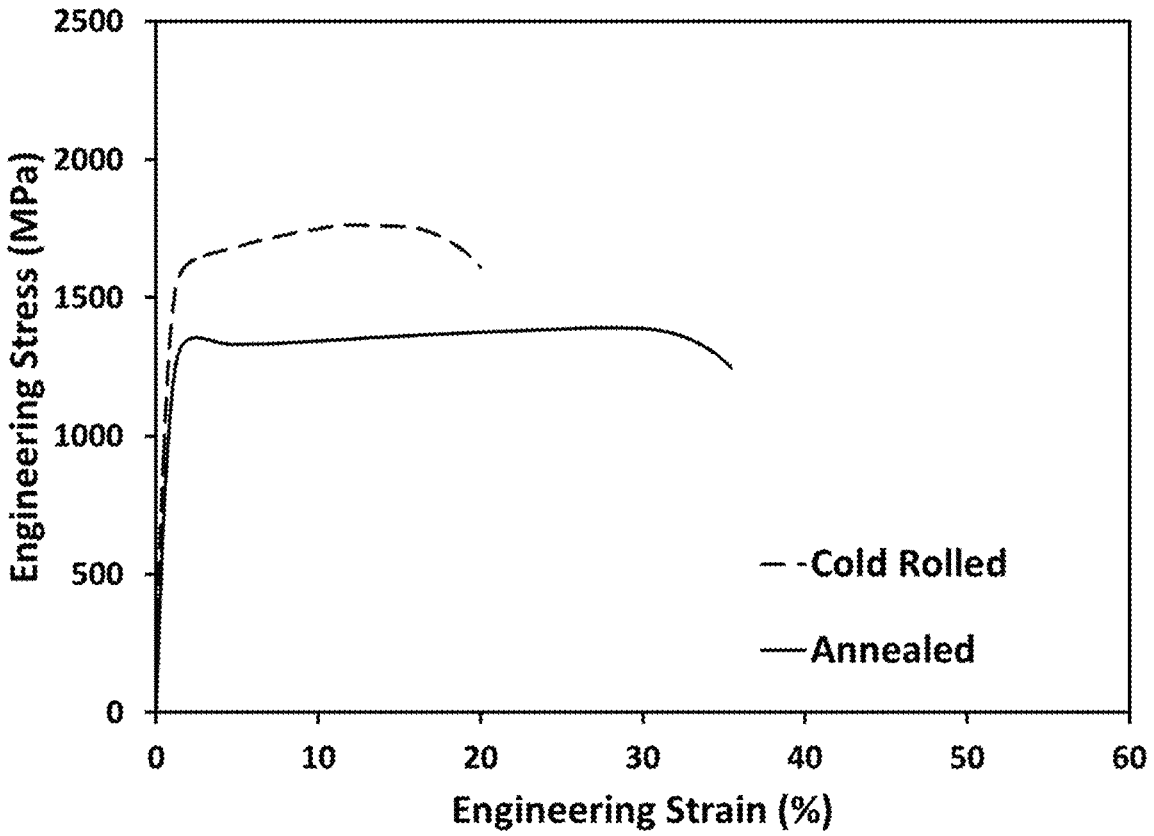
FIG. 48 Representative uniaxial tensile stress-strain curves for Alloy 17 in the cold rolled state and after annealing.
Figure 49:
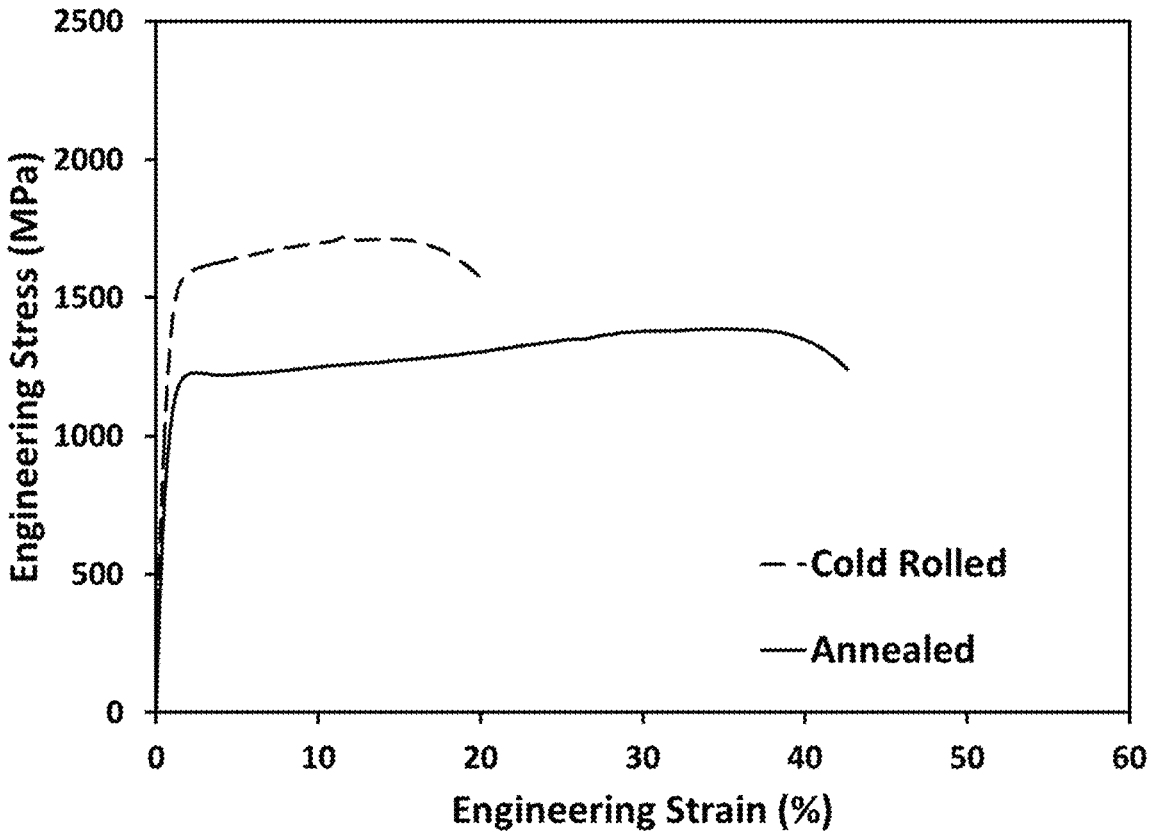
FIG. 49 Representative uniaxial tensile stress-strain curves for Alloy 18 in the cold rolled state and after annealing.
Figure 50:
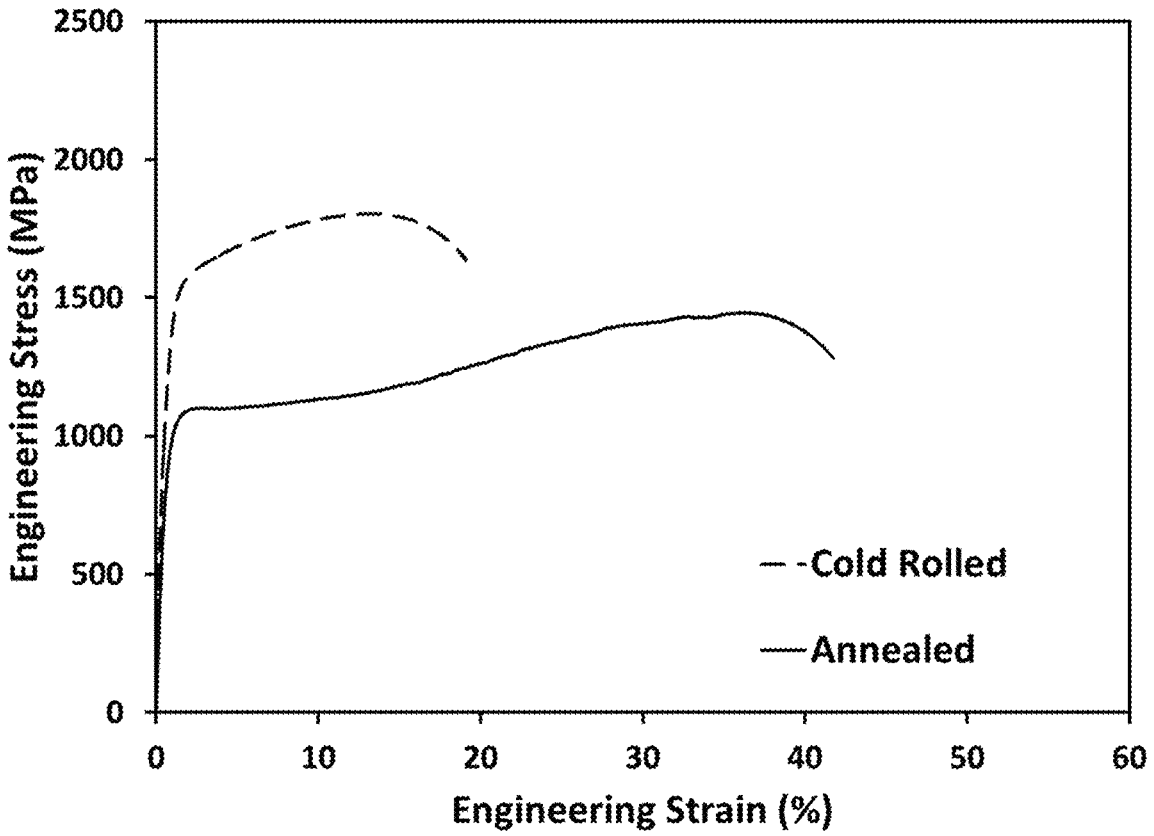
FIG. 50 Representative uniaxial tensile stress-strain curves for Alloy 19 in the cold rolled state and after annealing.
Figure 51:
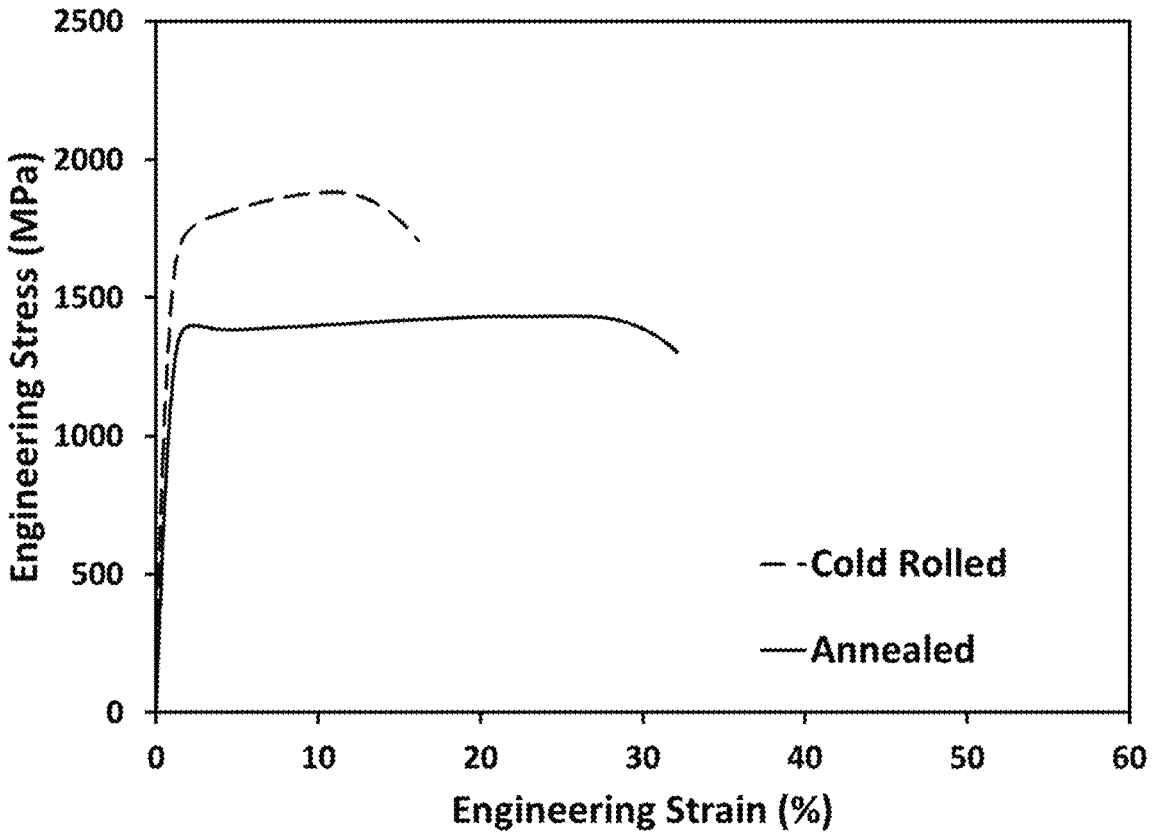
FIG. 51 Representative uniaxial tensile stress-strain curves for Alloy 20 in the cold rolled state and after annealing.
Figure 52:
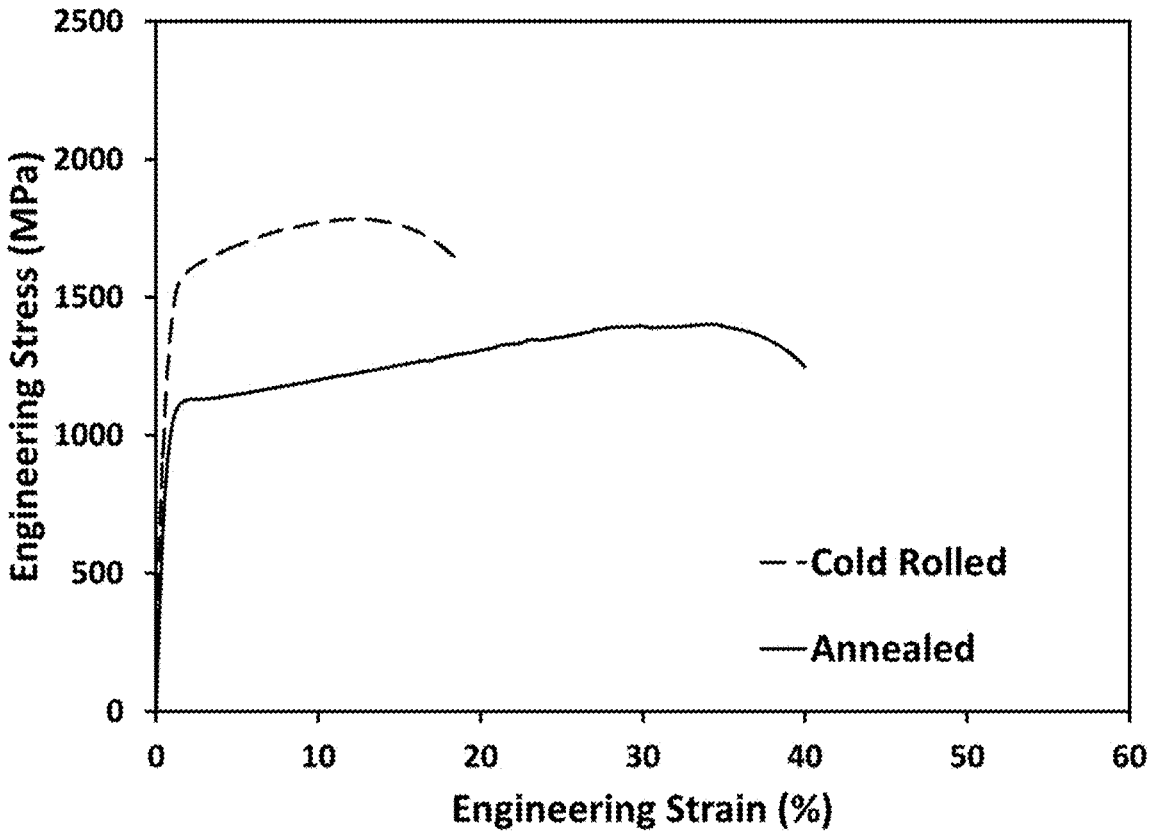
FIG. 52 Representative uniaxial tensile stress-strain curves for Alloy 21 in the cold rolled state and after annealing.
Figure 53:
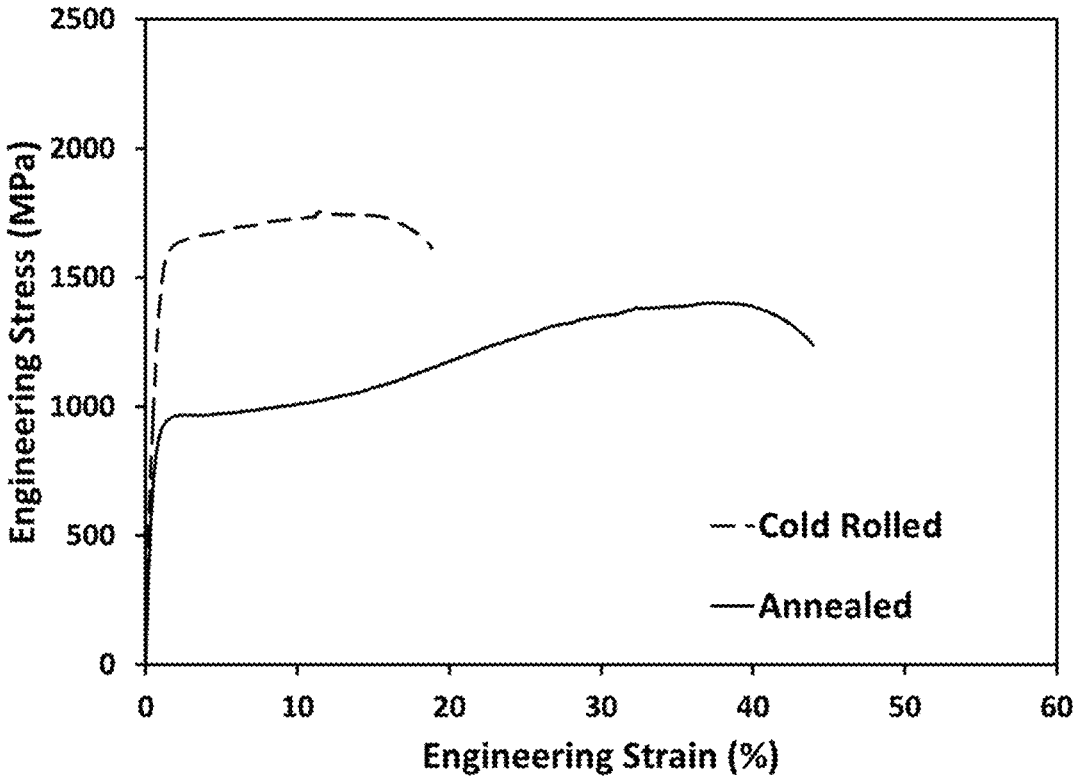
FIG. 53 Representative uniaxial tensile stress-strain curves for Alloy 22 in the cold rolled state and after annealing.
Figure 54:
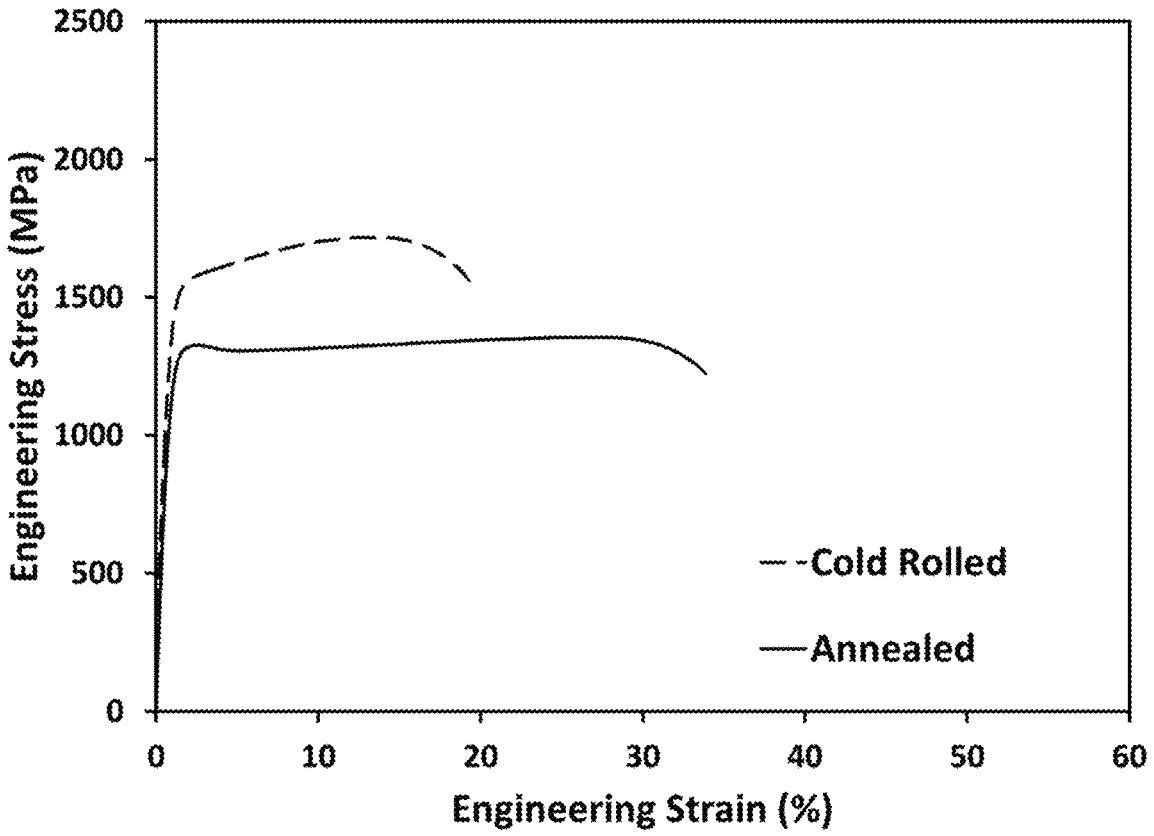
FIG. 54 Representative uniaxial tensile stress-strain curves for Alloy 23 in the cold rolled state and after annealing.
Figure 55:
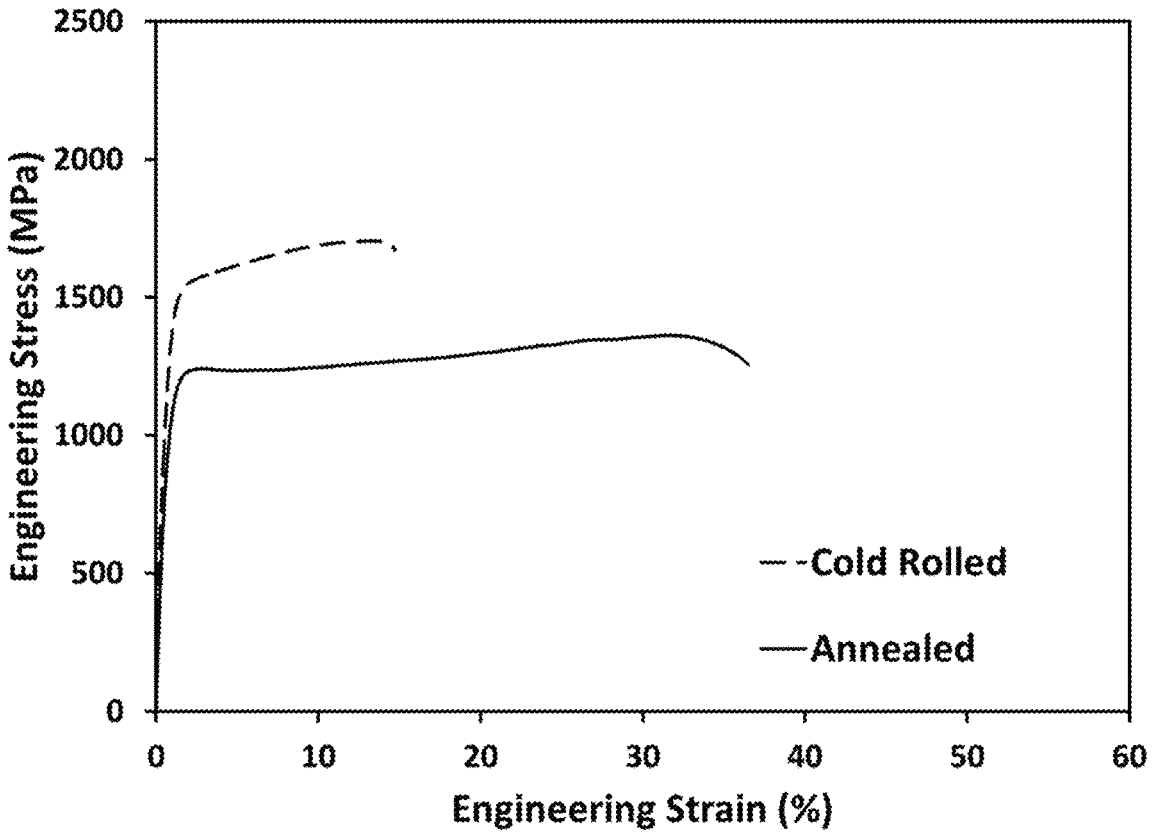
FIG. 55 Representative uniaxial tensile stress-strain curves for Alloy 24 in the cold rolled state and after annealing.
Figure 56:
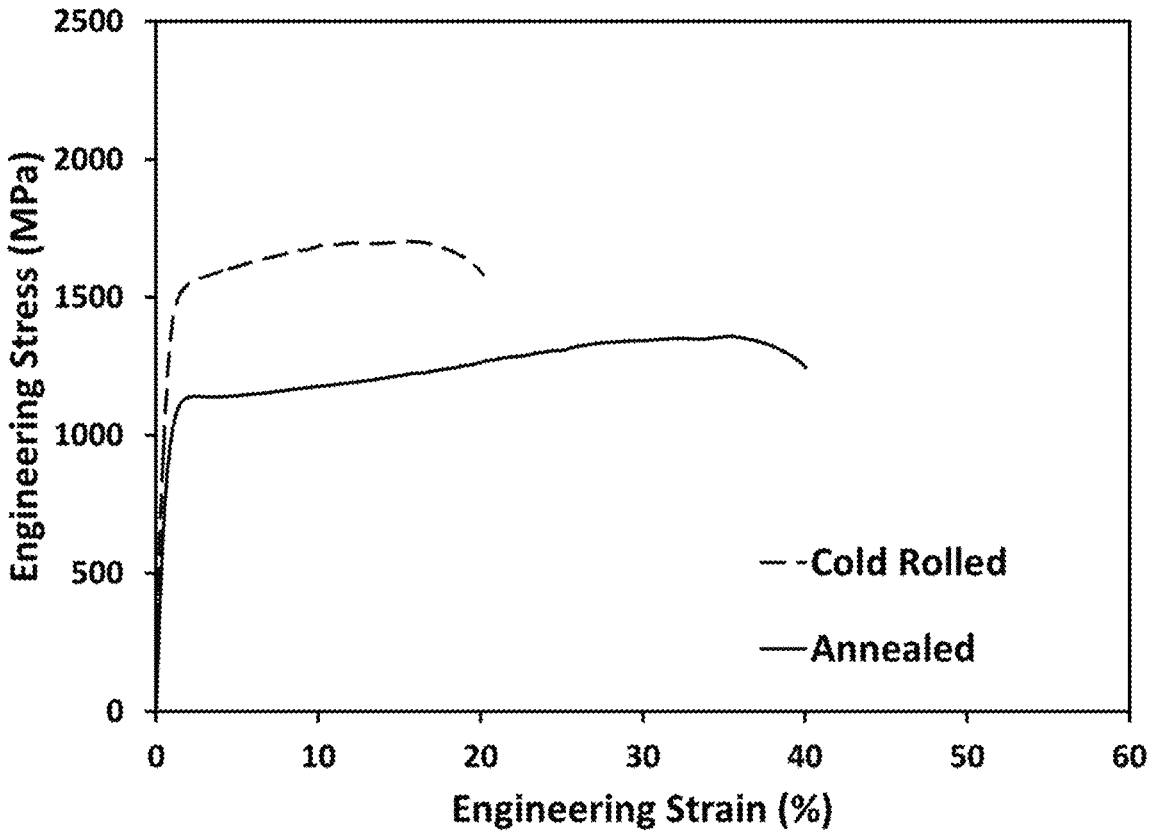
FIG. 56 Representative uniaxial tensile stress-strain curves for Alloy 25 in the cold rolled state and after annealing.
Figure 57:
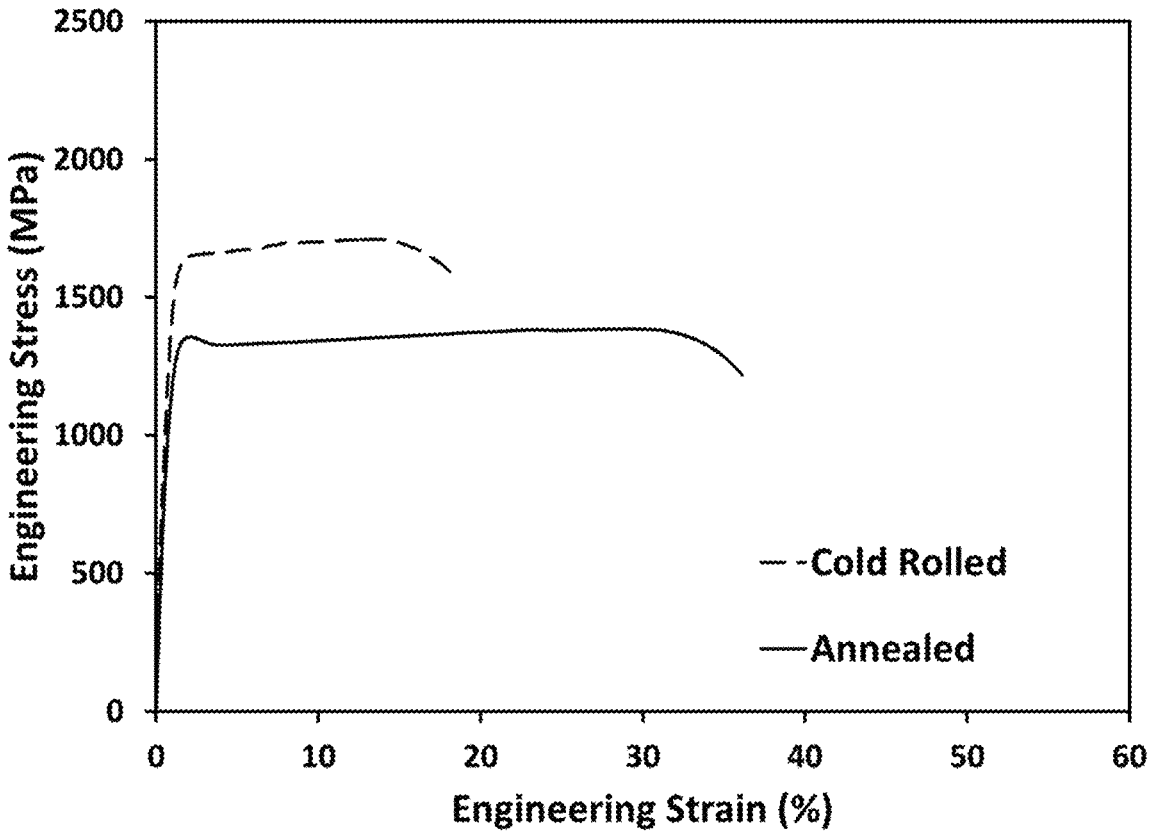
FIG. 57 Representative uniaxial tensile stress-strain curves for Alloy 29 in the cold rolled state and after annealing.
Figure 58:
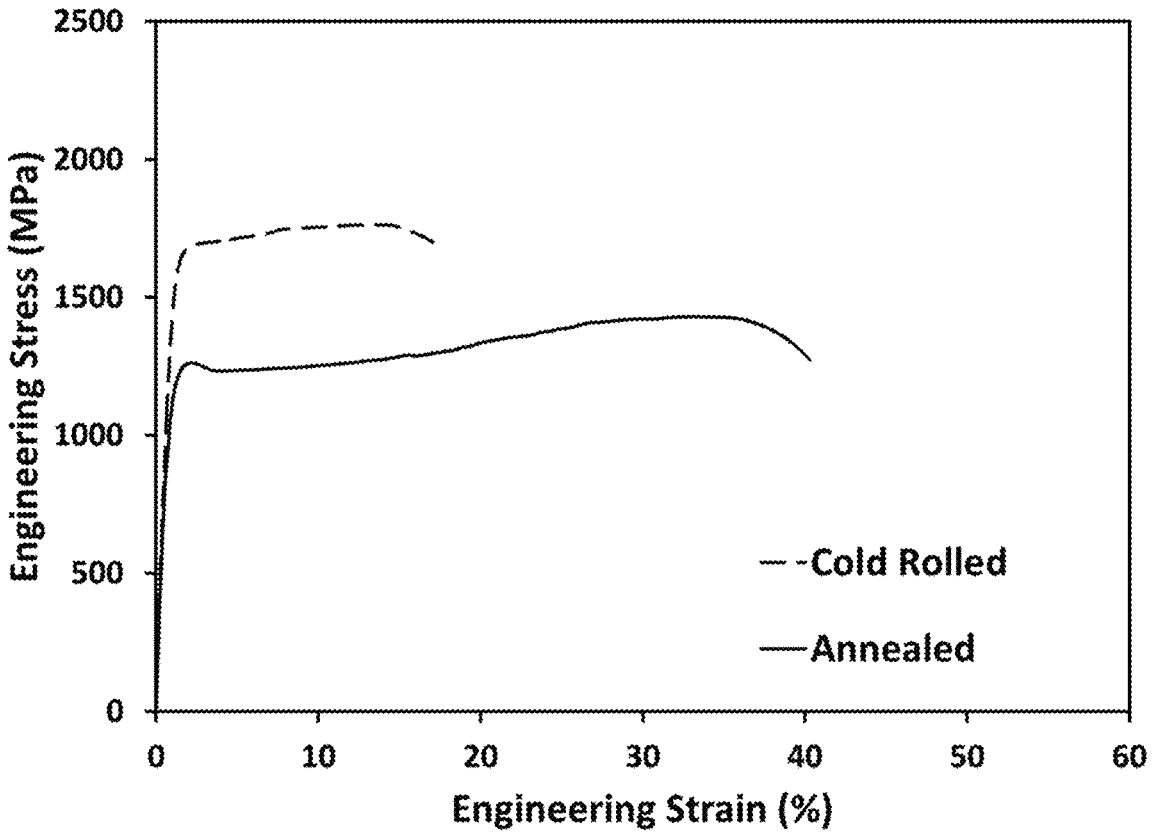
FIG. 58 Representative uniaxial tensile stress-strain curves for Alloy 30 in the cold rolled state and after annealing.
Figure 59:
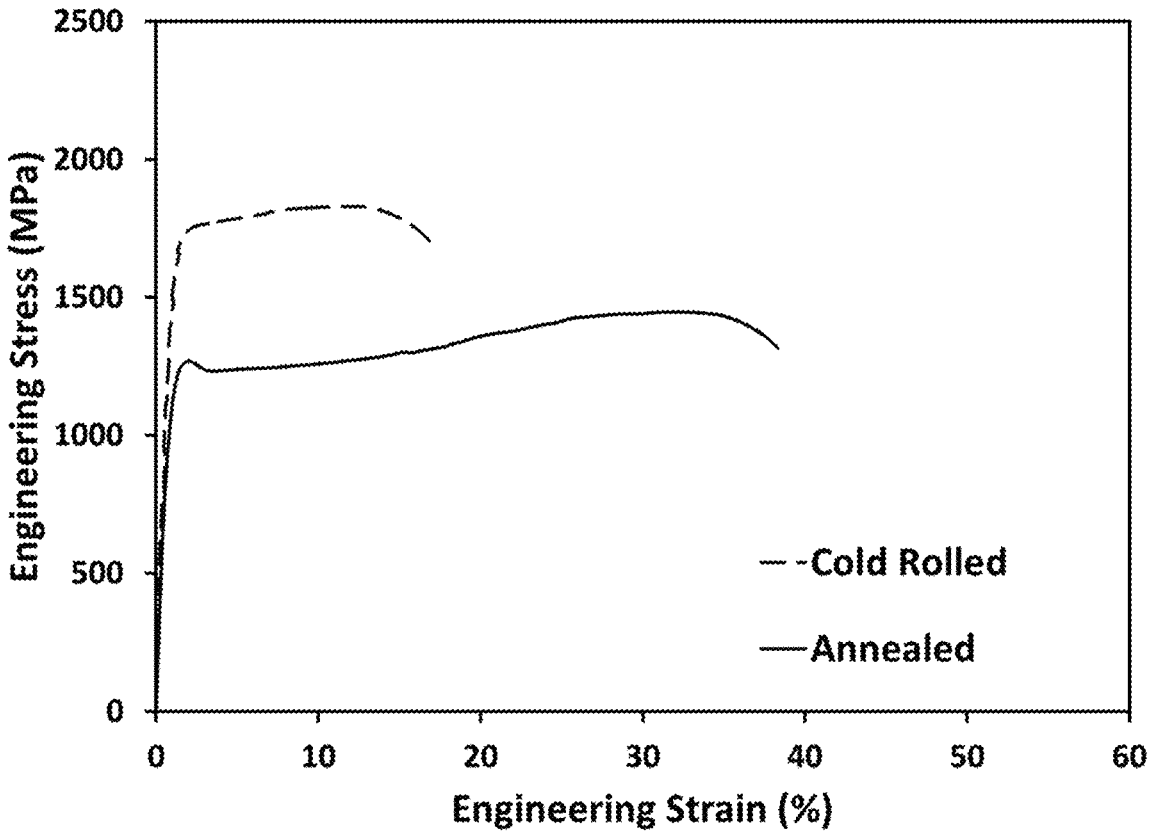
FIG. 59 Representative uniaxial tensile stress-strain curves for Alloy 31 in the cold rolled state and after annealing.
Figure 60:
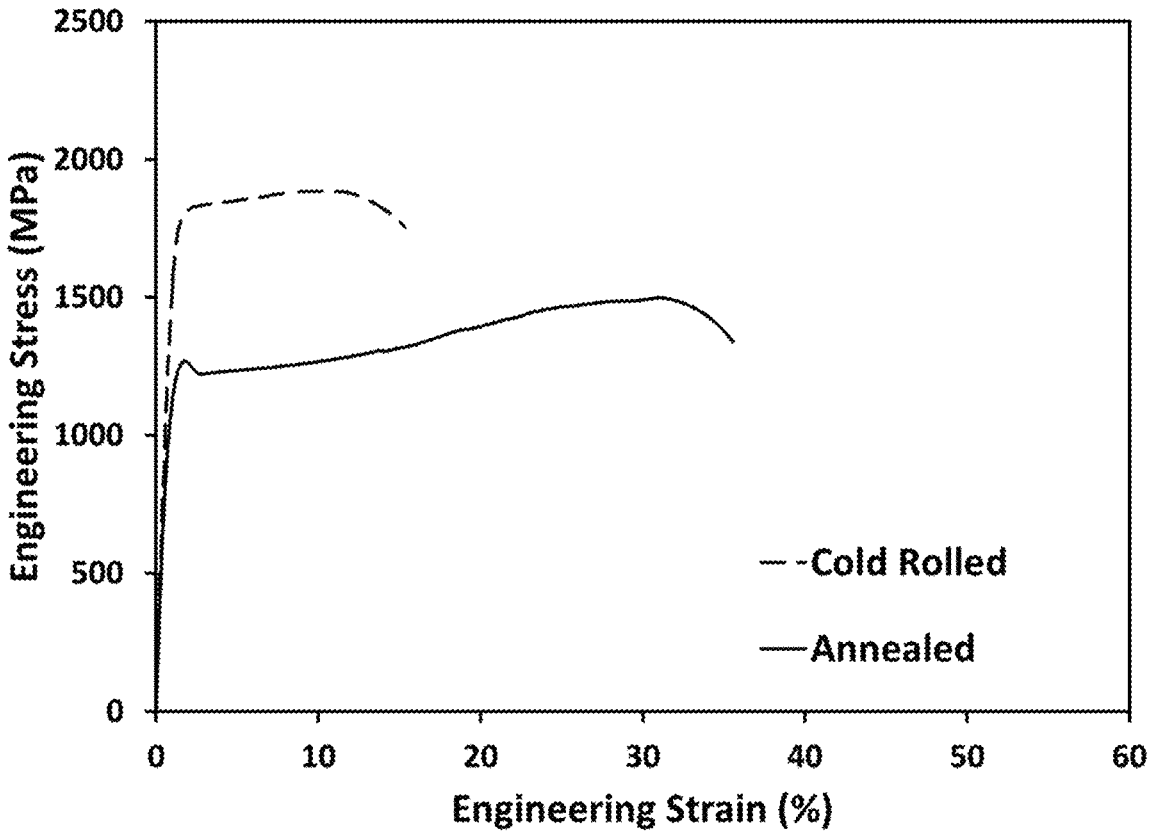
FIG. 60 Representative uniaxial tensile stress-strain curves for Alloy 32 in the cold rolled state and after annealing.
Figure 61:
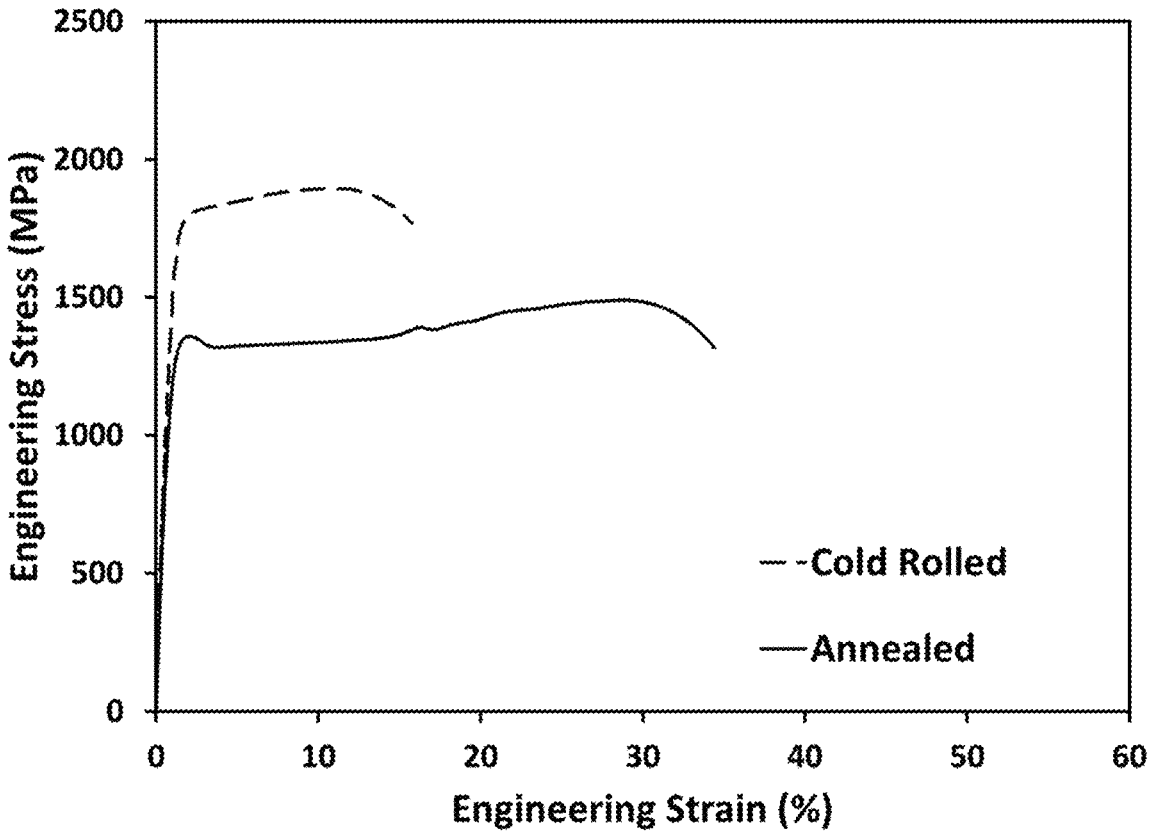
FIG. 61 Representative uniaxial tensile stress-strain curves for Alloy 33 in the cold rolled state and after annealing.
Figure 62:
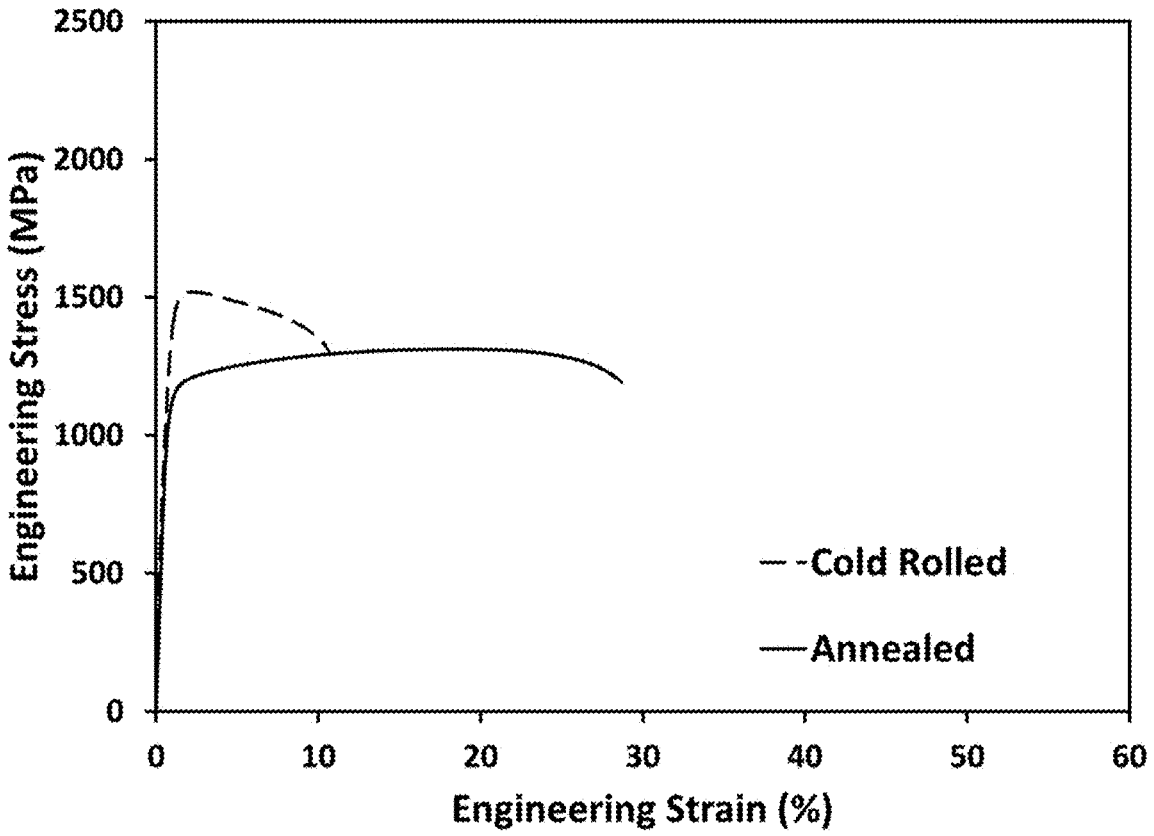
FIG. 62 Representative uniaxial tensile stress-strain curves for Alloy 34 in the cold rolled state and after annealing.
Figure 63:
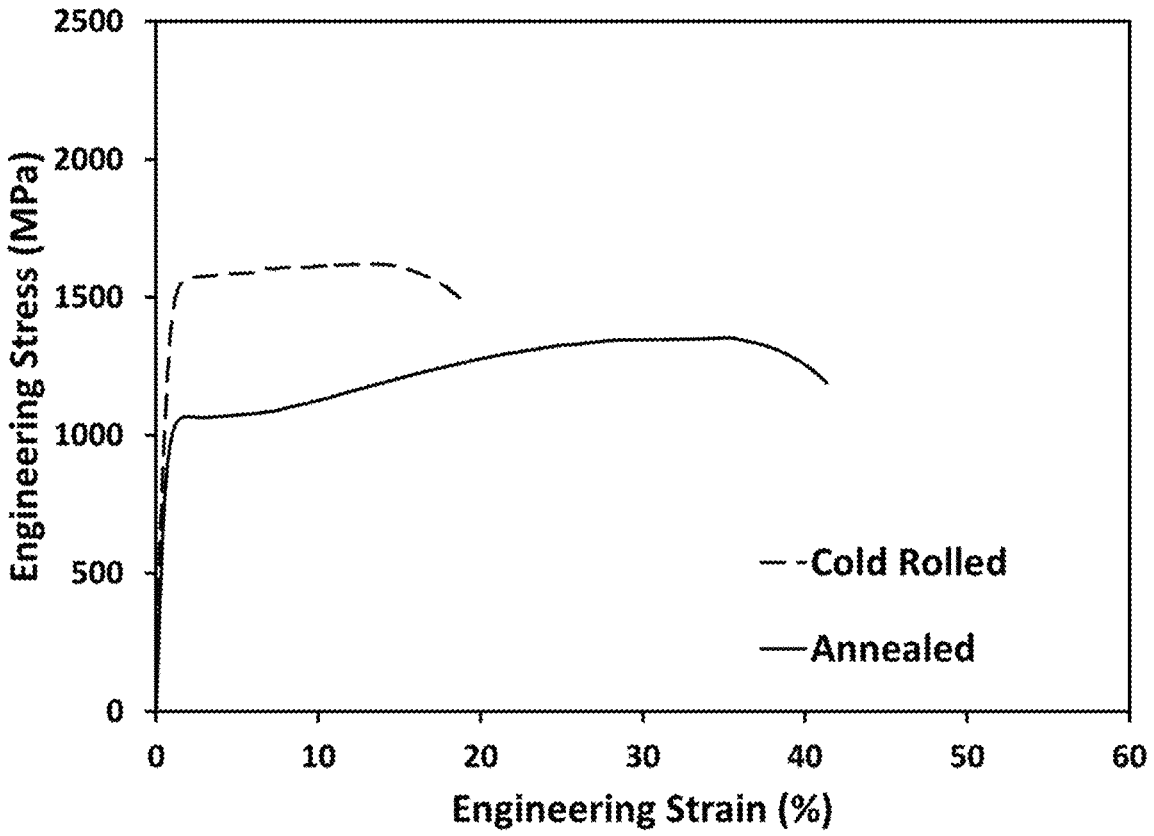
FIG. 63 Representative uniaxial tensile stress-strain curves for Alloy 36 in the cold rolled state and after annealing.
Figure 64:
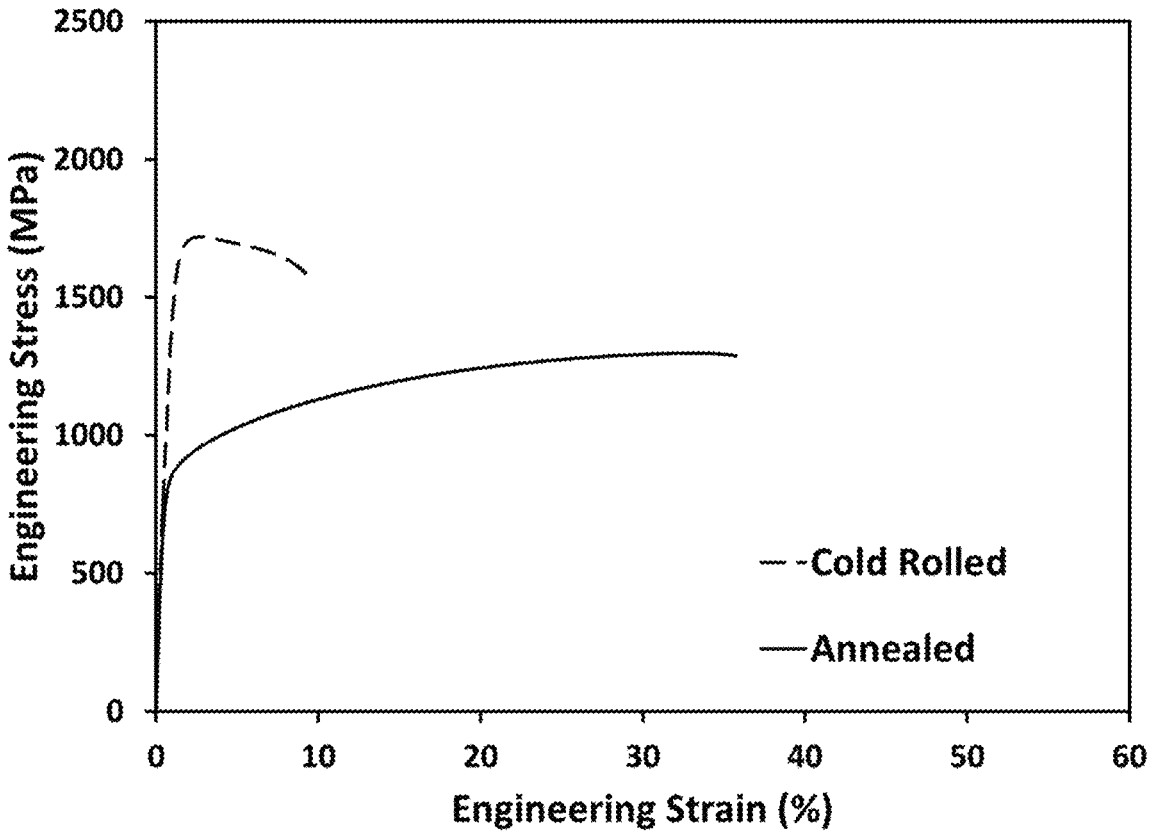
FIG. 64 Representative uniaxial tensile stress-strain curves for Alloy 38 in the cold rolled state and after annealing.
Figure 65:
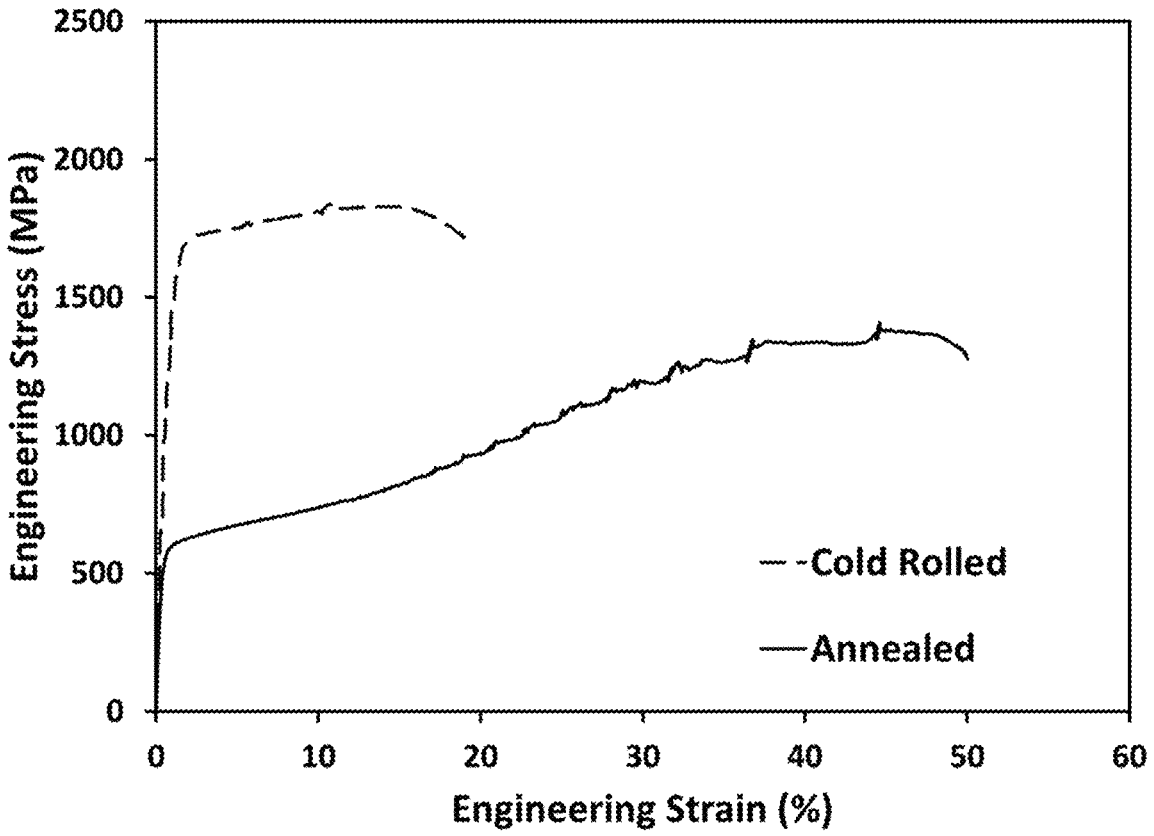
FIG. 65 Representative uniaxial tensile stress-strain curves for Alloy 39 in the cold rolled state and after annealing.
Figure 66:
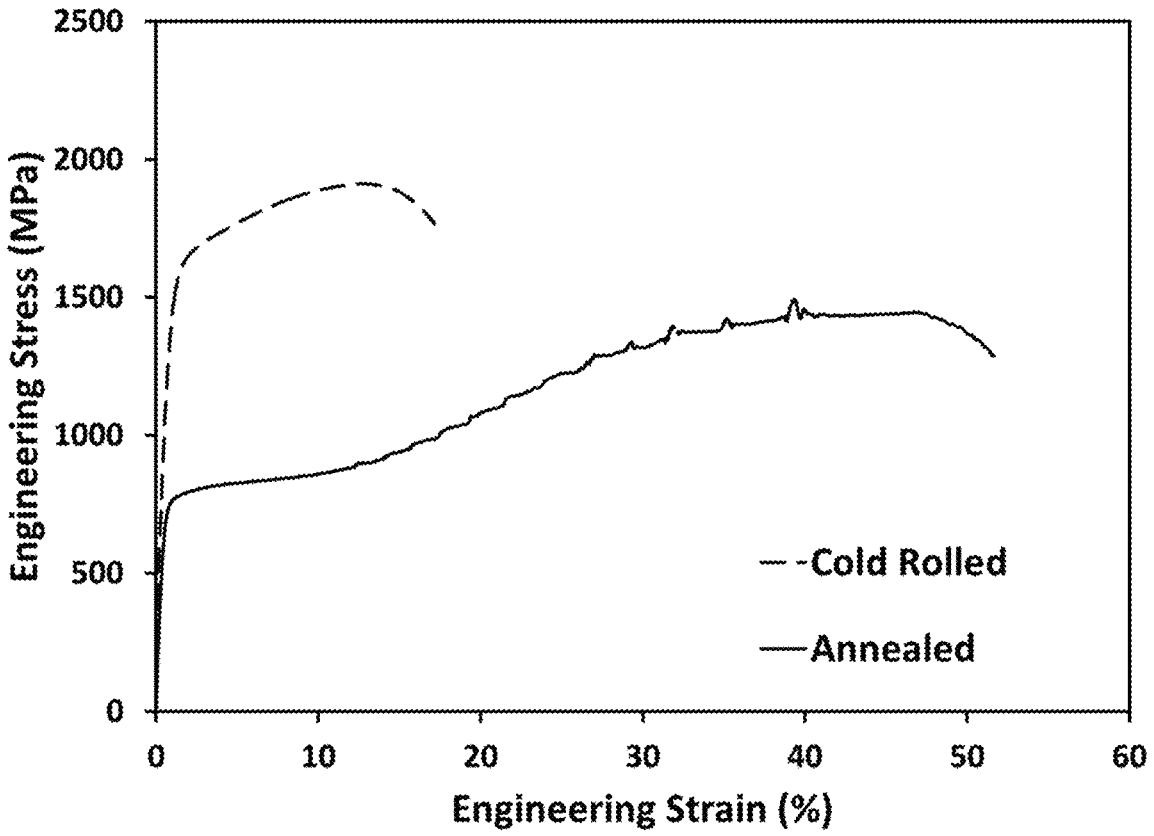
FIG. 66 Representative uniaxial tensile stress-strain curves for Alloy 40 in the cold rolled state and after annealing.
Figure 67:
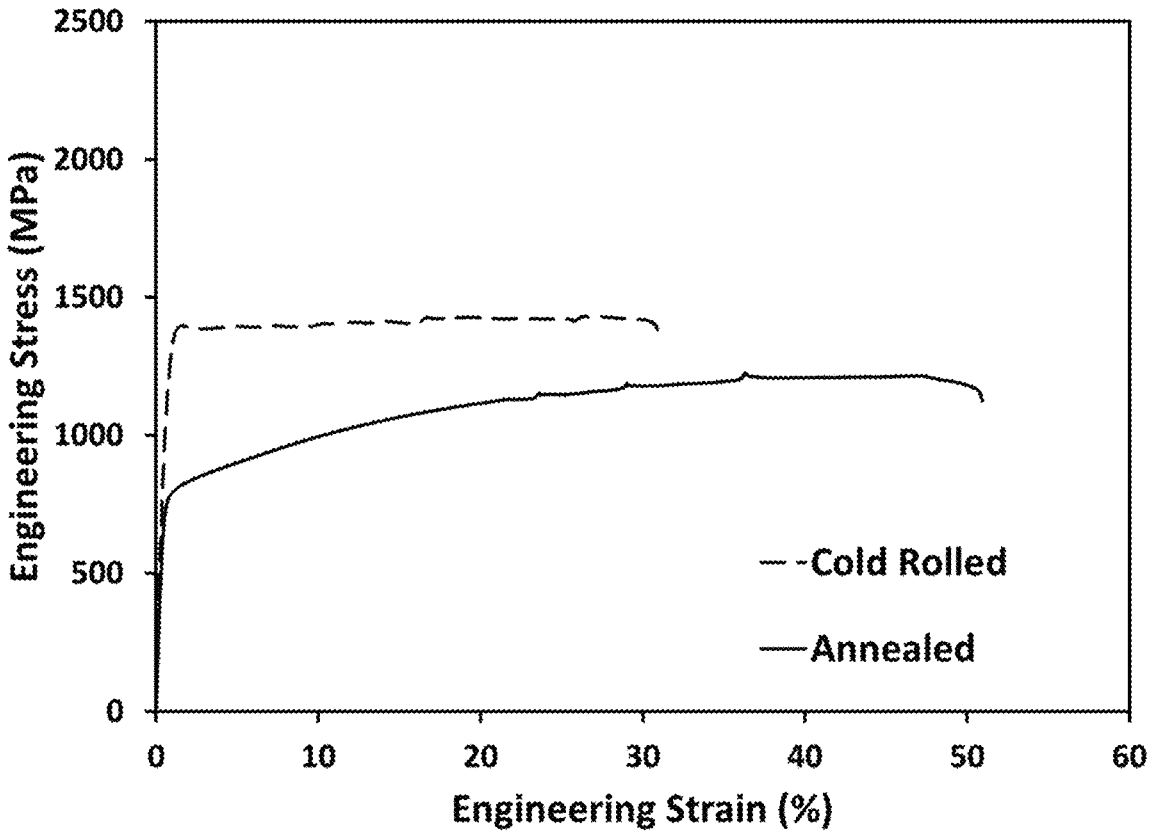
FIG. 67 Representative uniaxial tensile stress-strain curves for Alloy 41 in the cold rolled state and after annealing.

Hot band was prepared from Alloy 2 with approximately 9 mm thickness. It was heated to 200 to 250° C. for 60 minutes and rolled to approximately 4.5 mm with 10 minute reheats between rolling passes to ensure consistent temperature. Once at 4.5 mm it was sectioned and annealed at 850° C. for 10 minutes and allowed to air cool. The material was media blasted to remove the oxide and heated to the desired temperature for at least 30 minutes prior to rolling, and reheated for 10 minutes between passes to ensure consistent temperature. The material was rolled until failure (visible cracking) characterized by such visible cracks propagating in from the ends of the sheet at least 2 inches. At around 70% reduction the mill had difficulty achieving the loads necessary to reduce the material and rolling was stopped, this is an equipment limitation and not a material limitation. The control material for room temperature rolling was hot band at 4.4 mm thick which was rolled at room temperature until failure. The results of the maximum rolling reduction as a function of rolling temperature are provided in Table 27 and FIG. 39.

TABLE 27

Rolling Reduction Limit vs Rolling Temperature for Alloy 2

| Temperature (° C.) | Rolling Reduction Limit |
|---|---|
| 23 | 41.4% |
| 100 | 53.8% |
| 150 | 68.6% |
| 200 | >70% |
| 250 | >70% |

This Case Example demonstrates for the alloys herein that the limiting rolling reduction increases as temperature increases. It therefore can be seen that the alloys herein are contemplated to allow for permanent deformation with a reduction in thickness of greater than 20% before failure when heated to a temperature falling in the range of 150° C. to 400° C. More preferably, the alloys herein are such that they are contemplated to be capable of permanent deformation with a reduction in thickness of greater than 40% before failure when heated in such temperature range. This provides much greater potential deformation for rolling operations, including processing of industrial material to reach a target gauge. Greater reductions before cracking means that less steps (i.e. cold rolling and recrystallization annealing) may be required to hit a specific targeted gauge during steel production. Additionally, the greater formability demonstrated at elevated temperatures would be beneficial in making parts from a variety of forming operations including, stamping, roll forming, drawing, hydroforming etc.

Case Example #14 Development of High Yield Strength from Cold Rolled State During Galvanization Simulation Hot band from the alloys listed in Table 1 was cold rolled (i.e. permanent deformation at ≤150° C. resulting in a thickness reduction without any external heating) in Case Example #1 to provide the cold rolled properties in Table 3. From the same cold rolled sheet, additional tensile specimens were cut using wire EDM and the samples were then used for further targeted annealing studies to demonstrate high yield with ductility. Sets of 3 samples from each alloy were annealed in a Lucifer 7GT-K12 box furnace with a set point at 775° C. and dwell time of 80 seconds followed by air cooling. Note that these parameters were chosen since they simulate the conditions on a hot dip galvanization line for coating. Due to the short annealing time, samples did not reach the furnace set point temperature, thus, an instrumented sample was included to record the peak temperature of the samples during the annealing. Tensile properties were measured on an Instron mechanical testing frame (Model 3369), utilizing Instron's Bluehill control and analysis software. All tests were run at ambient temperature in displacement control.

Tensile properties of alloys herein after cold rolling and galvanization simulation annealing including peak annealing temperatures are listed in Table 28. Additionally, for each alloy, tensile curves are provided after cold rolling and after galvanization simulation as shown in FIGS. 40 to 67. As it can be seen, yield strength ranges from 538 to 1490 MPa. Tensile elongation is recorded from 12.5% to 59.4% and ultimate tensile strength ranges from 1136 to 1557 MPa.

TABLE 28

Properties of Alloys After Cold Rolling and Galvanization Simulation

| | Cold Rolling Reduction % | Peak Annealing Temperature ° C. | Tensile Elongation (%) | Ultimate Tensile Strength (MPa) | Yield Strength (MPa) |
|---|---|---|---|---|---|
| Alloy 1 | 38.0 | 652 | 40.4 | 1418 | 878 |
| | | | 41.6 | 1424 | 814 |
| | | | 41.7 | 1423 | 850 |
| Alloy 2 | 29.4 | 670 | 49.2 | 1350 | 742 |
| | | | 47.3 | 1315 | 720 |
| | | | 48.3 | 1337 | 762 |
| Alloy 10 | 35.1 | 671 | 42.3 | 1355 | 915 |
| | | | 43.1 | 1371 | 903 |
| | | | 46.4 | 1364 | 877 |

TABLE 28-continued

Properties of Alloys After Cold Rolling and Galvanization Simulation

| | Cold Rolling Reduction % | Peak Annealing Temperature ° C. | Tensile Elongation (%) | Ultimate Tensile Strength (MPa) | Yield Strength (MPa) |
|---|---|---|---|---|---|
| Alloy 11 | 32.7 | 676 | 32.9 | 1466 | 861 |
| | | | 32.9 | 1467 | 989 |
| | | | 31.2 | 1454 | 1046 |
| Alloy 13 | 36.5 | 683 | 49.7 | 1271 | 803 |
| | | | 43.2 | 1289 | 909 |
| | | | 44.8 | 1274 | 911 |
| Alloy 14 | 34.5 | 678 | 32.5 | 1432 | 1048 |
| | | | 34.1 | 1448 | 951 |
| | | | 31.2 | 1431 | 1048 |
| Alloy 15 | 37.3 | 682 | 21.8 | 1466 | 1173 |
| | | | 13.6 | 1514 | 1392 |
| | | | 12.5 | 1557 | 1490 |
| Alloy 16 | 36.9 | 687 | 42.2 | 1384 | 915 |
| | | | 40.9 | 1402 | 956 |
| | | | 42.8 | 1415 | 908 |
| Alloy 17 | 36.0 | 684 | 33.7 | 1407 | 1108 |
| | | | 35.5 | 1392 | 1063 |
| | | | 41.0 | 1410 | 904 |
| Alloy 18 | 37.3 | 657 | 41.0 | 1384 | 1048 |
| | | | 42.7 | 1387 | 856 |
| | | | 44.1 | 1389 | 881 |
| Alloy 19 | 38.0 | 660 | 42.0 | 1443 | 893 |
| | | | 38.1 | 1432 | 963 |
| | | | 41.8 | 1446 | 863 |
| Alloy 20 | 38.3 | 654 | 41.9 | 1466 | 1007 |
| | | | 25.3 | 1449 | 1223 |
| | | | 32.2 | 1435 | 1116 |
| Alloy 21 | 34.1 | 670 | 39.7 | 1435 | 800 |
| | | | 40.1 | 1402 | 916 |
| | | | 48.6 | 1388 | 627 |
| Alloy 22 | 38.0 | 692 | 40.7 | 1422 | 898 |
| | | | 44.0 | 1401 | 772 |
| | | | 45.2 | 1427 | 901 |
| Alloy 23 | 37.4 | 683 | 43.0 | 1372 | 897 |
| | | | 33.9 | 1355 | 1032 |
| | | | 24.2 | 1392 | 1015 |
| Alloy 24 | 37.5 | 687 | 35.5 | 1364 | 995 |
| | | | 36.6 | 1361 | 908 |
| | | | 40.8 | 1394 | 885 |
| Alloy 25 | 33.5 | 682 | 37.7 | 1343 | 1014 |
| | | | 45.7 | 1373 | 826 |
| | | | 40.1 | 1359 | 882 |
| | | | 44.7 | 1276 | 884 |
| | | | 45.2 | 1258 | 901 |
| Alloy 29 | 38.8 | 665 | 45.2 | 1423 | 946 |
| | | | 36.1 | 1385 | 1066 |
| | | | 19.1 | 1447 | 1117 |
| Alloy 30 | 39.9 | 674 | 43.1 | 1421 | 943 |
| | | | 40.3 | 1430 | 925 |
| | | | 38.9 | 1456 | 845 |
| Alloy 31 | 40.5 | 681 | 38.1 | 1443 | 1018 |
| | | | 38.4 | 1446 | 1004 |
| | | | 41.2 | 1441 | 860 |
| Alloy 32 | 41.1 | 676 | 35.6 | 1477 | 1076 |
| | | | 35.6 | 1498 | 987 |
| | | | 41.8 | 1494 | 863 |
| Alloy 33 | 38.2 | 677 | 19.7 | 1544 | 1314 |
| | | | 37.7 | 1522 | 863 |
| | | | 34.4 | 1490 | 1079 |
| Alloy 34 | 39.0 | 668 | 28.8 | 1313 | 1076 |
| | | | 36.8 | 1198 | 865 |
| | | | 24.7 | 1371 | 1141 |
| Alloy 36 | 36.7 | 709 | 38.7 | 1352 | 923 |
| | | | 41.7 | 1332 | 899 |
| | | | 41.3 | 1353 | 922 |
| Alloy 38 | 43.0 | 680 | 30.9 | 1385 | 899 |
| | | | 48.9 | 1217 | 588 |
| | | | 35.8 | 1297 | 774 |
| Alloy 39 | 36.5 | 691 | 49.3 | 1403 | 538 |
| | | | 50.1 | 1408 | 545 |

TABLE 28-continued

Properties of Alloys After Cold Rolling and Galvanization Simulation

| | Cold Rolling Reduction % | Peak Annealing Temperature ° C. | Tensile Elongation (%) | Ultimate Tensile Strength (MPa) | Yield Strength (MPa) |
|---|---|---|---|---|---|
| Alloy 40 | 37.4 | 705 | 52.2 | 1452 | 703 |
| | | | 48.3 | 1420 | 661 |
| | | | 51.7 | 1491 | 695 |
| Alloy 41 | 39.2 | 691 | 50.9 | 1224 | 731 |
| | | | 45.2 | 1274 | 803 |
| | | | 59.4 | 1136 | 594 |

This Case Example illustrates that high yield strength from 538 to 1490 MPa with improved ductility, can be achieved in the cold rolled alloys herein during heat exposure during galvanization process at a temperature from 652 to 709° C.

Case Example #15 Effect of Temperature During Galvanization Simulation on High Yield Strength Development Hot band from Alloy 2 was cold rolled (i.e. permanent deformation at ≤150° C. resulting in a thickness reduction without any external heating) with final cold rolling reductions of 25% and 29% to a final thickness of approximately 1.4 mm. Tensile specimens were cut from each cold rolled sheet using wire EDM. Sets of 3 samples were annealed in a Lucifer 7GT-K12 box furnace with a dwell time of 80 seconds followed by air cooling that simulates the potential conditions on the galvanization line during commercial production. An instrumented sample was included to record the peak temperature of the samples during the annealing. The furnace set point was varied from 500° C. to 850° C. to achieve peak temperatures from 405° C. to 752° C. Tensile properties were measured on an Instron mechanical testing frame (Model 3369), utilizing Instron's Bluehill control and analysis software. All tests were run at ambient temperature in displacement control.

Figure 68:
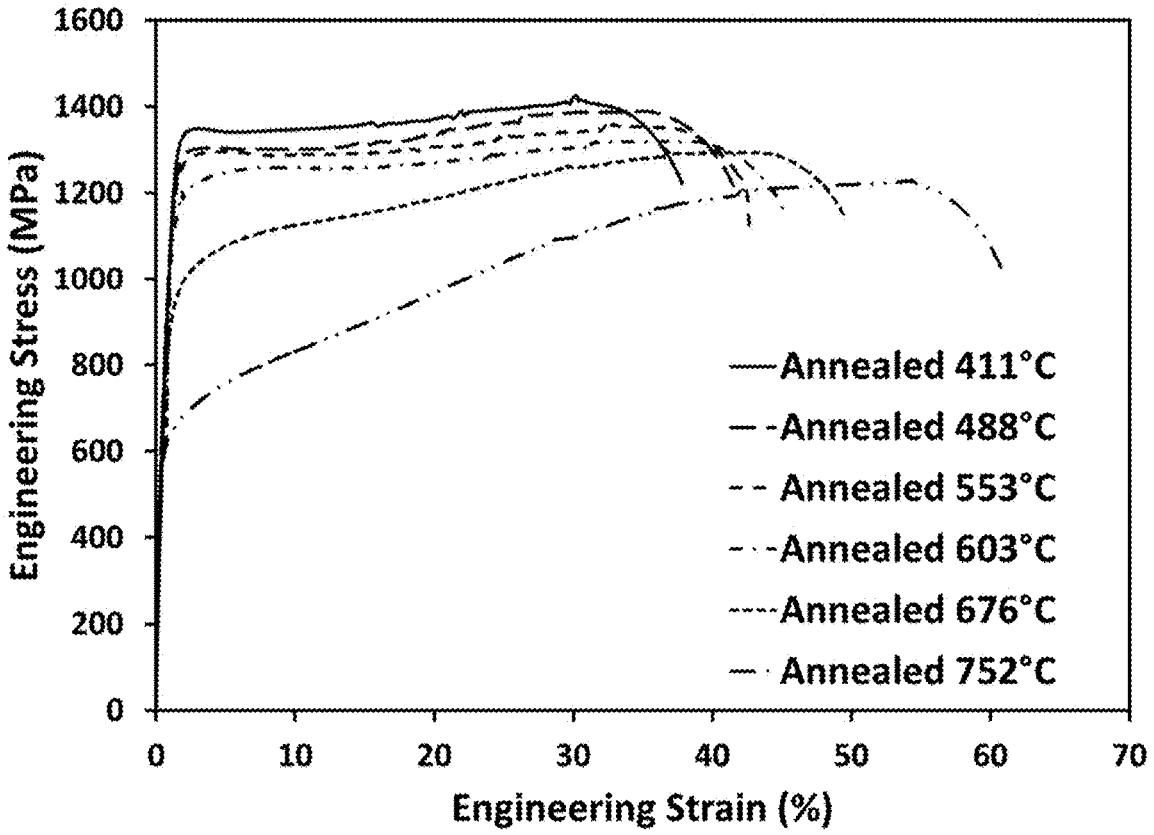
FIG. 68 Representative uniaxial tensile stress-strain curves for Alloy 2 cold rolled (25%) and annealed at various temperatures.
Figure 69:
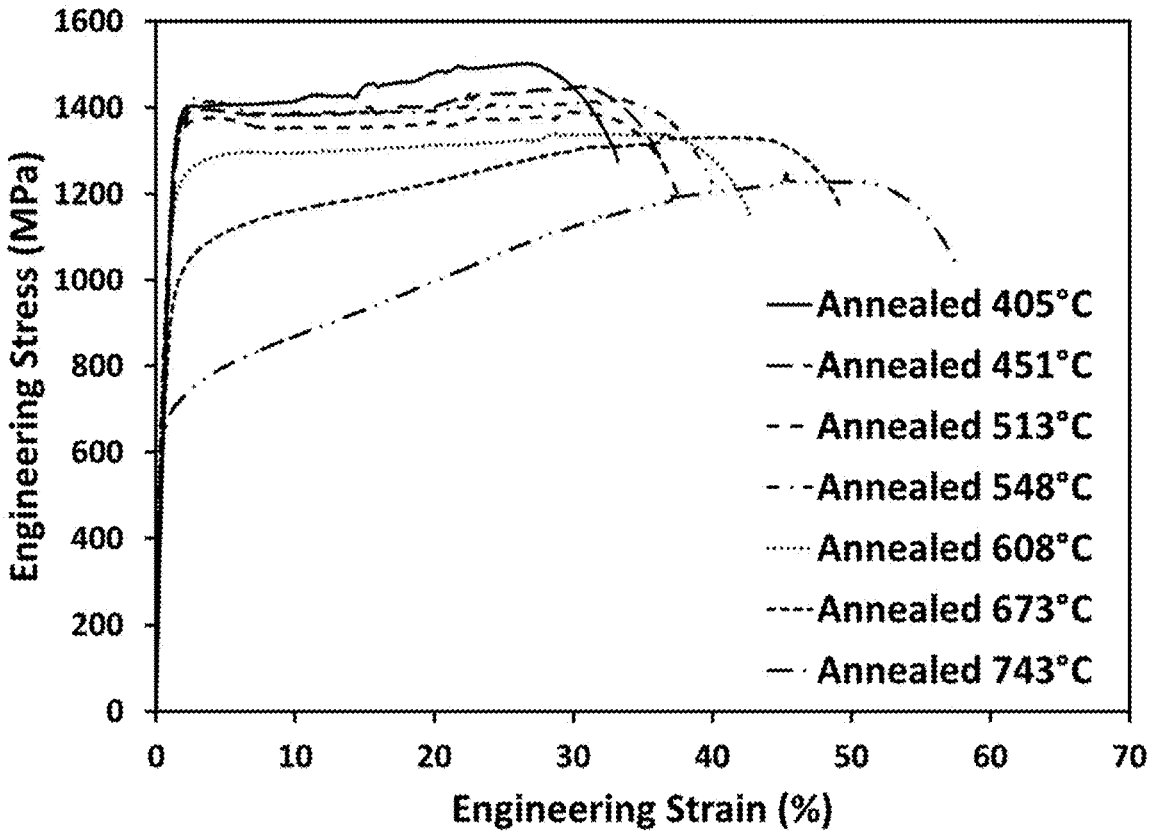
FIG. 69 Representative uniaxial tensile stress-strain curves for Alloy 2 cold rolled (29%) and annealed at various temperatures.

Tensile properties of alloys herein after cold rolling and galvanization simulation annealing at different temperatures are listed in Table 29. Additionally, for the 25% and 29% reduced samples, the individual tensile curves for various thermal exposures are provided in FIG. 68 and FIG. 69, respectively. Yield strength of the Alloy 2 ranges from 560 MPa to 1141 MPa. Tensile elongation is recorded from 31.8% to 64.2% and ultimate tensile strength ranged from 1206 MPa to 1502 MPa.

TABLE 29

Properties of Alloy 2 After Cold Rolling and Galvanization Simulation

| Cold Rolling Reduction % | Peak Annealing Temperature ° C. | Tensile Elongation (%) | Ultimate Tensile Strength (MPa) | Yield Strength (MPa) |
|---|---|---|---|---|
| 25 | 411 | 37.9 | 1425 | 817 |
| | | 39.3 | 1419 | 825 |
| | | 37.1 | 1434 | 830 |
| | 488 | 41.6 | 1387 | 894 |
| | | 41.6 | 1390 | 787 |
| | | 42.1 | 1395 | 801 |

TABLE 29-continued

| Properties of Alloy 2 After Cold Rolling and Galvanization Simulation | | | | |
|---|---|---|---|---|
| Cold Rolling Reduction % | Peak Annealing Temperature ° C. | Tensile Elongation (%) | Ultimate Tensile Strength (MPa) | Yield Strength (MPa) |
| | 553 | 43.7 | 1371 | 786 |
| | | 41.9 | 1364 | 867 |
| | | 42.7 | 1363 | 838 |
| | 603 | 47.8 | 1309 | 803 |
| | | 45.5 | 1320 | 815 |
| | | 43.4 | 1329 | 699 |
| | 676 | 47.0 | 1314 | 652 |
| | | 50.7 | 1310 | 676 |
| | | 49.5 | 1300 | 703 |
| | 752 | 60.8 | 1229 | 560 |
| | | 59.8 | 1262 | 579 |
| 29 | 405 | 33.5 | 1485 | 1037 |
| | | 33.2 | 1502 | 1141 |
| | | 31.8 | 1487 | 897 |
| | 451 | 36.3 | 1463 | 1009 |
| | | 36.7 | 1452 | 996 |
| | | 36.8 | 1466 | 919 |
| | 513 | 36.4 | 1453 | 956 |
| | | 39.2 | 1423 | 929 |
| | | 37.5 | 1391 | 899 |
| | 548 | 40.0 | 1424 | 883 |
| | | 40.1 | 1379 | 858 |
| | | 39.0 | 1401 | 1007 |
| | 608 | 42.8 | 1340 | 821 |
| | | 44.6 | 1337 | 836 |
| | | 41.3 | 1364 | 941 |
| | 673 | 51.7 | 1327 | 712 |
| | | 49.2 | 1338 | 764 |
| | | 48.7 | 1328 | 761 |
| | 743 | 57.4 | 1242 | 615 |
| | | 57.5 | 1247 | 614 |
| | | 64.2 | 1206 | 602 |

This Case Example illustrates that high yield strength from 560 MPa to 1141 MPa with improved ductility, can be achieved in the cold rolled alloys herein during galvanization process simulation in a wide temperature range from 405 to 752° C.

Case Example #16 Effect of Dwell Time on High Yield Strength Development During Galvanization Simulation Hot band from Alloys 2 and Alloy 13 were cold rolled with final cold rolling reductions of 32% and 37%, respectively, to a final thickness of approximately 1.2 mm. Tensile specimens were cut from each cold rolled sheet using wire EDM. Sets of 3 samples were annealed in a Lucifer 7GT-K12 box furnace with a furnace set point at 725° C. for variable time followed by air cooling that simulates the potential conditions on the galvanization line during commercial production. An instrumented sample was included to record the peak temperature of the samples during the annealing. The annealing time varied from 50 seconds to 200 seconds to achieve peak annealing temperatures from 532° C. to 709° C. Tensile properties were measured on an Instron mechanical testing frame (Model 3369), utilizing Instron's Bluehill control and analysis software. All tests were run at ambient temperature in displacement control.

Figure 70:
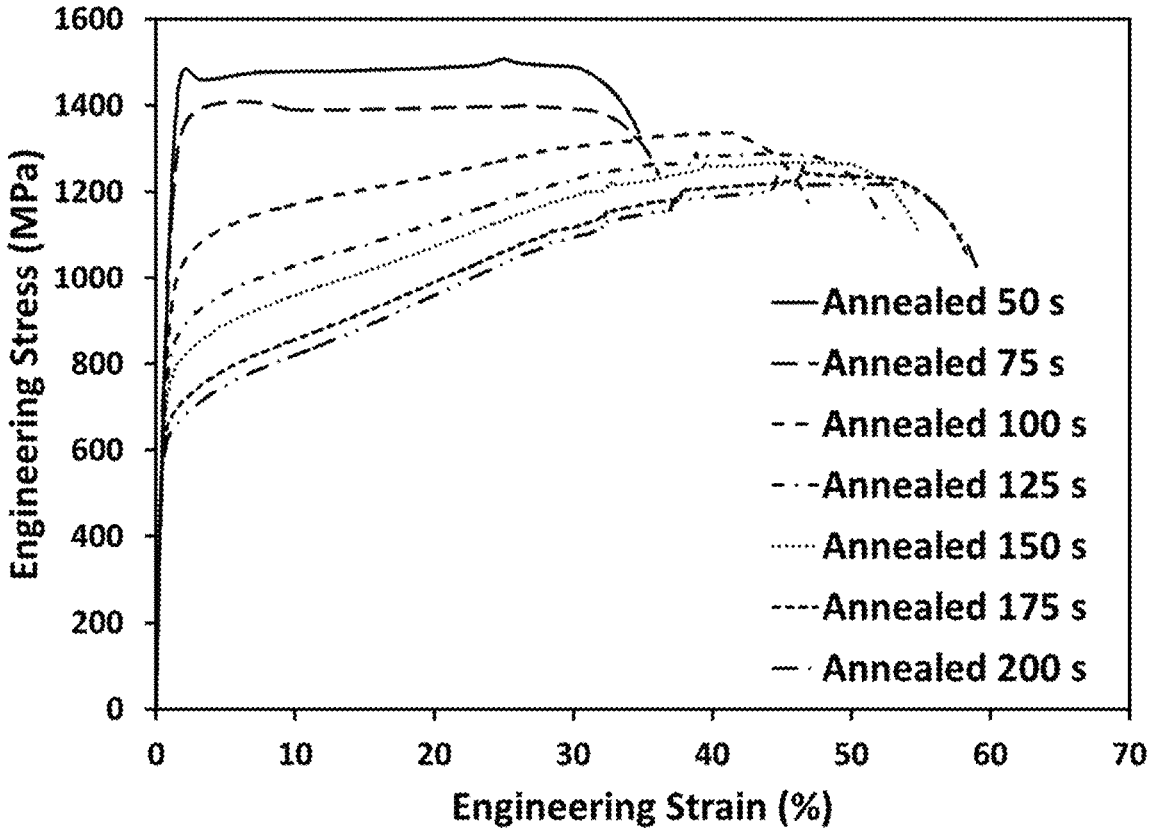
FIG. 70 Representative uniaxial tensile stress-strain curves for Alloy 2 cold rolled and annealed at various hold times.
Figure 71:
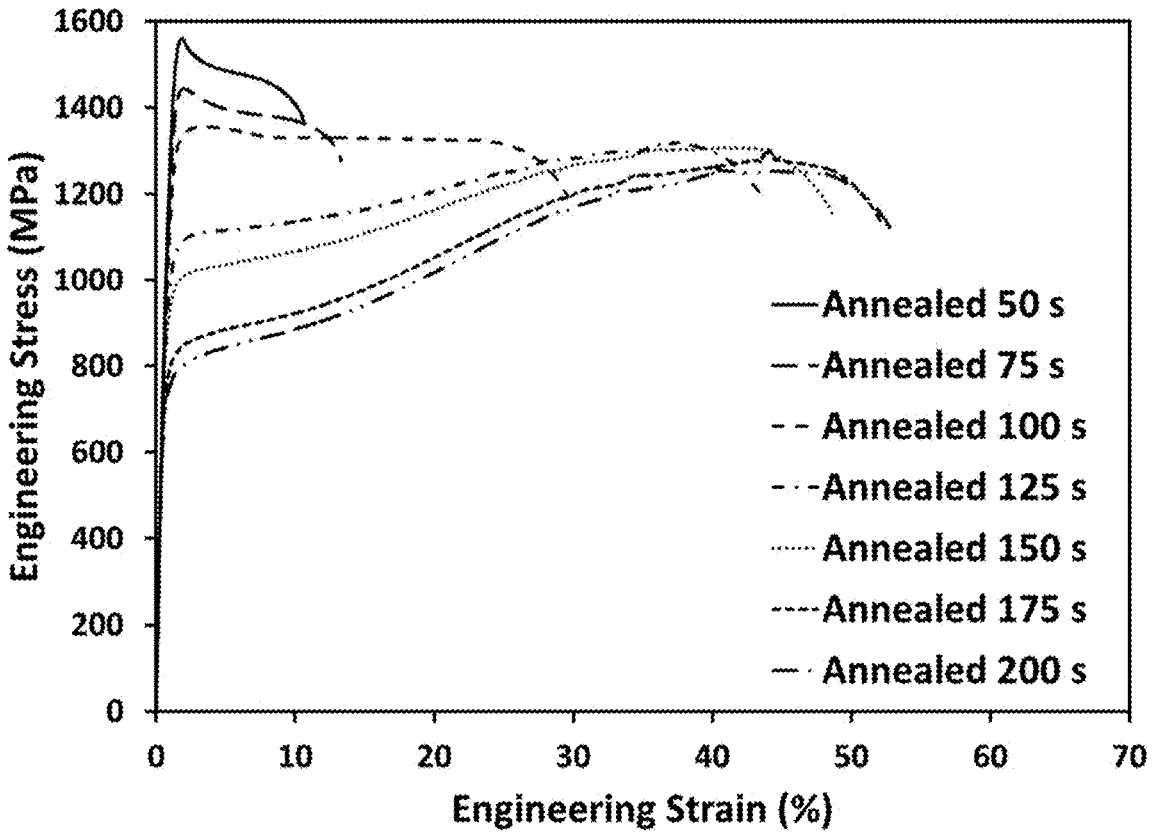
FIG. 71 Representative uniaxial tensile stress-strain curves for Alloy 13 cold rolled and annealed at various hold times.

Tensile properties of alloys herein after cold rolling and galvanization simulation annealing with various dwell time are listed in Table 30. Additionally, tensile curves are provided for Alloys 2 and 13 as a function of various time exposures in FIG. 70 and FIG. 71, respectively. Yield strength in alloys herein ranges from 564 to 1184 MPa. Tensile elongation is recorded from 10.3 to 60.0% and ultimate tensile strength ranges from 1207 to 1508 MPa.

TABLE 30

| Properties of Alloys 2 and 13 After Cold Rolling and Galvanization Simulation | | | | | |
|---|---|---|---|---|---|
| Alloy | Peak Annealing Temperature ° C. | Annealing Time s | Tensile Elongation (%) | Ultimate Tensile Strength (MPa) | Yield Strength (MPa) |
| Alloy 2 | 532 | 50 | 34.8 | 1508 | 1078 |
| | | | 33.2 | 1497 | 974 |
| | | | 37.4 | 1496 | 1002 |
| | 625 | 75 | 36.1 | 1410 | 915 |
| | | | 43.4 | 1363 | 846 |
| | | | 33.9 | 1402 | 970 |
| | 672 | 100 | 45.4 | 1366 | 802 |
| | | | 48.3 | 1372 | 783 |
| | | | 46.9 | 1336 | 773 |
| | 695 | 125 | 52.4 | 1285 | 703 |
| | | | 52.7 | 1289 | 726 |
| | | | 53.5 | 1287 | 730 |
| | 697 | 150 | 54.8 | 1269 | 672 |
| | | | 56.4 | 1266 | 672 |
| | | | 53.3 | 1274 | 667 |
| | 709 | 175 | 54.7 | 1255 | 613 |
| | | | 58.7 | 1244 | 622 |
| | | | 58.4 | 1261 | 609 |
| | 703 | 200 | 60.0 | 1236 | 594 |
| | | | 59.0 | 1235 | 581 |
| | | | 56.2 | 1207 | 590 |
| Alloy 13 | 570 | 50 | 12.4 | 1453 | 1169 |
| | | | 12.3 | 1456 | 1184 |
| | | | 10.3 | 1496 | 1167 |
| | 610 | 75 | 13.4 | 1444 | 1108 |
| | | | 14.1 | 1498 | 1111 |
| | | | 13.3 | 1493 | 1138 |
| | 662 | 100 | 18.2 | 1376 | 1057 |
| | | | 29.6 | 1356 | 1035 |
| | | | 40.0 | 1312 | 1024 |
| | 687 | 125 | 46.8 | 1315 | 895 |
| | | | 41.2 | 1305 | 909 |
| | | | 43.8 | 1319 | 906 |
| | 698 | 150 | 49.0 | 1291 | 734 |
| | | | 48.5 | 1315 | 853 |
| | | | 48.7 | 1306 | 788 |
| | 709 | 175 | 52.9 | 1298 | 732 |
| | | | 50.2 | 1285 | 726 |
| | | | 52.3 | 1302 | 713 |
| | 707 | 200 | 52.2 | 1297 | 688 |
| | | | 53.1 | 1264 | 680 |
| | | | 53.7 | 1267 | 564 |

This Case Example illustrates that high yield strength from 564 to 1184 MPa with improved ductility can be achieved in alloys herein during galvanization process with a wide range of time at temperature ranging from 50 to 200 s.

The invention claimed is:

1. A method of forming a metal alloy into sheet comprising:

a. supplying a metal alloy comprising at least 70 atomic % iron and at least four or more elements selected from Si, Mn, Cr, Ni, Cu or C, melting said alloy, cooling at a rate of $10^{-4}$ K/sec to $10^{3}$ K/sec and solidifying to a thickness of >5.0 mm to 500 mm;

b. processing said alloy into a first sheet form with thickness from 0.5 to 5.0 mm;

c. permanently deforming said alloy in a temperature of ≤150° C. into a second sheet form, exhibiting the following tensile property combinations;

(1) total elongation of 2.0 to 35.0%;

(2) ultimate tensile strength of 1350 to 2300 MPa;

(3) yield strength of 950 to 2075 MPa;

d. applying a thermal exposure on said second sheet from ≥400° C. to ≤775° C. and for a time of ≥25 to ≤225 s wherein said second sheet form after said thermal exposure has the following tensile property combinations:
(1) total elongation of 10.0% to 65.0%;
(2) ultimate tensile strength of 1100 MPa to 1600 MPa
(3) yield strength of 500 MPa to 1500 MPa.

2. The method of claim 1 wherein in step (c), permanently deforming said alloy at a temperature of ≤150° C. comprises reducing the thickness in step (b) by ≥10%.

3. The method of claim 1 wherein in step (c), permanently deforming said alloy at a temperature of <150° C. comprises reducing the thickness in step (b) to a thickness of 0.45 mm to 4.5 mm.

4. The method of claim 1 wherein step (d) is provided by a galvanization coating process wherein said sheet is coated with zinc or a zinc alloy.

5. The method of claim 4 wherein said zinc or zinc alloy has a thickness of 5 μm to 100 μm.

6. The method of claim 1 wherein said second sheet provided in step (d) is positioned in a vehicle frame, vehicular chassis or vehicular panel.

7. The method of claim 1 wherein said second sheet provided in step (d) is positioned in one of a drill collar, drill pipe, pipe casing, tool joint, wellhead, compressed gas storage tank, railway tank car/tank wagon or liquified natural gas canister.

8. A method of forming a metal alloy into sheet comprising:

a. supplying a metal alloy comprising at least 70 atomic % iron and at least four or more elements selected from Si, Mn, Cr, Ni, Cu or C, melting said alloy, cooling at a rate of $10^{-4}$ K/sec to $10^{3}$ K/sec and solidifying to a thickness of >5.0 mm to 500 mm;
b. processing said alloy into a first sheet form with thickness from 0.5 to 5.0 mm;
c. permanently deforming said alloy in a temperature of ≤150° C. into a second sheet form, exhibiting the following tensile property combinations;
(1) total elongation of 2.0 to 35.0%;
(2) ultimate tensile strength of 1350 to 2300 MPa;
(3) yield strength of 950 to 2075 MPa;
d. coating said sheet by exposing to a molten zinc or molten zinc alloy which provides a thermal exposure on said second sheet from ≥400° C. to ≤775° C. and for a time of ≥25 seconds to ≤225 seconds wherein said second sheet form after said thermal exposure and coating of zinc or zinc alloy has the following tensile property combinations:
(1) total elongation of 10.0% to 65.0%;
(2) ultimate tensile strength of 1100 MPa to 1600 MPa
(3) yield strength of 500 MPa to 1500 MPa.

9. The method of claim 1 wherein said alloy comprises at least 70 atomic percent iron, 0-2000 ppm impurities and at least four or more elements selected from the following:
Si (1.0 at. % to 6.5 at. %)
Mn (3.0 at. % to 15.5 at. %)
Cr (0.5 at. % to 9.0 at. %)
Ni (0.5 at. % to 10.5 at. %);
Cu (0.25 at. % to 2.5 at. %);
C (0.5 at. % to 4.0 at. %);
wherein the atomic percent of iron, said selected elements, and the presence of impurities in said alloy adds up to 100 atomic percent.

10. The method of claim 1 wherein said alloy comprises at least 70 atomic percent iron, 0-2000 ppm impurities, and at least five or more elements selected from the following:
Si (1.0 at. % to 6.5 at. %)
Mn (3.0 at. % to 15.5 at. %)
Cr (0.5 at. % to 9.0 at. %)
Ni (0.5 at. % to 10.5 at. %);
Cu (0.25 at. % to 2.5 at. %);
C (0.5 at. % to 4.0 at. %); and
wherein the atomic percent of iron, said selected elements, and the presence of impurities in said alloy adds up to 100 atomic percent.

11. The method of claim 1 wherein said alloy comprises at least 70 atomic percent iron, 0-2000 ppm impurities and the following elements:
Si (1.0 at. % to 6.5 at. %)
Mn (3.0 at. % to 15.5 at. %)
Cr (0.5 at. % to 9.0 at. %)
Ni (0.5 at. % to 10.5 at. %);
Cu (0.25 at. % to 2.5 at. %);
C (0.5 at. % to 4.0 at. %); and
wherein the atomic percent of iron, said elements in said alloy, and the presence of impurities adds up to 100 atomic percent.

12. The method of claim 8 wherein the level of Fe is in the range of 70 atomic percent to 85 atomic percent.

13. The method of claim 12 wherein said zinc or zinc alloy coating has a thickness of 5 μm to 100 μm.

14. The method of claim 12 wherein in step (c), permanently deforming said alloy at a temperature of ≤150° C. comprises reducing the thickness in step (b) by ≥10%.

15. The method of claim 12 wherein in step (c), permanently deforming said alloy at a temperature of <150° C. comprises reducing the thickness in step (b) to a thickness of 0.45 mm to 4.5 mm.

16. The method of claim 12 wherein said second sheet in step (d) is positioned in a vehicle frame, vehicular chassis or vehicular panel.

17. The method of claim 12 wherein said second sheet in step (d) is positioned in one of a drill collar, drill pipe, pipe casing, tool joint, wellhead, compressed gas storage tank, railway tank car/tank wagon or liquified natural gas canister.

18. The method of claim 12 wherein said alloy comprises at least 70 atomic percent iron, 0-2000 ppm impurities and at least four or more elements selected from the following:
Si (1.0 at. % to 6.5 at. %)
Mn (3.0 at. % to 15.5 at. %)
Cr (0.5 at. % to 9.0 at. %)
Ni (0.5 at. % to 10.5 at. %);
Cu (0.25 at. % to 2.5 at. %);
C (0.5 at. % to 4.0 at. %);
wherein the atomic percent of said iron, selected elements, and the presence of impurities in said alloy adds up to 100 atomic percent.

19. The method of claim 1 wherein said alloy comprises at least 70 atomic percent iron, 0-2000 ppm impurities, and at least five or more elements selected from the following:
Si (1.0 at. % to 6.5 at. %)
Mn (3.0 at. % to 15.5 at. %)
Cr (0.5 at. % to 9.0 at. %)
Ni (0.5 at. % to 10.5 at. %);
Cu (0.25 at. % to 2.5 at. %);
C (0.5 at. % to 4.0 at. %); and
wherein the atomic percent of iron, said selected elements, and the presence of impurities in said alloy adds up to 100 atomic percent.

20. The method of claim 1 wherein said alloy comprises at least 70 atomic percent iron, 0-2000 ppm impurities and the following elements:

Si (1.0 at. % to 6.5 at. %)
Mn (3.0 at. % to 15.5 at. %)
Cr (0.5 at. % to 9.0 at. %)
Ni (0.5 at. % to 10.5 at. %);
Cu (0.25 at. % to 2.5 at. %);
C (0.5 at. % to 4.0 at. %); and
wherein the atomic percent of iron, said elements in said alloy, and the presence of impurities adds up to 100 atomic percent.

* * * * *